US006649337B2

(12) United States Patent
Hioki et al.

(10) Patent No.: US 6,649,337 B2
(45) Date of Patent: Nov. 18, 2003

(54) HEAT-DEVELOPABLE PHOTOSENSITIVE MATERIAL

(75) Inventors: Takanori Hioki, Kanagawa (JP); Katsumi Kobayashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/987,620

(22) Filed: Nov. 15, 2001

(65) Prior Publication Data

US 2002/0106594 A1 Aug. 8, 2002

(30) Foreign Application Priority Data

Nov. 17, 2000 (JP) ..... P2000-351349
Sep. 28, 2001 (JP) ..... P2001-302129

(51) Int. Cl.[7] ..... G03C 1/12; G03C 1/498

(52) U.S. Cl. ..... 430/619; 430/572; 430/578; 430/579; 430/583; 430/584; 430/585; 430/586; 430/587; 430/588; 430/591; 430/592; 430/593; 430/594

(58) Field of Search ..... 430/619, 583, 430/572, 584, 585, 586, 587, 588, 591, 592, 593, 594, 578, 579

(56) References Cited

U.S. PATENT DOCUMENTS 3,976,493 A * 8/1976 Borror et al.
5,482,814 A * 1/1996 Ooi et al. ..... 430/203
5,871,897 A * 2/1999 Kato ..... 430/581

FOREIGN PATENT DOCUMENTS

EP 0887700 * 12/1998
JP 2000-098525 A 4/2000
JP 2000-122206 A 4/2000

* cited by examiner

*Primary Examiner*—Thorl Chea
(74) *Attorney, Agent, or Firm*—Birch, Stewart, Kolasch & Birch, LLP

(57) ABSTRACT

A heat-developable photosensitive material comprises: a support; a photosensitive silver halide; a non-photosensitive organic silver salt; a reducing agent for a silver ion; a binder; and a compound having specified structure.

17 Claims, No Drawings

HEAT-DEVELOPABLE PHOTOSENSITIVE MATERIAL

FIELD OF THE INVENTION

The present invention relates to a heat-developable photosensitive material. More specifically, the present invention relates to a heat-developable photosensitive material that is excellent in sensitivity and storage stability.

BACKGROUND OF THE INVENTION

Reduction of waste solutions has been strongly desired in recent years in the field of films for medical diagnosis and photomechanical process from the viewpoint of environmental protection and space saving. Accordingly, techniques concerning heat-developable recording materials as the films for medical diagnosis and photomechanical process capable of performing exposure efficiently with a laser/image setter or a laser/imager and forming a clear black image exhibiting high resolution and sharpness have been required. Such a heat-developable recording material can offer to customers a simpler and environmentally benign heat development processing system in which chemicals in solution system is not necessary for processing.

There also arises the same requirement in the field of general image-forming materials, but particularly image for the medical diagnosis have characteristics in that a cold tone image is preferable because high image quality excellent in sharpness and graininess is necessary as precise imaging is required and, in addition, from the viewpoint of easiness of diagnosis. At present, various hard copy systems utilizing pigments and dyes such as ink jet printers and electrophotography prevail as general image-forming systems, but none of these systems are satisfactory as a medical image output system.

On the other hand, thermal image-forming systems making use of organic silver salts are described, e.g., in U.S. Pat. Nos. 3, 152,904 and 3,457,075, and D. Klosterboer, *Thermally Processed Silver Systems*, "Imaging Processes and Materials", compiled by Sturge, V. Walworth, A. Shepp, 8th Ed., Chap. 9, p. 279, Neblette (1989).

A heat-developable photosensitive material generally has a photosensitive layer comprising a catalytically active amount of photocatalyst (e.g., a silver halide), a reducing agent, a reducible silver salt (e.g., an organic silver salt) and, if necessary, a toner which controls the tone of silver, which have been dispersed in a binder matrix. A heat-developable photosensitive material forms a black silver image by heating at high temperature (e.g., 80° C. or more) after image exposure to cause an oxidation reduction reaction between a reducible silver salt (which functions as an oxidizing agent) and a reducing agent. The oxidation reduction reaction is accelerated by the catalytic action of the latent image of the silver halide generated by exposure. Therefore, the black silver image is formed in the exposed area.

These heat-developable image-recording materials are described in various literature including U.S. Pat. No. 2,910,377 and JP-B-43-4924 (the term "JP-B" as used herein means an "examined Japanese patent publication").

Various spectral sensitizing dyes have so far been used for silver halides for use in these heat-developable photosensitive materials and every endeavor has been made for attaining a higher sensitization and improving storage stability. For example, methods of using the sensitizing dyes disclosed in JP-A-2000-98525 and JP-A-2000-122206 (the term "JP-A" as used herein means an "unexamined published Japanese patent application") are known. However, further improvement of storage stability has been required even when these sensitizing dyes are used.

SUMMARY OF THE INVENTION

An object of the present invention is to solve the above-described technical problems, i.e., an object of the present invention is to provide a heat-developable photosensitive material that has a high sensitivity and is an excellent in a storage stability.

As a result of eager investigation to solve the above problems, the present inventor has found that a heat-developable photosensitive material excellent in a sensitivity and storage stability can be obtained by using as a sensitizing dye a compound having specific structure in which two or more dyes are linked by covalent bonding, thus the present invention has been accomplished.

That is, the present invention comprises the following structure:

(1) A heat-developable photosensitive material comprising:

a support;

a photosensitive silver halide;

a non-photosensitive organic silver salt;

a reducing agent for a silver ion;

a binder; and a compound represented by formula (A):

$$D^a([\text{—}L^a\text{—}]q^b[D^b]q^a)r^a \quad M^a m^a \tag{A}$$

wherein $D^a$ and $D^b$ each independently represents a dye chromophore; $L^a$ represents a linking group or a single bond; $q^a$ and $r^a$ each represents an integer of from 1 to 100; $q^b$ represents an integer of from 1 to 4; $M^a$ represents a counter ion for equilibrating the electric charge; and $m^a$ represents a number necessary to neutralize the electric charge of the molecule.

(2) The heat-developable photosensitive material as described in item (1), wherein the compound represented by formula (A) is a compound having a structure represented by formula (I):

$$D^1([\text{—}L^1\text{—}]q^2[D^1]q^1)r^1 \quad M^1 m^1 \tag{I}$$

wherein $D^1$ represents a dye chromophore; $L^1$ represents a linking group or a single bond; $q^1$ and $r^1$ each represents an integer of from 1 to 100; $q^2$ represents an integer of from 1 to 4; $M^1$ represents a counter ion for equilibrating the electric charge; and $m^1$ represents a number necessary to neutralize the electric charge of the molecule.

(3) The heat-developable photosensitive material as described in item (2), wherein $D^1$ is a dye chromophore having a structure represented by one of formulae (XI), (XII) and (XIII):

(XI)

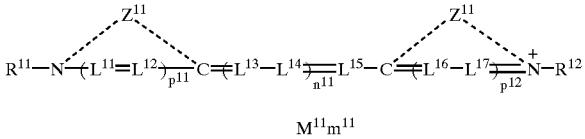

$M^{11}m^{11}$ wherein $L^{11}$, $L^{12}$, $L^{13}$, $L^{14}$, $L^{15}$, $L^{16}$ and $L^{17}$ each represents a methine group; $p^{11}$ and $p^{12}$ each represents 0 or 1; $n^{11}$ represents 0, 1, 2, 3 or 4; $Z^{11}$ and $Z^{12}$ each represents an atomic group necessary to form a nitrogen-containing heterocyclic ring, and $Z^{11}$ and $Z^{12}$ each may be a condensed ring; $M^{11}$ represents a counter ion for equilibrating the electric charge; $m^1$ represents a number of 0 or higher necessary to neutralize the electric charge of the molecule; and $R^{11}$ and $R^{12}$ each represents a hydrogen atom, an alkyl group, an aryl group or a heterocyclic group;

(XII)

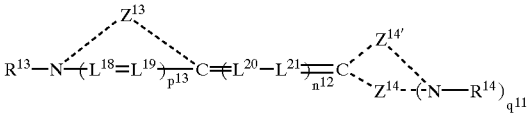

$M^{12}m^{12}$ wherein $L^{18}$, $L^{19}$, $L^{20}$ and $L^{21}$ each represents a methine group; $p^{13}$ represents 0 or 1; $q^{11}$ represents 0 or 1; $n^{12}$ represents 0, 1, 2, 3 or 4; $Z^{13}$ represents an atomic group necessary to form a nitrogen-containing heterocyclic ring; $Z^{14}$ and $Z^{14'}$ each represents an atomic group necessary to form a heterocyclic ring or an acyclic acidic terminal group together with $(N—R^{14})$ $q^{11}$; $Z^{13}$, and $Z^{14}$ and $Z^{14'}$ each may be a condensed ring; $M^{12}$ represents a counter ion for equilibrating the electric charge; $m^{12}$ represents a number of 0 or higher necessary to neutralize the electric charge of the molecule; and $R^{13}$ and $R^{14}$ each represents a hydrogen atom, an alkyl group, an aryl group or a heterocyclic group;

(XIII)

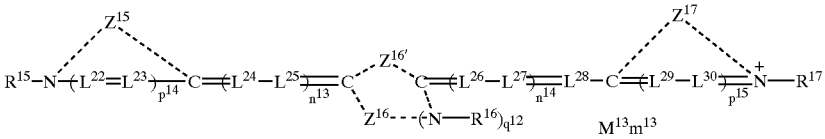

$M^{13}m^{13}$ wherein $L^{22}$, $L^{23}$, $L^{24}$, $L^{25}$, $L^{26}$, $L^{27}$, $L^{28}$, $L^{29}$ and $L^{30}$ each represents a methine group; $p^{14}$ and $p^{15}$ each represents 0 or 1; $q^{12}$ represents 0 or 1; $n^{13}$ and $n^{14}$ each represents 0, 1, 2, 3 or 4; $Z^{15}$ and $Z^{17}$ each represents an atomic group necessary to form a nitrogen-containing heterocyclic ring; $Z^{16}$ and $Z^{16}$ each represents an atomic group necessary to form a heterocyclic ring together with $(N—R^{16})q^{12}$; $Z^{15}$, $Z^{16}$ and $Z^{16'}$, and $Z^{17}$ each may be a condensed ring; $M^{13}$ represents a counter ion for equilibrating the electric charge; $m^{13}$ represents a number of 0 or higher necessary to neutralize the electric charge of the molecule; and $R^{15}$, $R^{16}$ and $R^{17}$ each represents a hydrogen atom, an alkyl group, an aryl group or a heterocyclic group.

(4) The heat-developable photosensitive material as described in item (2), wherein the compound represented by formula (I) is a compound represented by one of formulae (XXI) and (XXII):

(XXI)

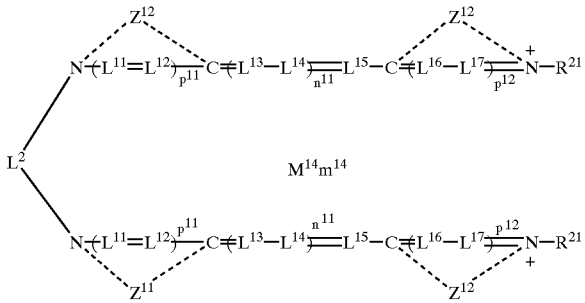

$M^{14}m^{14}$ wherein $L^{11}$, $L^{12}$, $L^{13}$, $L^{14}$, $L^{15}$, $L^{16}$, $L^{17}$, $p^{11}$, $p^{12}$, $n^{11}$, $Z^{11}$ and $Z^{12}$ each has the same meaning as in formula (XI); $L^2$ represents a linking group; $M^{14}$ represents a counter ion for equilibrating the electric charge; $m^{14}$ represents a number of 0 or higher necessary to neutralize the electric charge of the molecule; and $R^{21}$ represents an alkyl group, an aryl group or a heterocyclic group;

(XXII)

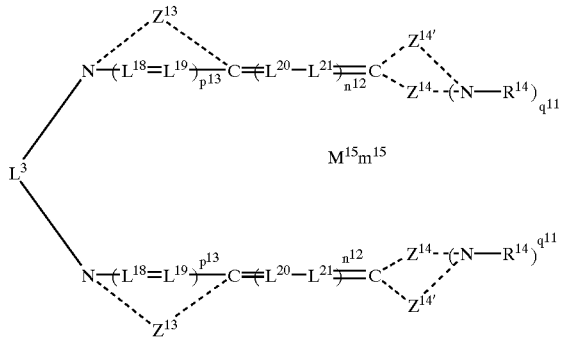

$M^{15}m^{15}$ wherein $L^{18}$, $L^{19}$, $L^{20}$, $L^{21}$, $p^{13}$, $q^{11}$, $n^{12}$, $Z^{13}$, $Z^{14}$, $Z^{14'}$ and $R^{14}$ each has the same meaning as in formula (XII); $L^3$ represents a linking group; $M^{15}$ represents a counter ion for equilibrating the electric charge; and $m^{15}$ represents a number of 0 or higher necessary to neutralize the electric charge of the molecule.

(5) The heat-developable photosensitive material as described in item (2), wherein the compound represented by formula (I) is a compound represented by one of formulae (XXXIa), (XXXIb) and (XXXII):

(XXXIa)

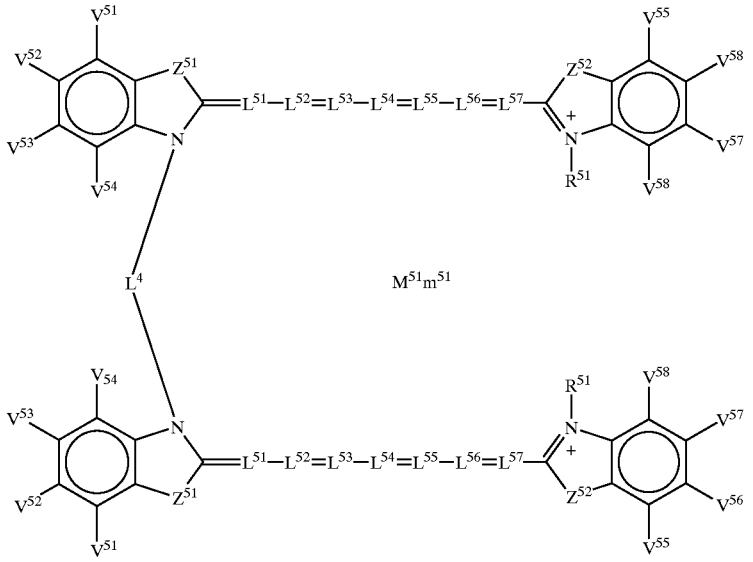

wherein $Z^{51}$ and $Z^{52}$ each represents an oxygen atom, a sulfur atom, a selenium atom, a nitrogen atom or a carbon atom; $R^{51}$ represents an alkyl group, an aryl group or a heterocyclic group; $L^{51}$, $L^{52}$, $L^{53}$, $L^{54}$, $L^{55}$, $L^{56}$ and $L^{57}$ each represents a methine group; $V^{51}$, $V^{52}$, $V^{53}$, $V^{54}$, $V^{55}$, $V^{56}$, $V^{57}$ and $V^{58}$ each represents a hydrogen atom or a substituent; $L^4$ represents a linking group; $M^{51}$ represents a counter ion for equilibrating the electric charge; and $m^{51}$ represents a number of 0 or higher necessary to neutralize the electric charge of the molecule;

(XXXIb)

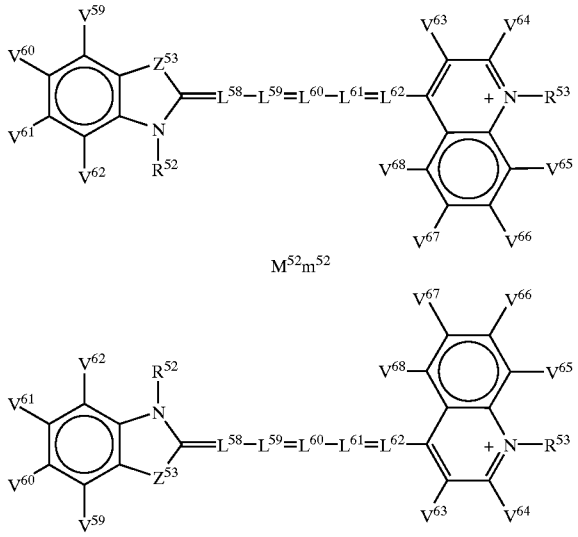

wherein $Z^{53}$ represents an oxygen atom, a sulfur atom, a selenium atom, a nitrogen atom or a carbon atom; $R^{52}$ and $R^{53}$ each represents an alkyl group, an aryl group or a heterocyclic group, provided that either two $R^{52}$'s or two $R^{53}$'s form $L^5$ jointly; $L^5$ represents a linking group; $L^{58}$, $L^{59}$, $L^{60}$, $L^{61}$ and $L^{62}$ each represents a methine group; $V^{59}$, $V^{60}$, $V^{61}$, $V^{62}$, $V^{63}$, $V^{64}$, $V^{65}$, $V^{66}$, $V^{67}$ and $V^{68}$ each represents a hydrogen atom or a substituent; $M^{52}$ represents a counter ion for equilibrating the electric charge; and $m^{52}$ represents a number of 0 or higher necessary to neutralize the electric charge of the molecule;

(XXXII)

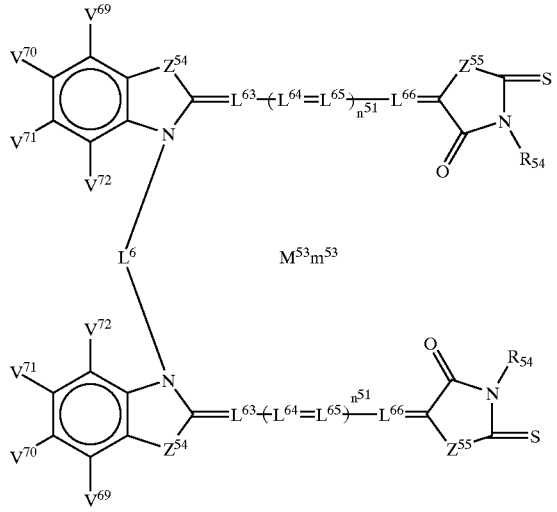

wherein $Z^{54}$ represents an oxygen atom, a sulfur atom, a selenium atom, a nitrogen atom or a carbon atom; $Z^{55}$ represents an oxygen atom, a sulfur atom or a nitrogen atom; $R^{54}$ represents an alkyl group, an aryl group or a heterocyclic group; $L^6$ represents a linking group; $L^{63}$, $L^{64}$, $L^{65}$ and L each represents a methine group; $n^{51}$ represents 1 or 2; $V^{69}$, $V^{70}$, $V^{71}$ and $V^{72}$ each represents a hydrogen atom or a substituent; $M^{53}$ represents a counter ion for equilibrating the electric charge; and $m^{53}$ represents a number of 0 or higher necessary to neutralize the electric charge of the molecule.

(6) The heat-developable photosensitive material as described in item (1), wherein the compound represented by formula (A) is adsorbed in a single layer.

(7) The heat-developable photosensitive material as described in item (1), wherein the photosensitive silver halide has an average equivalent-circle diameter of from 10 to 50 nm.

(8) The heat-developable photosensitive material as described in item (1), which further comprises an image-forming layer containing the photosensitive silver halide, the non-photosensitive organic silver salt and the compound represented by formula (A).

(9) The heat-developable photosensitive material as described in item (8), wherein the image-forming layer further contains the reducing agent for a silver ion and the binder.

(10) The heat-developable photosensitive material as described in item (8), which further comprises a second image-forming layer containing the reducing agent for a silver ion and the binder.

DETAILED DESCRIPTION OF THE INVENTION

The present invention is described in detail below. In the present invention, "from x to y" means the range including the numerical values x and y as the minimum value and maximum value respectively.

The compounds used in the present invention are described below. In the first place, the comprehensive definitions of the groups of the compounds for use in the present invention are described in detail.

When the specific moiety of a compound is called "a group" in the present invention, the moiety itself may not be substituted, or may be substituted with one or more (with the possible maximum number of substituents) substituents. When the group can be substituted with a plurality of substituents, the substituents may be the same or different. For example, "an alkyl group" means a substituted or unsubstituted alkyl group. Any substituent which can be substituted for the groups of the compounds according to the present invention can be included in the substituents whether they are substituted or unsubstituted.

Taking these substituents as W, substituents W are not particularly restricted and any groups can be included, for example, a halogen atom, an alkyl group [(a cycloalkyl group, a bicycloalkyl group and a tricycloalkyl group are included), and an alkenyl group (a cycloalkenyl group and a bicycloalkenyl group are included) and an alkynyl group are also included], an aryl group, a heterocyclic group, a cyano group, a hydroxyl group, a nitro group, a carboxyl group, an alkoxyl group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group, a phospho group (also referred to as a phosphono group), a silyl group, a hydrazino group, a ureido group, a boronic acid group (—$B(OH)_2$), a phosphato group (—$OPO(OH)_2$), a sulfato group (—$OSO_3H$), and other well-known substituents can be exemplified.

Further in detail, the examples of W include a halogen atom (e.g., fluorine, chlorine, bromine, iodine), an alkyl group {[a straight chain, branched, cyclic, substituted or unsubstituted alkyl group including an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecylcyclohexyl), a bicycloalkyl group (preferably a substituted or unsubstituted bicycloalkyl group having from 5 to 30 carbon atoms, i.e., a monovalent group obtained by removing one hydrogen atom from a bicycloalkane group having from 5 to 30 carbon atoms, e.g., bicyclo[1,2,2]heptan-2-yl, bicyclo[2,2,2]octan-3-yl), and a tricyclohexyl structure having more ring structures; the alkyl group in the substituent described below (e.g., the alkyl group in an alkylthio group) represents the alkyl group of such a concept, in addition to the above, analkenyl group and an alkynyl group are also included], analkenyl group [a straight chain, branched, cyclic, substituted or unsubstituted alkenyl group including an alkenyl group (preferably a substituted or unsubstituted alkenyl group having from 2 to 30 carbon atoms, e.g., vinyl, allyl, prenyl, geranyl, oleyl), a cycloalkenyl group (preferably a substituted or unsubstituted cycloalkenyl group having from 3 to 30 carbon atoms, i.e., a monovalent group obtained by removing one hydrogen atom from a cycloalkene group having from 3 to 30 carbon atoms, e.g., 2-cyclopenten-1-yl, 2-cyclohexen-1-yl), a bicycloalkenyl group (a substituted or unsubstituted bicycloalkenyl group, preferably a substituted or unsubstituted bicycloalkenyl group having from 5 to 30 carbon atoms, i.e., a monovalent group obtained by removing one hydrogen atom from a bicycloalkene group having one double bond, e.g., bicyclo[2,2,1]hepto-2-en-1-yl, bicyclo[2,2,2]octo-2-en-4-yl)], an alkynyl group (preferably a substituted or unsubstituted alkynyl group having from 2 to 30 carbon atoms, e.g., ethynyl, propargyl, trimethylsilylethynyl)}, an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a 5- or 6-membered, substituted or unsubstituted, aromatic or non-aromatic monovalent group obtained by eliminating one hydrogen atom from a heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl, further, a cationic heterocyclic group, e.g., 1-methyl-2-pyridinio and 1-methyl-2-quinolinio may also be included), a cyano group, a hydroxyl group, a nitro group, a carboxyl group, an alkoxyl group (preferably a substituted or unsubstituted alkoxyl group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms, a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxy-phenoxycarbonyloxy), an amino group (preferably an amino group, a substituted or unsubstituted alkylamino group having from 1 to 30 carbon atoms, a substituted or unsubstituted anilino group having from 6 to 30 carbon atoms, e.g., amino, methylamino, dimethylamino, anilino, N-methylanilino, diphenylamino), an ammonio group (preferably an ammonio group, an ammonio group substituted with a substituted or unsubstituted alkyl group having from 1 to 30 carbon atoms, an aryl group or a heterocyclic group, e.g., trimethylammonio, triethylammonio, diphenylmethylammonio), an acylamino group (preferably a formylamino group, a substituted or unsubstituted alkylcarbonylamino group having from 1 to 30 carbon atoms, a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an amino-carbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylmino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, tert-butoxycarbonylamino, n-octadecyloxycarbonylamino, N-methylmethoxycarbonylamino), an aryloxycarbonylamino group (preferably a substituted or unsubstituted aryloxycarbonyl-amino group having from 7 to 30 carbon atoms, e.g., phenoxycarbonylamino, p-chlorophenoxycarbonylamino, m-(n-octyloxyphenoxycarbonylamino), a sulfamoylamino group (preferably a substituted or unsubstituted sulfamoyl amino group having from 0 to 30 carbon atoms, e.g., sulfamoylamino, N,N-dimethylaminosulfonylamino, N-n-octylaminosulfonylamino), an alkylsulfonylamino group and an arylsulfonylamino group (preferably a substituted or unsubstituted alkylsulfonylamino group having from 1 to 30 carbon atoms, a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkylsulfinyl group and an arylsulfinyl group (preferably a substituted or unsubstituted alkylsulfinyl group having from 1 to 30 carbon atoms, a substituted or unsubstituted aryl sulfinyl group having from 6 to 30 carbon atoms, e.g., methylsulfinyl, ethylsulfinyl, phenylsulfinyl, p-methylphenylsulfinyl), an alkylsulfonyl group and an arylsulfonyl group (preferably a substituted or unsubstituted alkylsulfonyl group having from 1 to 30 carbon atoms, a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms, a substituted or unsubstituted heterocyclic carbonyl group having from 4 to 30 carbon atoms bonded to a carbonyl group via a carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-tert-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an arylazo group and a heterocyclic azo group (preferably a substituted or unsubstituted arylazo group having from 6 to 30 carbon atoms, a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido, N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, tert-butyldimethylsilyl, phenyldimethylsilyl), a hydrazino group (preferably a substituted or unsubstituted hydrazino group having from 0 to 30 carbon atoms, e.g., trimethylhydrazino), and a ureido group (preferably a substituted or unsubstituted ureido group having from 0 to 30 carbon atoms, e.g., N,N-dimethylureido).

Two W's may form a ring (an aromatic or non-aromatic hydrocarbon ring or heterocyclic ring) jointly.

These rings may further be combined to form a polycyclic condensed ring. Examples of such polycyclic condensed rings include a benzene ring, a naphthalene ring, an anthracene ring, a quinoline ring, a phenanthrene ring, a fluorene ring, a triphenylene ring, anaphthacene ring, abiphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a phthalazine ring, a naphthyridine ring, a quinoxaline ring, a quinoxazoline ring, an isoquinoline ring, a carbazole ring, a phenanthridine ring, an acridine ring, a phenanthroline ring, a thianthrene ring, a chromene ring, a xanthene ring, a phenoxthine ring, a phenothiazine ring, and a phenazine ring.

Of the above-described substituents W, those having hydrogen atoms may be substituted with the above groups after removing the hydrogen atoms therefrom. The examples of the substituents which are further substituted on substituents W include a —$CONHSO_2$— group (a sulfonylcarbamoyl group, a carbonylsulfamoyl group), a —CONHCO— group (a carbonylcarbamoyl group), and —$SO_2NHSO_2$— group (a sulfonylsulfamoyl group).

More specifically, an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl), and an arylsulfonylaminocarbonyl group (e.g., p-methylphenylsulfonylaminocarbonyl) can be exemplified.

The compounds represented by formula (A) which are used in the present invention are described below.

In formula (A), $D^a$ and $D^b$ each represents a dye chromophore. $D^a$ and $D^b$ may be the same dye chromophore or may be different dye chromophores, preferably the same dye chromophore. $D^a$ and $D^b$ each preferably has the same meaning as $D^1$ described later.

$L^a$ represents a linking group or a single bond, and preferably has the same meaning as $L^1$ described later.

$q^a$ and $r^a$ each represents an integer of from 1 to 100, preferably an integer of 1 to 5, more preferably an integer of 1 or 2, and particularly preferably 1.

When $q^a$ and $r^a$ each represents 2 or more, a plurality of $L^a$ and $D^b$ contained may be linking groups, single bonds or dye chromophores different from each other.

$q^b$ represents an integer of from 1 to 4. $q^b$ being 2 or more means that each of $D^a$ and $D^b$, and $D^b$ and $D^b$ are linked by a plurality of linking groups. That is, $D^a$ and $D^b$, or $D^b$ and $D^b$ each may be linked at one point or at a plurality of points (from 2 to 4, preferably 2).

When $q^b$ represents 2 or more, a plurality of $L^a$ are the same or different, preferably the same.

$q^b$ preferably represents 1 or 2, more preferably 1.

$L^a$ may be linked with any moiety of $D^a$ and $D^b$ respectively, but preferably not the methine chain moiety. $L^a$ is preferably bonded to $D^a$ and $D^b$ at the N-position of a basic nucleus or an acidic nucleus, more preferably at the N-position of a basic nucleus.

$M^a$ represents a counter ion for equilibrating the electric charge. $m^a$ represents a number necessary to neutralize the electric charge of the molecule. $M^a$ and $m^a$ each preferably has the same meaning as $M^1$ and $m^1$ described later.

Formula (A) represents that dye chromophores can be linked to each other in any way.

The dye chromophores, formulae and substituents of the more preferred ranges in the case where $D^a$ and $D^b$ are different in formula (A) are the same as those in the following description of formula (I) and the preferred ranges in the case where $D^a$ and $D^b$ are the same, except for the point that the dye chromophores are not the same.

That is, the dye chromophores of the more preferred ranges in the case where $D^a$ and $D^b$ are different in formula (A) are the dye chromophores represented by formula (XI), (XII) or (XIII) which are described in formula (I) and they are not the same.

When $D^a$ and $D^b$ are different in formula (A), more preferable dye chromophore is a compound represented by formula (XXI), wherein at least one of each two $L^{11}$, $L^{12}$, $L^{13}$, $L^{14}$, $L^{15}$, $L^{16}$, $L^{17}$ $p^{11}$, $p^{12}$ $n^{11}$, $Z^{11}$, $Z^{12}$ and $R^{21}$ are not the same, or a compound represented by formula (XXII), wherein at least one of each two $L^{18}$, $L^{19}$, $L^{20}$, $L^{21}$, $p^{13}$, $q^{11}$, $n^{12}$, $Z^{13}$, $Z^{14}$, $Z^{14'}$ and $R^{14}$ are not the same.

When $D^a$ and $D^b$ are different in formula (A), particularly preferable dye chromophore is a compound represented by formula (XXXIa), wherein at least one of each two $Z^{51}$, $Z^{52}$, $R^{51}$, $L^{51}$, $L^{52}$, $L^{53}$, $L^{54}$, $L^{55}$, $L^{57}$, $V^{51}$, $V^{52}$, $V^{53}$, $V^{54}$, $V^{55}$, $V^{56}$, $V^{57}$ and $V^{58}$ are not the same, or a compound represented by formula (XXXIb), wherein at least one of each two $Z^{53}$, $R^{52}$, $R^{53}$, $L^{58}$, $L^{59}$, $L^{60}$, $L^{61}$, $L^{62}$, $V^{59}$, $V^{60}$, $V^{61}$, $V^{62}$, $V^{63}$, $V^{64}$, $V^{65}$, $V^{66}$, $V^{67}$ and $V^{68}$ are not the same, or a compound represented by formula (XXXII), wherein at least one of each two $Z^{54}$, $Z^{55}$, $R^{54}$, $L^{63}$, $L^{64}$, $L^{65}$, $L^{66}$, $n^{51}$, $V^{69}$, $V^{70}$, $V^{71}$ and $V^{72}$ are not the same.

Of the compounds represented by formula (A), a particularly preferred compound is a compound represented by formula (I). The compound represented by formula (I) corresponds to the compound represented by formula (A) wherein $D^a$ and $D^b$ each represents the same dye chromophore.

Formula (I) denotes that dye chromophores can be linked to each other in any way.

The compound represented by formula (I) is described below.

The compound represented by formula (I) has a plurality of same chromophores and is superior to the compound represented by formula (A) in storage stability (the case where $D^a$ and $D^b$ are different). Further, the compound represented by formula (I) is superior to the compound represented by formula (A) (the case where $D^a$ and $D^b$ are different) in the points that the compound represented by formula (I) can be synthesized more easily and manufactured inexpensively.

When the compound represented by formula (A) or (I) for use in the present invention is adsorbed in a single layer, the storage stability is high hence preferred.

"Adsorbed in a single layer" means that the dye chromophore of a compound (a sensitizing dye) is adsorbed onto the surface of a silver halide grain in one or less layer.

That is, the terms means that the adsorption amount of the dye chromophore per the unit surface area of a grain is in the state of not more than a monolayer saturation coating amount (a monolayer saturation coating amount means the adsorption amount of a dye per the unit surface area of a grain at the time of saturation coating of a single layer).

That is, the compound represented by formula (A) or (I) for use in the present invention is high in storage stability and preferred when the compound is not in the state of multilayer adsorption.

"Multilayer adsorption" means that the dye chromophore of a compound (a sensitizing dye) is adsorbed onto the surface of a silver halide grain in more than one layer. That is, multilayer adsorption means that the adsorption amount of the dye chromophore per the unit surface area of a grain is in the state of more than a single layer saturation coating amount. An adsorption layer number is the adsorption amount with a single layer saturation coating amount as standard.

The detailed descriptions of the single-layer adsorption and the multilayer adsorption such as a measurement method are disclosed in JP-A-2000-267216, JP-A-2001-75222 and JP-2001-75226.

In the invention, the light absorption strength of a spectrally sensitized silver halide grain is preferably less than 100. When the wavelength of spectral absorption maximum is not more than 500 nm, the light absorption strength is preferably less than 60. When the light absorption strength is less than 100 or less than 60, the adsorption in a single layer is preferable in view of the high storage stability as described above. The light absorption strength is described in detail in JP-A-10-239789.

$D^1$ and $L^1$ are described below.

The dye chromophores represented by $D^1$ are not restricted and any chromophores can be used, for example, a group comprising a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, a holopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphyrin dye, a chlorophyll dye, a phthalocyanine dye, or a metallic complex dye can be exemplified.

Preferably, polymethine chromophores, e.g., a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, a holopolar dye, an oxonol dye, a hemioxonol dye, a squarylium dye, a croconium dye, and an azamethine dye can be exemplified.

More preferably, a cyanine dye, a merocyanine dye, a trinuclear merocyanine dye, a tetranuclear merocyanine dye, an oxonol dye and a rhodacyanine dye can be exemplified, still more preferably, a group comprising a cyanine dye, a merocyanine dye or an oxonol dye, and most preferably a group comprising a cyanine dye or a merocyanine dye.

These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds. Special Topics in Heterocyclic Chemistry*, Chap. 18, Clause 14, pp. 482 to 515, John Wiley & Sons, New York, London (1977), and *Rodd's Chemistry of Carbon Compounds,* 2nd Ed., Vol. IV, Part B, Chap. 15, pp. 369 to 422, Elsevier Science Publishing Company Inc., New York (1977).

As the preferred formulae of the dyes, the formulae on pages 32 to 36 in U.S. Pat. No. 5,994,051, and the formulae on pages 30 to 34 in U.S. Pat. No. 5,747,236 can be exemplified. Further, as the preferred cyanine, merocyanine and rhodacyanine dyes, those represented by formulae (XI), (XII) and (XIII) disclosed in columns 21 and 22 in U.S. Pat. No. 5,340,694 can be exemplified (however, the numbers of $n_{12}$, $n_{15}$, $n_{17}$ and $n_{18}$ are not restricted here and regarded as the integers of 0 or more (preferably 4 or less)).

$D^1$ may or may not form J aggregates.

$L^1$ is described below.

$L^1$ represents a linking group (preferably a divalent linking group) or a single bond. $L^1$ preferably represents a linking group. The linking group preferably comprises an atom or an atomic group containing at least one of a carbon atom, a nitrogen atom, a sulfur atom and an oxygen atom.

The linking group is preferably a linking group having from 0 to 100, preferably from 1 to 20, carbon atoms comprising one or more in combination of an alkylene group (e.g., methylene, ethylene, trimethylene, tetramethylene, pentamethylene), an arylene group (e.g., phenylene, naphthylene), an alkenylene group (e.g., ethenylene, propenylene), an alkynylene group (e.g., ethynylene, propynylene), an amido group, an ester group, a sulfoamido group, a sulfonic ester group, a ureido group, a sulfonyl group, a sulfinyl group, a thioether group, an ether group, a carbonyl group, —N($V_a$)-(wherein $V_a$ represents a hydrogen atom or a monovalent substituent, and the above-described W can be exemplified as the monovalent substituent), and a hetero-cyclic divalent group (e.g., a 6-chloro-1,3,5-triazine-2,4-diyl group, a pyrimidine-2,4-diyl group, a quinoxaline-2,3-diyl group).

The linking group may further have a substituent represented by W described above, or may contain a ring (e.g., an aromatic or non-aromatic hydrocarbon ring or a heterocyclic ring).

The linking group is more preferably a divalent linking group having from 1 to 30 carbon atoms, which comprises one or two or more in combination of an alkylene group having from 1 to 30 (e.g., methylene, ethylene, trimethylene, tetramethylene, pentamethylene, hexamethylene, octamethylene, decamethylene), an arylene group having from 6 to 10 carbon atoms (e.g., phenylene, naphthylene), an alkenylene having from 2 to 30 carbon atoms (e.g., ethenylene, propenylene), an alkynylene having from 2 to 30 carbon atoms (e.g., ethynylene, propynylene), an ether group, an amido group, an ester group, a sulfoamido group, and a sulfonic ester group.

The linking groups may further be substituted with the above W.

It is more preferred that the linking group does not contain hetero atoms other than an amido group or an ester group, and it is still more preferred not to contain a hetero atom.

$L^1$ particularly preferably represents the above alkylene group (e.g., ethylene, trimethylene, tetramethylene, pentamethylene, hexamethylene, octamethylene, decamethylene, dodecamethylene), and the carbon atoms are preferably from 2 to 24, more preferably from 4 to 20, still more preferably from 6 to 18, far more preferably from 8 to 15, and particularly preferably from 12 to 14.

$L^1$ is particularly preferably a linking group having a center of symmetry.

$q^1$ and $r^1$ each represents an integer of from 1 to 100, preferably an integer of from 1 to 5, still more preferably an integer of 1 or 2, and particularly preferably 1.

When $r^1$ is 2 or higher, a plurality of $L^1$ contained may be different linking groups or single bonds, but the same linking group or single bond is preferred.

When $q^1$ or $r^1$ is 2 or higher, a plurality of $D^1$ bonded to $L^1$ must be the same dye chromophore.

$q^2$ represents an integer of from 1 to 4. $q^2$ being 2 or high means that $D^1$ and $D^1$ are linked by a plurality of linking groups. That is, $D^1$ and $D^1$ may be linked at one point of each or at a plurality of points (from 2 to 4, preferably 2). When $q^2$ represents 2 or higher, a plurality of $L^1$ may be the same or different, preferably the same.

$q^2$ preferably represents 1 or 2, more preferably 1.

$L^1$ may be linked with any moiety of $D^1$, but preferably not the methine chain moiety. $L^1$ is preferably bonded to $D^1$ at the N-position of a basic nucleus or an acidic nucleus, more preferably at the N-position of a basic nucleus.

$D^1$ in formula (I) is preferably a methine dye represented by formula (XI), (XII) or (XIII), more preferably a methine dye represented by formula (XI) or (XII), and particularly preferably a methine dye represented by formula (XII).

Methine compounds represented by formula (I), (XI), (XII) or (XIII) are described in detail below.

In formula (XI), (XII) or (XIII), $Z^{11}$, $Z^{12}$, $Z^{13}$, $Z^{15}$ and $Z^{17}$ each represents an atomic group necessary to form a nitrogen-containing heterocyclic ring, preferably a 5- or 6-membered nitrogen-containing heterocyclic ring, and a ring may be further condensed with these groups. The rings to be condensed with them may include an aromatic ring or a non-aromatic ring, preferably an aromatic ring, such as an aromatic hydrocarbon ring, e.g., a benzene ring and a naphthalene ring, and an aromatic heterocyclic ring, e.g., a pyrazine ring and a thiophene ring.

The examples of the nitrogen-containing heterocyclic rings formed by $Z^{11}$, $Z^{12}$, $Z^{13}$, $Z^{15}$ and $Z^{17}$ include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a tellurazoline nucleus, a tellurazole nucleus, a benzotellurazole nucleus, a 3,3-dialkylindolenine nucleus (e.g., 3,3-dimethylindolenine), an imidazoline nucleus, an imidazole nucleus, abenzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b] quinoxaline nucleus, an oxadiazole nucleus, a thiadiazole nucleus, a tetrazole nucleus, and a pyrimidine nucleus, preferably a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, a 2-quinoline nucleus, a 4-quinoline nucleus, a 1-isoquinoline nucleus, and a 3-isoquinoline nucleus, more preferably a benzothiazole nucleus, a benzoxazole nucleus, a 3,3-dialkylindolenine nucleus (e.g., 3,3-dimethylindolenine), and a benzimidazole nucleus, still more preferably a benzoxazole nucleus, a benzothiazole nucleus, and a benzimidazole nucleus, and most preferably a benzoxazole nucleus and a benzothiazole nucleus.

These nitrogen-containing heterocyclic rings may be substituted with substituents W or condensed with rings. The preferred substituents are an alkyl group, an aryl group, an alkoxyl group, a halogen atom, aromatic ring condensation, a sulfo group, a carboxyl group, and a hydroxyl group.

As the specific examples of the heterocyclic rings formed by $Z^{11}$, $Z^{12}$, $Z^{13}$, $Z^{15}$ and $Z^{17}$, the similar rings to those exemplified as the examples formed by $Z^{11}$, $Z^{12}$, $Z^{13}$, $Z^{14}$ and $Z^{16}$ disclosed in columns 23 and 24 in U.S. Pat. No. 5,340,694 can be exemplified.

The more preferred substituents W on $Z^{11}$, $Z^{12}$, $Z^{13}$, $Z^{15}$ and $Z^{17}$ are a halogen atom, an aromatic ring and aromatic ring condensation.

$Z^{14}$ and $Z^{14'}$ each represents an atomic group necessary to form a heterocyclic ring or an acyclic acidic terminal group together with $(N—R^{14})q^{11}$. The heterocyclic ring (preferably a 5-or 6-membered heterocyclic ring) is not particularly limited but an acidic nucleus is preferred.

The acidic nucleus and the acyclic acidic terminal group are described below. Any forms of acidic nuclei and acyclic acidic terminal groups which are generally used in merocyanine dyes can be used in the present invention.

Preferably, $Z^{14}$ represents a thiocarbonyl group, a carbonyl group, an ester group, an acyl group, a carbamoyl group, a cyano group or a sulfonyl group, more preferably a thiocarbonyl group or a carbonyl group. $Z^{14'}$ represents the remaining atomic group necessary to form the acidic nucleus and the acyclic acidic terminal group. For forming an acyclic acidic terminal group, a thiocarbonyl group, a carbonyl group, an ester group, an acyl group, a carbamoyl group, a cyano group or a sulfonyl group is preferably used.

$q^{11}$ represents 0 or 1, preferably 1.

Acidic nuclei and acyclic acidic terminal groups are described, for example, in James, *The Theory of the Photographic Process,* 4th Ed., pp. 198 to 200, Macmillan (1977). Acyclic acidic terminal groups here means acidic, i.e., electron-attractive terminal groups which do not form a ring.

Acidic nuclei and acyclic acidic terminal groups are specifically disclosed in U.S. Pat. Nos. 3,567,719, 3,575,869, 3,804,634, 3,837,862, 4,002,480, 4,925,777 and JP-A-3-167546, U.S. Pat. Nos. 5,994,051 and 5,747,236.

Acidic nuclei are preferably used to form a heterocyclic ring (preferably a 5- or 6-membered nitrogen-containing heterocyclic ring) comprising carbon, nitrogen and/or chalcogen atoms (typically, oxygen, sulfur, selenium and tellurium), more preferably to form a 5- or 6-membered nitrogen-containing heterocyclic ring comprising carbon, nitrogen and/or chalcogen atoms (typically, oxygen, sulfur, selenium and tellurium).

Specifically, the following nuclei are exemplified, e.g., 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo-[1,5-b]quinazolone, pyrazolo[1,5-a]benzimidazole, pyrazolo-pyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide.

Further examples include nuclei having exo-methylene structure obtained by substituting a carbonyl group or a thiocarbonyl group constituting these nuclei on the active methylene position of acidic nuclei, nuclei having exo-methylene structure obtained by substituting a carbonyl group or a thiocarbonyl group on the active methylene position of active methylene compounds having the ketomethylene structure and cyanomethylene structure which are the raw materials of acyclic acidic terminal groups, and nuclei having these structures as a repeating unit. However, nuclei having the structure not substituting a carbonyl group or a thiocarbonyl group is preferred.

These acidic nuclei and acyclic acidic terminal groups may be substituted with substituents W or condensed with rings.

Of acidic nuclei and acyclic acidic terminal groups, acidic nuclei are preferred.

The preferred examples of the heterocyclic rings formed by $Z^{14}$, $Z^{14'}$ and $(N—R^{14})q^{11}$ include hydantoin, 2-or 4-thiohydantoin, 2-oxazolin-5-one, 2-thiooxazoline-2,4-dione, thiazolidine-2,4-dione, rhodanine, thiazolidine-2,4-dithione, barbituric acid and 2-thiobarbituric acid, the more preferred examples are hydantoin, 2-or 4-thiohydantoin, 2-oxazolin-5-one, rhodanine, barbituric acid and 2-thiobarbituric acid, and the particularly preferred examples are 2- or 4-thiohydantoin, 2-oxazolin-5-one and rhodanine.

Rhodanine is most preferred.

As the heterocyclic rings formed by $Z^{16}$, $Z^{16'}$ and $(N—R^{16})q^{12}$, the same rings as described in the heterocyclic rings formed by $Z^{14}$, $Z^{14'}$ and $(N—R^{14})q^{11}$ can be exemplified. The preferred heterocyclic rings are those obtained by eliminating an oxo group or a thioxo group from the acidic nuclei described in the explanation of the heterocyclic rings formed by $Z^{14}$, $Z^{14'}$ and $(N—R^{14})q^{11}$.

The more preferred heterocyclic rings are those obtained by eliminating an oxo group or a thioxo group from the acidic nuclei exemplified as the specific examples of the heterocyclic groups formed by $Z^{14}$, $Z^{14'}$ and $(N—R^{14})q^{11}$.

The still further preferred heterocyclic rings are the rings obtained by eliminating an oxo group or a thioxo group from hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, or 2-thiobarbituric acid, the particularly preferred heterocyclic rings are those obtained by eliminating an oxo group or a thioxo group from hydantoin, 2-or 4-thiohydantoin, 2-oxazolin-5-one, rhodanine, barbituric acid, or 2-thiobarbituric acid, the particularly preferred heterocyclic rings are the rings obtained by eliminating an oxo group or a thioxo group from 2- or 4-thiohydantoin, 2-oxazolin-5-one, or rhodanine, and the most preferred heterocyclic rings are the rings obtained by eliminating a thioxo group from rhodanine.

$q^{12}$ represents 0 or 1, preferably 1.

$R^{11}$, $R^{12}$, $R^{13}$, $R^{14}$, $R^{15}$, $R^{16}$ and $R^{17}$ each represents a hydrogen atom, an alkyl group, an aryl group or a heterocyclic group, preferably represents an alkyl group, an aryl group or a heterocyclic group.

The alkyl group, aryl group and heterocyclic group represented by $R^{11}$, $R^{12}$, $R^{13}$, $R^{14}$, $R^{15}$, $R^{16}$ and $R^{17}$ include, e.g., an unsubstituted alkyl group having from 1 to 18, preferably from 1 to 7, and particularly preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, and particularly preferably from 1 to 4 carbon atoms [e.g., an alkyl group substituted with the above-described substituents W] can be exemplified, in particular, alkyl groups having an acid radical described later are particularly preferred, preferably an aralkyl group (e.g., benzyl, 2-phenylethyl), an unsaturated hydrocarbon group (e.g., allyl and vinyl, i.e., an alkenyl group and an alkynyl group are to be included in the substituted alkyl group), a hydroxyalkyl group (e.g., 2-hydroxyethyl, 3-hydroxypropyl), a carboxyalkyl group (e.g., carboxymethyl, 2-carboxyethyl, 3-carboxypropyl, 4-carboxybutyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy) ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl)ethyl, tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), analkylsulfonylsulfamoylalkyl group (e.g., methanesulfonylsulfamoylmethyl)], an unsubstituted aryl group having from 6 to 20, preferably from 6 to 10, and more preferably from 6 to 8, carbon atoms (e.g., phenyl, 1-naphthyl), a substituted aryl group having from 6 to 20, preferably from 6 to 10, and more preferably from 6 to 8, carbon atoms (e.g., the aryl groups substituted with substituents W, specifically p-methoxyphenyl, p-methylphenyl, p-chlorophenyl can be exemplified), an unsubstituted heterocyclic group having from 1 to 20, preferably from 3 to 10, and more preferably from 4 to 8, carbon atoms(e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, and more preferably from 4 to 8, carbon atoms (e.g., the heterocyclic groups substituted with substituents W, specifically 5-methyl-2-thienyl, 4-methoxy-2-pyridyl).

As the groups represented by $R^{11}$, $R^{12}$, $R^{13}$, $R^{14}$, $R^{15}$, $R^{16}$ and $R^{17}$, unsubstituted alkyl groups and substituted alkyl groups are preferred, and as the substituted alkyl groups, alkyl groups having an acid radical are preferred.

Acid radicals are described below. Acid radicals are groups having a dissociable proton.

Specifically, groups in which protons are dissociated by the pKa of the groups and the ambient pH can be exemplified, e.g., a sulfo group, a carboxyl group, a sulfato group, a $—CONHSO_2—$ group (a sulfonylcarbamoyl group, a carbonyl-sulfamoyl group), a —CONHCO— group (a carbonylcarbamoyl group), an $—SO_2NHSO_2—$ group (a sulfonylsulfamoyl group), a sulfonamido group, a phosphono group, a boronic acid group and a phenolic hydroxyl group. For example, proton-dissociating acid radicals in which 90% or more protons are dissociated at pH 5 to 12 are preferred.

More preferred examples are a sulfo group, a carboxyl group, a $—CONHSO_2—$ group, a —CONHCO— group, and an $—SO_2NHSO_2—$ group, and particularly preferably a sulfo group and a carboxyl group, and most preferably a sulfo group.

$L^{11}$, $L^{12}$, $L^{13}$, $L^{14}$, $L^{15}$, $L^{16}$, $L^{17}$, $L^{18}$, $L^{19}$, $L^{20}$, $L^{21}$, $L^{22}$, $L^{23}$, $L^{24}$, $L^{25}$, $L^{26}$, $L^{27}$, $L^{28}$, $L^{29}$ and $L^{30}$ each represents a methine group.

The methine groups represented by $L^{11}$ to $L^{30}$ may be substituted, and the above-described substituents W can be exemplified as the substituents.

For example, a substituted or unsubstituted alkyl group having from 1 to 15, preferably from 1 to 10, and particularly preferably from 1 to 5, carbon atoms (e.g., methyl, ethyl, 2-carboxyethyl), a substituted or unsubstituted aryl group having from 6 to 20, preferably from 6 to 15, and more preferably from 6 to 10, carbon atoms (e.g., phenyl, o-carboxyphenyl), a substituted or unsubstituted heterocyclic group having from 3 to 20, preferably from 4 to 15, and more preferably from 6 to 10, carbon atoms (e.g., N,N-dimethylbarbituric acid), a halogen atom (e.g., chlorine, bromine, iodine, fluorine), an alkoxyl group having from 1 to 15, preferably from 1 to 10, and more preferably from 1 to 5, carbon atoms (e.g., methoxy, ethoxy), an amino group having from 0 to 15, preferably from 2 to 10, and more preferably from 4 to 10, carbon atoms (e.g., methylamino, N,N-dimethylamino, N-methyl-N-phenylamino, N-methylpiperadino), an alkylthio group having from 1 to 15, preferably from 1 to 10, and more preferably from 1 to 5, carbon atoms (e.g., methylthio, ethylthio), and an arylthio group having from 6 to 20, preferably from 6 to 12, and more preferably from 6 to 10, carbon atoms (e.g., phenylthio, p-methylphenylthio) can be exemplified.

Each of these methine groups may form a ring together with other methine groups, or they may form a ring together with $Z^{11}$ to $Z^{17}$, or $R^{11}$ to $R^{17}$.

$L^{11}$, $L^{12}$, $L^{16}$, $L^{17}$, $L^{18}$, $L^{19}$, $L^{22}$, $L^{23}$, $L^{29}$ and $L^{30}$ each preferably represents an unsubstituted methine group.

$n^{11}$, $n^{12}$, $n^{13}$ and $n^{14}$ each represents 0, 1, 2, 3 or 4, preferably 0, 1, 2 or 3, more preferably 1, 2 or 3, and particularly preferably 2 or 3. $n^{11}$ most preferably represents 3, and $n^{12}$ most preferably represents 2. When $n^{11}$, $n^{12}$, $n^{13}$ and $n^{14}$ each represents 2 or more, the methine groups are repeated and these methine groups may be the same with or different from each other.

$p^{11}$, $p^{12}$, $p^{13}$, $p^{14}$ and $p^{15}$ each represents 0 or 1, preferably 0.

Dye chromophore $D^1$ may be linked with $L^1$ at any position of the carbon atom moiety or the N-position of the basic nucleus of the dye chromophores, the N-position of the acidic nucleus, or the methine chain moiety, preferably the carbon atom moiety or the N-position of the basic nucleus, or the N-position of the acidic nucleus, more preferably the N-position of the basic nucleus or the N-position of the acidic nucleus (i.e., the case of linking through $R^{11}$, $R^{12}$, $R^{13}$, $R^{14}$, $R^{15}$, $R^{16}$ or $R^{17}$ in formulae (XI), (XII) and (XIII)), and particularly preferably the N-position of the basic nucleus (i.e., the case of linking through $R^{11}$, $R^{12}$, $R^{13}$, $R^{15}$ or $R^{17}$ in formulae (XI), (XII) and (XIII)).

$M^1$, $M^{11}$, $M^{12}$ and $M^{13}$ are included in the formulae to show the presence of a cation or an anion when a counter ion is necessary to neutralize the ionic charge of a dye.

Representative examples of cations include inorganic cations such as a hydrogen ion ($H^+$), an alkali metal ion (e.g., a sodium ion, a potassium ion, a lithium ion), and an alkaline earth metal ion (e.g., a calcium ion), and organic ions such as an ammonium ion (e.g., an ammonium ion, a tetraalkylammonium ion, a triethylammonium ion, a pyridinium ion, an ethyl pyridinium ion, a 1,8-diazabicyclo[5,4,0]-7-undecenium ion).

Anions may be either inorganic anions or organic anions, and the examples include a halogen anion (e.g., a fluorine ion, a chlorine ion, an iodine ion), a substituted arylsulfonate ion (e.g., a p-toluenesulfonate ion, a p-chlorobenzenesulfonate ion), an aryldisulfonate ion (e.g., a 1,3-benzenedisulfonate ion, a 1,5-naphthalenedisulfonate ion, a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion, and a trifluoromethanesulfonate ion. Further, $CO_2^-$ and $SO_3^-$ can be described as $CO_2H$ and $SO_3H$ respectively when they have hydrogen ions as the counter ions.

$m^1$, $m^{11}$, $m^{12}$ and $m^{13}$ each represents a number of 0 or higher necessary to neutralize the electric charge of the molecule, preferably from 0 to 4, and more preferably from 0 to 2. $m^1$, $m^{11}$, $m^{12}$ and $m^{13}$ each represents 0 when an inner salt is formed.

The compound represented by formula (I) is preferably selected from the compounds represented by formula (XXI) or (XXII).

In formulae (XXI) and (XXII), $L^{11}$, $L^{12}$, $L^{13}$, $L^{14}$, $L^{15}$, $L^{16}$, $L^{17}$, $p^{11}$, $p^{12}$, $n^{11}$, $Z^{11}$, $Z^{12}$, $L^{18}$, $L^{19}$, $L^{20}$, $L^{21}$, $p^{13}$, $q^{11}$, $n^{12}$, $Z^{13}$, $Z^{14}$, $Z^{14'}$ and $R^{14}$ each has the same meaning as in formulae (XI) and (XII), and the preferred ranges are also the same.

Each of $M^{14}$ and $m^{14}$, and $M^{15}$ and $m^{15}$ has the same meaning as described in $M^1$ and $m^1$.

As $R^{21}$, the same as the alkyl group, aryl group or heterocyclic group exclusive of a hydrogen atom among those described in $R^{12}$ can be exemplified, and the preferred range is also the same.

As $L^2$ and $L^3$, the linking group exclusive of a single bond among those described in $L^1$ can be exemplified, and the preferred range is also the same.

In formula (XXI), a particularly preferred combination is a case where $n^{11}$ represents 2, and either the basic nucleus formed by $Z^{11}$, $L^{11}$, $L^{12}$ and $p^{11}$ or the basic nucleus formed by $Z^{12}$, $L^{16}$, $L^{17}$ and $p^{12}$ is a 4-quinoline nucleus, and the other is a benzoxazole nucleus or a benzothiazole nucleus (preferably a benzothiazole nucleus), or a case where $n^{11}$ represents 3, and the basic nucleus formed by $Z^{11}$, $L^{11}$, $L^{12}$ and $p^{11}$ and the basic nucleus formed by $Z^{12}$, $L^{16}$, $L^{17}$ and $p^{12}$ are a benzoxazole nucleus or a benzothiazole nucleus (preferably at least one is a benzothiazole nucleus, and more preferably both are benzothiazole nuclei).

In formula (XXII),a particularly preferred combination is a case where $n^{12}$ represents 2, and the basic nucleus formed by $Z^{13}$, $L^{18}$, $L^{19}$ and p13 is a benzoxazole nucleus or a benzothiazole nucleus, and the acidic nucleus formed by $Z^{14}$, $Z^{14'}$ and $(N—R^{14})q^{11}$ is a rhodanine nucleus, or a case where $n^{12}$ represents 3, and the basic nucleus formed by $Z^{13}$, $L^{18}$, $L^{19}$ and $p^{13}$ is a benzothiazole nucleus, and the acidic nucleus formed by $Z^{14}$, $Z^{14'}$ and $(N—R^{14})q^{11}$ is a rhodanine nucleus.

Of formulae (XXI) and (XXII), formula (XXII) is preferred.

The compound represented by formula (I) is especially preferably selected from the compounds represented by formula (XXXIa), (XXXIb) or (XXXII).

In formulae (XXXIa), (XXXIb) and (XXXII), $Z^{51}$, $Z^{52}$, $Z^{53}$ and $Z^{54}$ each represents an oxygen atom, a sulfur atom, a selenium atom, a nitrogen atom ($N—V^{80}$), or a carbon atom ($CV^{81}V^{82}$).

$V^{80}$, $V^{81}$ and $V^{82}$ each represents a hydrogen atom or a substituent (e.g., the above-described substituents W), preferably the same alkyl group, aryl group or heterocyclic group as represented by $R^{11}$, and more preferably the same alkyl group. $Z^{51}$ and $Z^{52}$ each preferably represents an oxygen atom or a sulfur atom, more preferably at least either one represents a sulfur atom, and particularly preferably both represent sulfur atoms.

$Z^{53}$ preferably represents an oxygen atom or a sulfur atom, and more preferably a sulfur atom. $Z^{54}$ preferably represents an oxygen atom or a sulfur atom. When $n^{51}$ is 1, $Z^{54}$ more preferably represents an oxygen atom, and when $n^{51}$ is 2, $Z^{54}$ more preferably represents a sulfur atom. $Z^{55}$ represents an oxygen atom, a sulfur atom or a nitrogen atom ($N—V^{83}$).

$V^{83}$ represents a hydrogen atom or a substituent (e.g., the above-described substituents W), preferably the same alkyl group, aryl group or heterocyclic group as represented by $R^{11}$, and more preferably the same alkyl group.

$V^{51}$, $V^{52}$, $V^{53}$, $V^{54}$, $V^{55}$, $V^{56}$, $V^{57}$, $V^{58}$, $V^{59}$, $V^{60}$, $V^{61}$, $V^{62}$, $V^{63}$, $V^{64}$, $V^{65}$, $V^{66}$, $V^{67}$, $V^{68}$, $V^{69}$, $V^{70}$, $V^{71}$ and $V^{72}$ each represents a hydrogen atom or a substituent (e.g., the above-described substituents W), and contiguous two substituents of these may be linked to each other to form a saturated or unsaturated condensed ring.

$V^{51}$ to $V^{72}$ each preferably represents a hydrogen atom, an alkyl group (e.g., methyl), an aryl group (e.g., phenyl), an aromatic heterocyclic group (e.g., 1-pyrrolyl, 2-thienyl), an alkoxyl group (e.g., methoxy), an alkylthio group (e.g., methylthio), a cyano group, an acyl group (e.g., acetyl), an alkoxycarbonyl group (e.g., methoxycarbonyl), or a halogen atom (e.g., fluorine, chlorine, bromine, iodine), or a case where contiguous two substituents are linked to each other to form an unsaturated condensed ring (e.g., a benzene ring) is preferred.

$R^{51}$, $R^{52}$, $R^{53}$ and $R^{54}$ each represents an alkyl group, an aryl group or a heterocyclic group, provided that either two $R^{52}$'s form $L^5$ jointly, or two $R^{53}$'s form $L^5$ jointly. As $R^{51}$, $R^{52}$, $R^{53}$ and $R^{54}$s, preferably the same groups as described above in $R^{11}$ can be exemplified, and the preferred range is also the same.

$R^{54}$ more preferably represents a carboxyalkyl group and most preferably a carboxymethyl group.

$L^{51}$, $L^{52}$, $L^{53}$, $L^{54}$, $L^{55}$, $L^{56}$, $L^{57}$, $L^{58}$, $L^{59}$, $L^{60}$, $L^{61}$, $L^{62}$, $L^{63}$, $L^{64}$, $L^{65}$ and $L^{66}$ each represents a methine group, and has the same meaning as $L^{13}$, $L^{14}$, $L^{15}$, $L_{20}$ and $L^{21}$, and the preferred range is the same.

With respect to $L^{51}$, $L^{52}$, $L^{53}$, $L^{54}$, $L^{55}$, $L^{56}$ and $L^{57}$, it is preferred that at least one of $L^{52}$ and $L^{54}$, $L^{53}$ and $L^{55}$, $L^{54}$ and $L^{56}$, and $L^{52}$, $L^{54}$ and $L^{56}$ be linked to each other to form a ring. The ring is not limited, preferably a 5- or 6-membered hydrocarbon ring or a heterocyclic ring, and more preferably a 5- or 6-membered hydrocarbon ring.

Of the above, when three methine groups form a ring jointly, the ring is preferably a 5- or 6-membered hydrocarbon ring or a condensed ring of two heterocyclic rings, and more preferably a condensed ring of two 5- or 6-membered hydrocarbon rings.

These rings may be substituted with substituents W.

The specific examples of preferred ring structures are shown below.

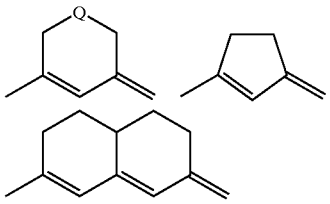

wherein Q represents $CH_2$, O, S or N—$R_{100}$ ($R_{100}$ is a hydrogen atom, or a monovalent substituent, e.g., substituents W)

In the above ring structures, substituents may be substituted at arbitrary positions (e.g., substituents W).

The examples of particularly preferred ring structures are shown below.

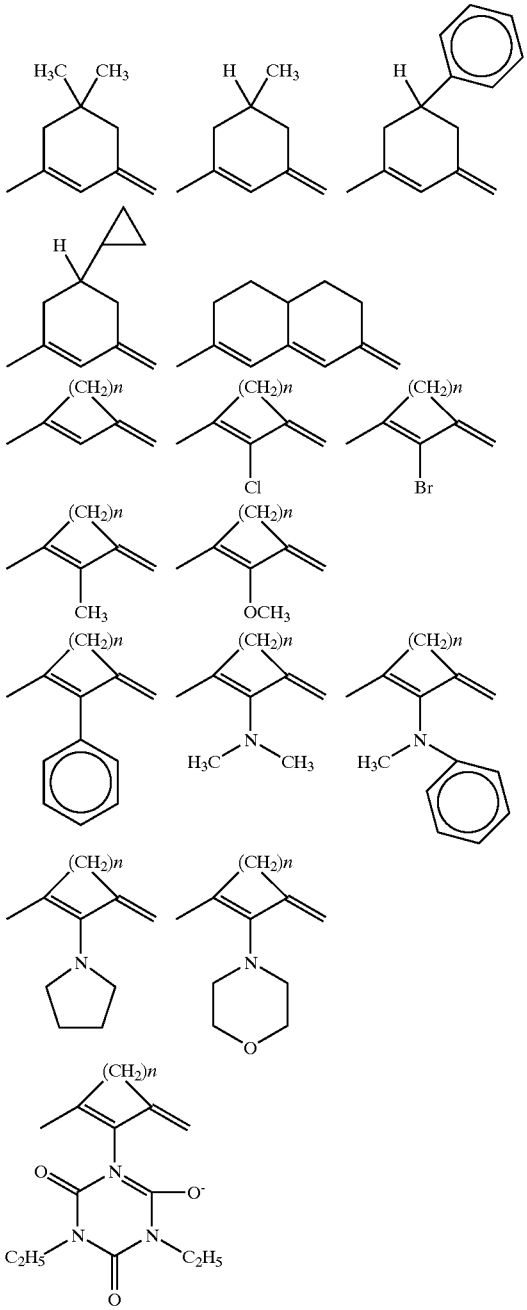

wherein n represents 2 or 3.

Of $L^{51}$, $L^{52}$, $L^{53}$, $L^{54}$, $L^{55}$, $L^{56}$ and $L^{57}$, methine groups not forming a ring are preferably unsubstituted methine groups.

With respect to $L^{58}$, $L^{59}$, $L^{60}$, $L^{61}$ and $L^{62}$ each of $L^{58}$, $L^{59}$, $L^{61}$ and $L^{62}$ preferably represents an unsubstituted methine group, and $L^{60}$ preferably represents an unsubstituted methine group or a methine group substituted with an alkyl group, and more preferably a methine group substituted with a methyl group.

With respect to $L^{63}$, $L^{64}$, $L^{65}$ and $L^{66}$, when $n^{51}$ represents 1, $L^{63}$, $L^{64}$ and $L^{66}$ each preferably represents an unsubstituted methine group, and $L^{65}$ preferably represents an unsubstituted methine group or a methine group substituted with an alkyl group, and more preferably a methine group substituted with a methyl group.

When $n^{51}$ represents 2, $L^{64}$ and $L^{65}$ are repeated but they need not be the same, preferably they are unsubstituted. A case where $L^{64}$, $L^{65}$ and $L^{66}$ form at least one ring described in $L^{51}$, $L^{52}$, $L^{53}$, $L^{54}$, $L^{55}$, $L^{56}$ and $L^{57}$ as a preferred case, and methine groups not forming a ring are unsubstituted methine groups is preferred.

$n^{51}$ represents 1 or 2, preferably 1.

$M^{51}$ and $m^{51}$, $M^{52}$ and $m^{52}$, and $M^{53}$ and m each has the same meaning as $M^1$ and $m^1$ above. $L^4$, $L^5$ and $L^6$ each has the same meaning with the linking group exclusive of a single bond among those described in $L^1$, and the preferred range is also the same.

Of formulae (XXXIa), (XXXIb) and (XXXII), formulae (XXXIa) and (XXXII) are preferred, and formula (XXXII) is more preferred.

The specific examples of the dye compounds represented by formulae (A) and (I) which are particularly preferably used in the present invention are shown below, but the present invention is not limited thereto.

In the first place, the specific examples of dye chromophores $D^1$, $D^a$ and $D^b$ are shown (electric charge-equilibrating counter ions are omitted. These compounds may have any possible counter anion).

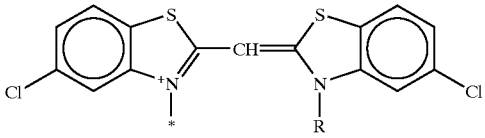

DS-1 R = $C_2H_5$
DS-2 R = $(CH_2)_3SO_3^-$
DS-3 R = $CH_2CONHSO_2CH_3$
DS-4 R = $CH_2CO_2H$

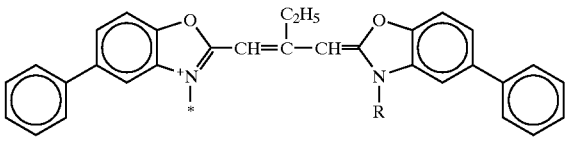

DS-5 R = $C_2H_5$
DS-6 R = $(CH_2)_4SO_3^-$

DS-7 R = $(CH_2)_2O$ 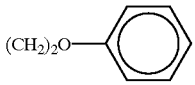

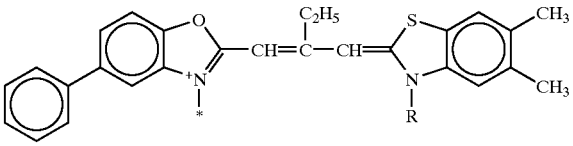

DS-8 R = $(CH_2)_2OH$
DS-9 R = $(CH_2)_2CHCH_3SO_3^-$

DS-10 R = $(CH_2)_3CONHSO_2$ 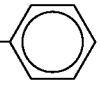

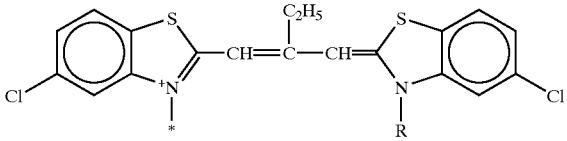

DS-11 R = $C_2H_5$
DS-12 R = $(CH_2)_3SO_3^-$

-continued

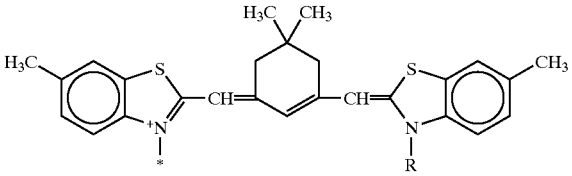

DS-13 R = $C_2H_5$
DS-14 R = $(CH_2)_3P_2O_3^{2-}$

DS-15 R = $(CH_2)_2O$ 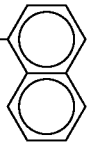

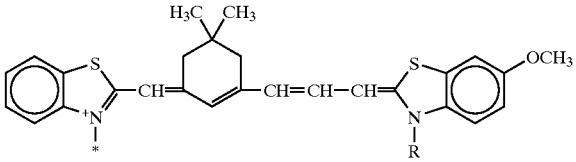

DS-16 R = $C_2H_5$
DS-17 R = $(CH_2)_3SO_3^-$

DS-18 R = $(CH_2)_2O$ 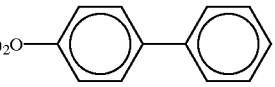

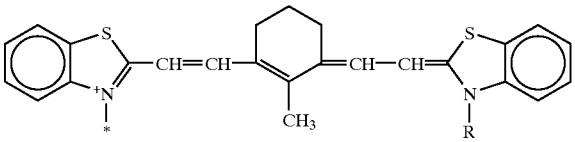

DS-19 R = $C_2H_5$

DS-20 = $(CH_2)_2O$ 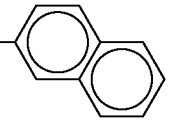

DS-21 = $(CH_2)_2S$ 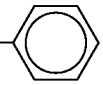

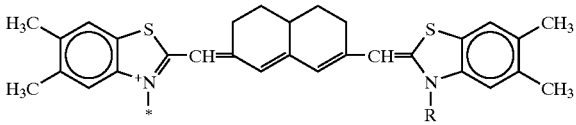

DS-22 R = $(n)C_5H_{11}$
DS-23 R = $(CH_2)_2O(CH_2)_2O$ 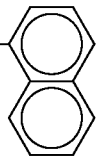

DS-24 R = $(CH_2)_2SO_3^-$

-continued

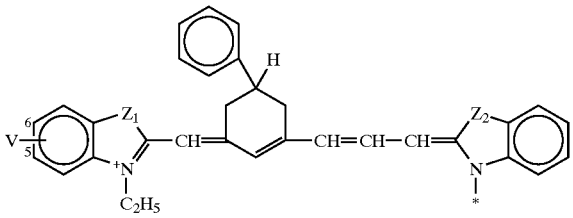

DS-25 $Z_1$ = Se, V = 5-$CH_3$, $Z_2$ = S
DS-26 $Z_1$ = N-$C_2H_5$, V = 5-CN, 6-Cl, $Z_2$ = O)
DS-27 $Z_1$ = Te, V = H, $Z_2$ = —CH═CH—

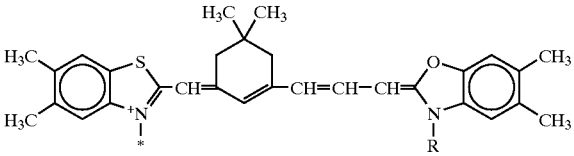

DS-28 R = $C_2H_5$
DS-29 R = $(CH_2)_2O$—

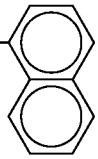

DS-29 R = $(CH_2)_2CHSO_3^-$

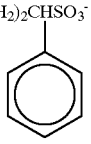

DS-31 R = $(CH_2)_2O$—

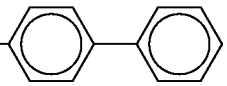

DS-32

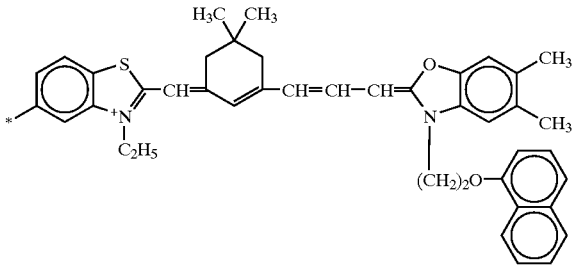

DS-33

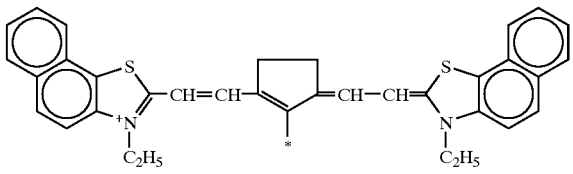

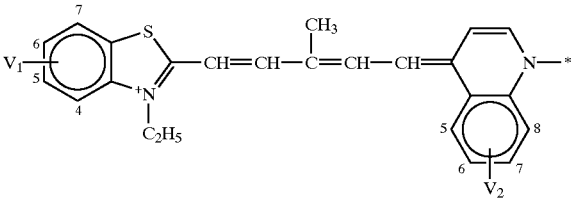

DS-34 $V_1$ = 5,6-$(CH_3)_2$, $V_2$ = H
DS-35 $V_1$ = 5,6-$(CH_3)_2$, $V_2$ = 6,7-$(CH_3)_2$

-continued

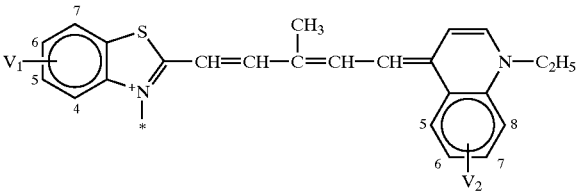

DS-36 $V_1$ = 5-$SOCH_3$, $V_2$ = 6,7-$(OCH_3)_2$
DS-37 $V_1$ = 5,6-$(CH_3)_2$, $V_2$ = 6,7-$(CH_3)_2$
DS-38 $V_1$ = 5-$SCH_3$, $V_2$ = H

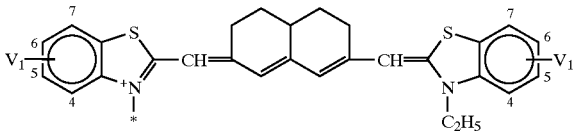

DS-39 $V_1$ = H
DS-40 $V_1$ = 5-$SCH_3$
DS-41 $V_1$ = 6-$OCH_3$
DS-42 $V_1$ = 6,7-Benzo
DS-43 $V_1$ = 5-$SOCH_3$

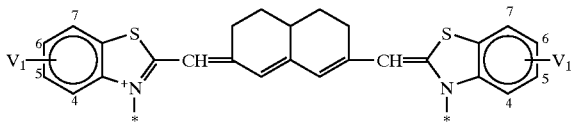

DS-44 $V_1$ = H
DS-45 $V_1$ = 5,6-$(CH_3)_2$

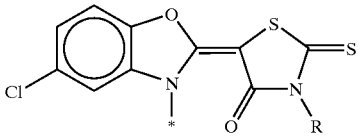

DS-50 R = $C_2H_5$
DS-51 R = $CH_2CO_2H$
DS-52 R = $(CH_2)_2SO_3^-$

DS-53 R =

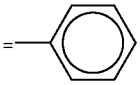

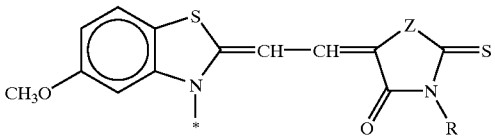

DS-54 $Z_1$ = S, R = $CH_2$—

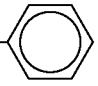

DS-55 $Z_1$ = $N(CH_2)_2O(CH_2)_2OH$, R =

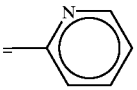

DS-56 $Z_1$ = O, R = $CH_2CO_2H$

-continued

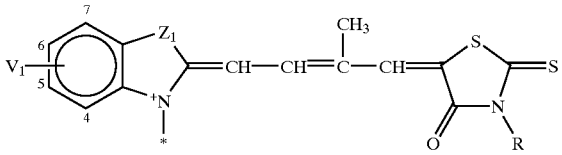

DS-57 $V_1$ = 5,6-$(CH_3)_2$, $Z_1$ = O, R = $CH_2CO_2H$
DS-58 $V_1$ = 6,7-$(CH_3)_2$, $Z_1$ = O, R = $CH_2CO_2H$
DS-59 $V_1$ = 6-$CH_3$, $Z_1$ = S, R = $CH_2CO_2H$
DS-60 $V_1$ = 5,6-$Cl_2$, $Z_1$ = N—$C_2H_5$, R = $C_2H_5$

DS-61 $V_1$ = 5-Cl, $Z_1$ = Se, R = 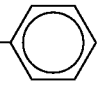

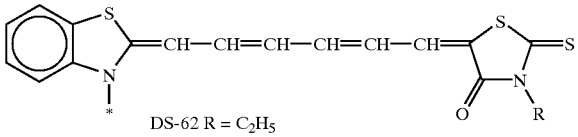

DS-62 R = $C_2H_5$
DS-63 R = $CH_2CO_2H$

DS-64 R =$(CH_2)_2O$— 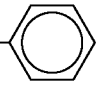

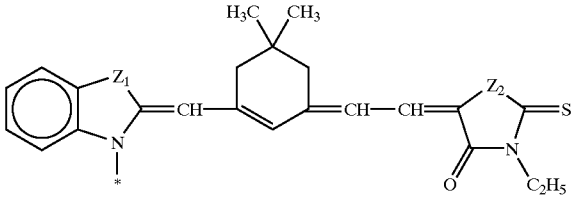

DS-65 $Z_1$ = S, $Z_2$ = S
DS-66 $Z_1$ = O, $Z_2$ - N—$C_2H_5$
DS-67 $Z_1$ = N—$C_2H_5$, $Z_2$ = O

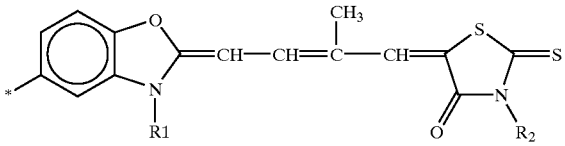

DS-68 $R_1$ = (n)$C_8H_{17}$, $R_2$ = $CH_2CO_2H$

DS-69 $R_1$ = $(CH_2)_2$— 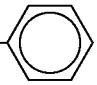 , $R_2$ = $C_2H_5$

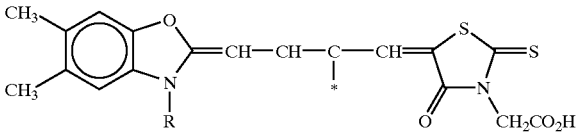

DS-70 R = $C_2H_5$
DS-71 R = $CH_2CO_2H$
DS-72 R = $(CH_2)_3CONHSO_2CH_3$

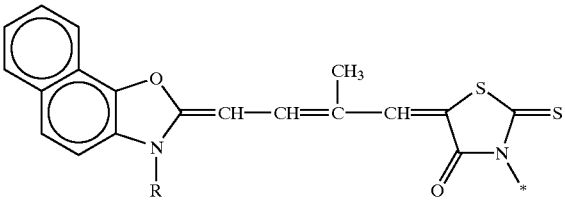

DS-73 R = (n)$C_8H_{17}$
DS-74 R = $CH_2CO_2H$
DS-75 R = $(CH_2)_4SO_3^-$

-continued

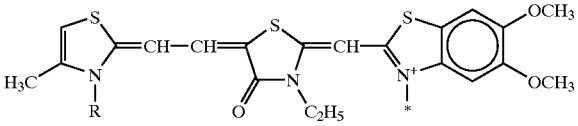

DS-100 R = $C_2H_5$
DS-101 R = $CH_2CO_2H$
DS-102 R = $(CH_2)_3SO_3^-$
DS-103 R = $(CH_2)_2OSO_3^-$

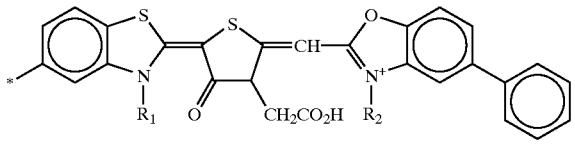

DS-104 $R_1$ = $R_2$ = $C_2H_5$
DS-105 $R_1$ = $(CH_2)_2SO_3^-$, $R_2$ = $CH_2CO_2H$

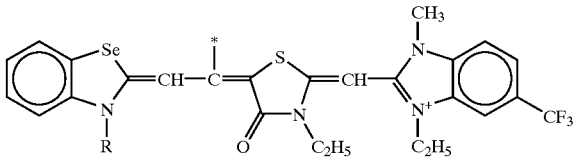

DS-106 R = $C_2H_5$
DS-107 R = $(CH_2)_2SO_3^-$

DS-108 R = $CH_2$— 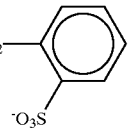

DS-109

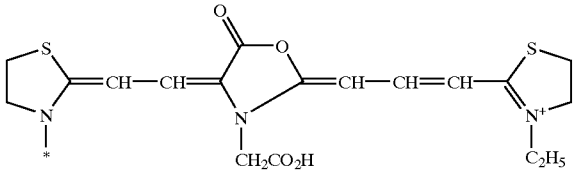

DS-110

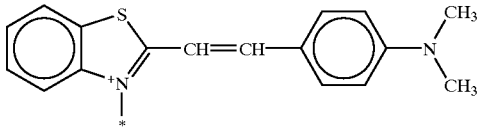

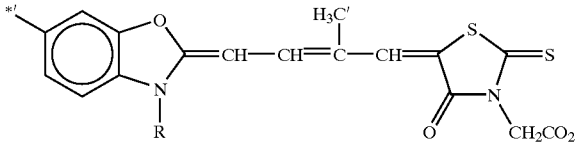

DS-111 R = $(CH_2)_3SO_3^-$
DS-112 R = $C_2H_5$

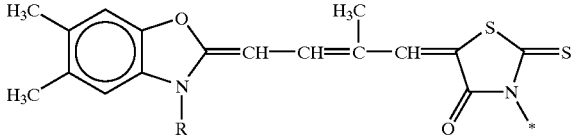

DS-113 R = $(CH_2)_4SO_3^-$
DS-114 R = $C_2H_5$
DS-115 R = $^n$-$C_5H_{11}$
DS-116 R = $(CH_2)_5CO_2H$

-continued

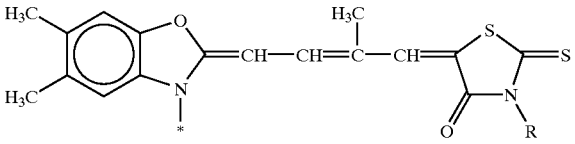

DS-117 R = $(CH_2)_2SO_3^-$

DS-118 R = 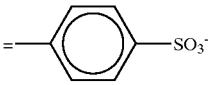

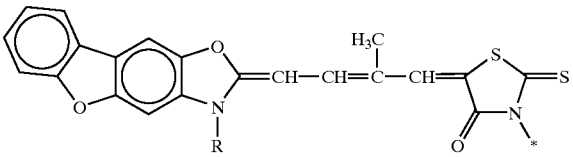

DS-119 R = $(CH_2)_3SO_3^-$

DS-120 R = $C_2H_5$

-continued

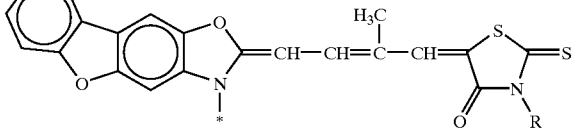

DS-121 R = $(CH_2)_3SO_3^-$

DS-122 R = $CH_2CO_2H$

In the next place, the specific examples of linking groups —$L^1$— or —$L^a$— are shown (electric charge-equilibrating counter ions are omitted. These compounds may have any possible counter anion).

Examples of linking groups —$L^1$— or —$L^a$—

L-1

L-2

L-3

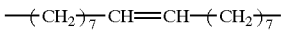

L-4

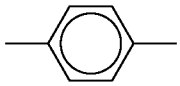

L-5

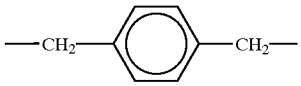

L-6

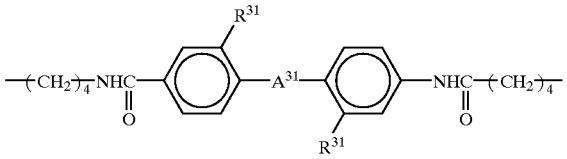

| | $A^{31}$ | $R^{31}$ |
|---|---|---|
| L-6 | — | H |
| L-7 | — | —$SO_3^-$ |
| L-8 | —O— | H |
| L-9 | —O— | —$SO_3^-$ |
| L-10 | —$SO_2$— | H |

L-11

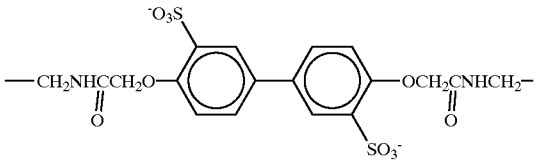

L-12

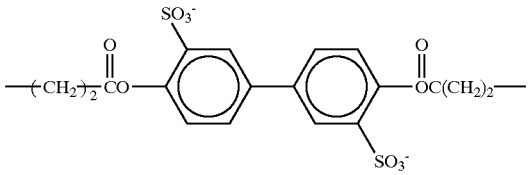

L-13

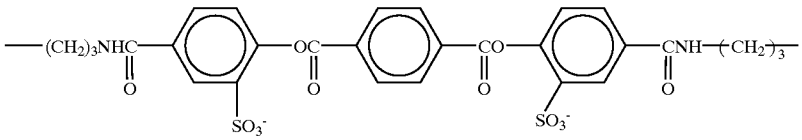

-continued
L-14
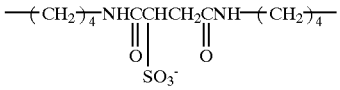
L-15
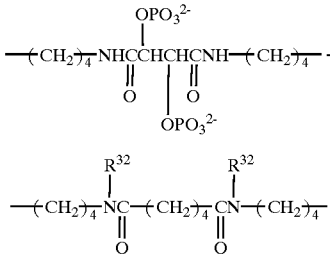
| | $R^{32}$ |
|---|---|
| L-16 | $-(CH_2)_3-SO_3^-$ |
| L-17 | $-(CH_2)_2-COOH$ |
| L-18 | $-(CH_2)_2-PO_3^-$ |
L-19
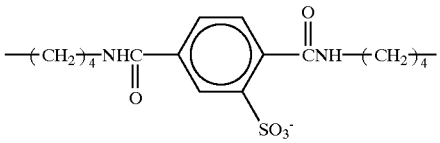
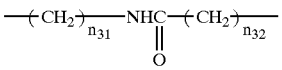
| | $n_{31}$ | $n_{32}$ |
|---|---|---|
| L-20 | 4 | 5 |
| L-21 | 8 | 5 |
| L-22 | 8 | 1 |
| L-23 | 4 | 3 |
| L-24 | 4 | 1 |
L-25
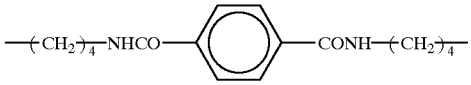
L-26
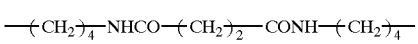
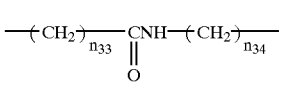
| | $n_{33}$ | $n_{34}$ |
|---|---|---|
| L-27 | 5 | 4 |
| L-28 | 5 | 8 |
| L-29 | 1 | 6 |
L-30
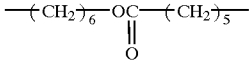
L-31
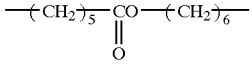
L-32
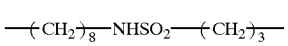
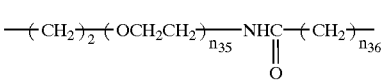
| | $n_{35}$ | $n_{36}$ |
|---|---|---|
| L-33 | 2 | 5 |
| L-34 | 2 | 1 |
| L-35 | 3 | 1 |
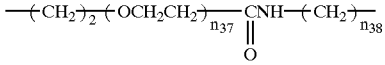
| | $n_{37}$ | $n_{38}$ |
|---|---|---|
| L-36 | 2 | 3 |
| L-37 | 2 | 4 |
| L-38 | 2 | 8 |
L-39
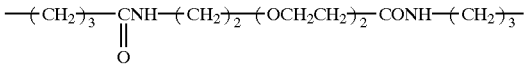
L-40
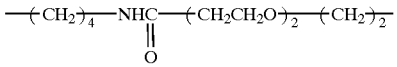
L-41
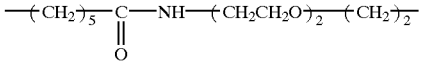
L-42
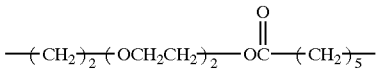
L-43
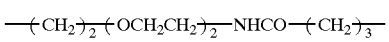
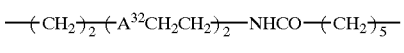
| | $A^{32}$ |
|---|---|
| L-44 | $-S-$ |
| L-45 | $-N(CH_3)-$ |
| L-46 | $-CH(OH)-$ |

-continued

L-47

$$-(CH_2)_2-SO_2-(CH_2)_2-NHCO-(CH_2)_5-$$

L-48

$$-[(CH_2)_2-O]_n-(CH_2)_2-$$

L-49 n = 1
L-50 n = 2
L-51 n = 3
L-52 n = 4

$$-(CH_2)_n-$$

L-53 n = 2
L-54 n = 5
L-55 n = 12

L-56

$$-CH_2C\equiv CCH_2-$$

L-57

$$-S-(CH_2)_5-S-$$

L-58

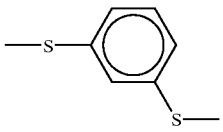

L-59

$$-(CH_2)_5CONH-(CH_2)_2N(-(CH_2)_2NHCO(CH_2)_5-)-(CH_2)_2-NH-CO-(CH_2)_5-$$

$$-(CH_2)_n-$$

L-60 n = 1
L-61 n = 3
L-62 n = 6
L-63 n = 10
L-64 n = 9
L-65 n = 18
L-66 n = 14
L-67 n = 16
L-68 n = 24

$$-[(CH_2)_2-O]_n-(CH_2)_2-$$

L-69 n = 44(average)

L-70

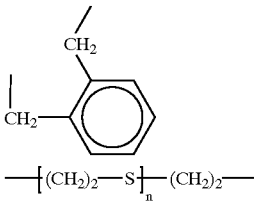

L-71

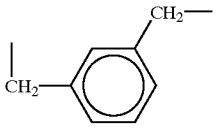

L-72 n = 1
L-73 n = 2
L-74 n = 3

The specific examples of the compounds represented by formula (A) or (I) for use in the present invention are shown below.

The specific examples of $D^1$—$L^1$—$D^1$ $M^1m^1$ (a case in which all of $q^1$, $q^2$ and $r^1$ in formula (I) represent 1) are shown below.

Each of structural formulae DS-1 to DS-122 is linked with $L^1$ at the position of the asterisk.

| No. | $D^1$ | $L^1$ | $M^1$ | $m^1$ |
|---|---|---|---|---|
| DD-1 | DS-1 | L-2 | p-TsO$^-$ | 2 |
| DD-2 | DS-2 | L-50 | — | — |

-continued

| No. | $D^1$ | $L^1$ | $M^1$ | $m^1$ |
|---|---|---|---|---|
| DD-3 | DS-7 | L-51 | p-TsO$^-$ | 2 |
| DD-4 | DS-11 | L-5 | p-TsO$^-$ | 2 |
| DD-5 | DS-15 | L-7 | — | — |
| DD-6 | DS-16 | L-11 | — | — |
| DD-7 | DS-21 | L-13 | — | — |
| DD-8 | DS-24 | L-14 | $Na^+$ | 2 |
| DD-9 | DS-26 | L-21 | Br | 2 |
| DD-10 | DS-28 | L-50 | $CH_3SO_3^-$ | 2 |
| DD-11 | DS-29 | L-50 | $CH_3SO_3^-$ | 2 |
| DD-12 | DS-31 | L-5 | p-TsO$^-$ | 2 |
| DD-13 | DS-32 | L-30 | p-TsO$^-$ | 2 |
| DD-14 | DS-33 | L-58 | $Cl^-$ | 2 |

-continued

| No. | $D^1$ | $L^1$ | $M^1$ | $m^1$ |
|---|---|---|---|---|
| DD-15 | DS-51 | L-33 | — | — |
| DD-16 | DS-54 | L-41 | — | — |
| DD-17 | DS-57 | L-50 | — | — |
| DD-18 | DS-57 | L-51 | — | — |
| DD-19 | DS-58 | L-50 | — | — |
| DD-20 | DS-58 | L-54 | — | — |
| DD-21 | DS-63 | L-43 | — | — |
| DD-22 | DS-65 | L-7 | $Na^+$ | 2 |
| DD-23 | DS-68 | L-52 | — | — |
| DD-24 | DS-70 | L-16 | $HN^+(C_2H_5)_3$ | 2 |
| DD-25 | DS-75 | L-56 | $K^+$ | 2 |
| DD-26 | DS-100 | L-50 | p-$TsO^-$ | 2 |
| DD-27 | DS-104 | L-1 | $Cl^-$ | 2 |
| DD-28 | DS-107 | L-9 | $Na^+$ | 2 |
| DD-29 | DS-109 | L-11 | — | — |
| DD-30 | DS-110 | L-54 | p-$TsO^-$ | 2 |
| DD-31 | DS-28 | L-1 | $CH_3SO_3^-$ | 2 |
| DD-32 | DS-28 | L-2 | $CH_3SO_3^-$ | 2 |
| DD-33 | DS-28 | L-63 | $CH_3SO_3^-$ | 2 |
| DD-34 | DS-57 | L-1 | — | — |
| DD-35 | DS-57 | L-2 | — | — |
| DD-36 | DS-57 | L-63 | — | — |
| DD-37 | DS-58 | L-1 | — | — |
| DD-38 | DS-58 | L-2 | — | — |
| DD-39 | DS-58 | L-63 | — | — |
| DD-40 | DS-35 | L-2 | p-$TsO^-$ | 2 |
| DD-41 | DS-37 | L-63 | $CH_3SO_3^-$ | 2 |
| DD-42 | DS-39 | L-1 | $Br^-$ | 2 |
| DD-43 | DS-40 | L-2 | p-$TsO^-$ | 2 |
| DD-44 | DS-43 | L-63 | $BF_4^-$ | 2 |
| DD-45 | DS-29 | L-2 | $CH_3SO_3^-$ | 2 |
| DD-46 | DS-57 | L-54 | — | — |
| DD-47 | DS-57 | L-62 | — | — |
| DD-48 | DS-57 | L-54 | $N(C_2H_5)_3$ | 1 |
| DD-49 | DS-57 | L-64 | — | — |
| DD-50 | DS-57 | L-55 | — | — |
| DD-51 | DS-57 | L-55 | $N(C_2H_5)_3$ | 1 |
| DD-52 | DS-57 | L-65 | $N(C_2H_5)_3$ | 2 |
| DD-53 | DS-57 | L-5 | — | — |
| DD-54 | DS-58 | L-55 | — | — |
| DD-55 | DS-113 | L-2 | $HN^+(C_2H_5)_3$ | 2 |
| DD-56 | DS-114 | L-2 | — | — |
| DD-57 | DS-115 | L-2 | — | — |
| DD-58 | DS-116 | L-2 | — | — |
| DD-59 | DS-111 | L-48 | $K^+$ | 4 |
| DD-60 | DS-111 | L-63 | $Na^+$ | 4 |
| DD-61 | DS-117 | L-2 | $HN^+(C_2H_5)_3$ | 2 |
| DD-62 | DS-118 | L-2 | $HN^+(C_2H_5)_3$ | 2 |
| DD-63 | DS-119 | L-2 | $HN^+(C_2H_5)_3$ | 2 |
| DD-64 | DS-122 | L-62 | — | — |
| DD-65 | DS-57 | L-69 | — | — |
| DD-66 | DS-29 | L-55 | $CH_3SO_3^-$ | 2 |
| DD-67 | DS-40 | L-55 | p-$TsO^-$ | 2 |
| DD-68 | DS-43 | L-55 | $BF_4^-$ | 2 |

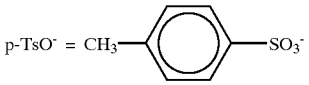

The specific example of a case wherein two $D^1$'s are linked with two $L^1$'s is shown below (a case in which $q^2$ represents 2 and $q^1$ and $r^1$ represent 1 in formula (I)).

DS-44 is linked with L-55 at the position of the asterisk.

DD-69

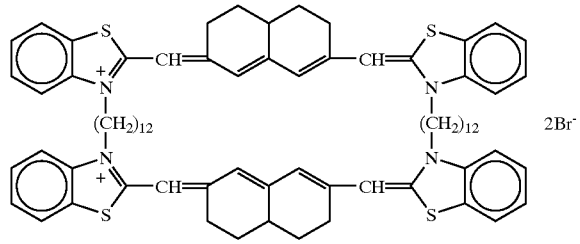

The specific examples of a case wherein there are three or more $D^1$'s are shown below (a case in which $q^2$ represents 1, and either $q^1$ or $r^1$ represents 1 and the other represents 2 in formula (I)).

Each of structural formulae DS-1 to DS-122 is linked with $L^1$ at the position of the asterisk.

DD-70

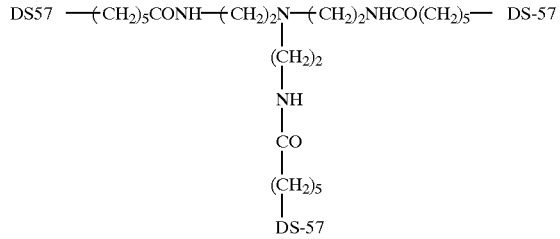

DD-71

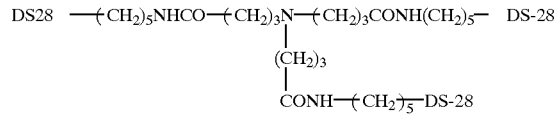

The specific examples of $D^a$—$L^a$—$D^b$ $M^a m^a$ (a case in which all of $q^a$, $q^b$ and $r^a$ in formula (A) represent 1) are shown below.

Each of structural formulae DS-1 to DS-122 is linked with $L^a$ at the position of the asterisk.

| No. | $D^a$ | $D^b$ | $L^a$ [1)] | $M^a$ | $M^a$ |
|---|---|---|---|---|---|
| DD-72 | DS-28 | DS-29 | L-55 | $CH_3SO_3^-$ | 2 |
| DD-73 | DS-28 | DS-30 | L-54 | $CH_3SO_3^-$ | 1 |
| DD-74 | DS-57 | DS-58 | L-55 | — | |
| DD-75 | DS-28 | DS-57 | L-3 | $CH_3SO_3^-$ | 1 |
| DD-76 | DS-57 | DS-58 | L-2 | — | — |

[1)] The left side of $L^a$ is $D^a$.

The sensitizing dyes represented by formula (A) or (I) for use in the present invention can be synthesized according to the methods described in F. M. Harmer, *Heterocyclic compounds— Cyanine Dyes and Related Compounds*, John Wiley & Sons, New York, London (1964), D. M. Sturmer, *Heterocyclic Compounds Special Topics in Heterocyclic Chemistry*, Chap. 18, Clause 14, pp. 482 to 515, John Wiley & Sons, New York, London (1977), and *Rodd's Chemistry of Carbon Compounds,* 2nd Ed., Vol. IV, Part B, Chap. 15, pp. 369 to 422, Elsevier Science Publishing Company Inc., New York (1977).

The synthesis of the sensitizing dye represented by formula (A) or (I) for use in the present invention is described below by a specific example.

SYNTHESIS EXAMPLE

Synthesis of Compound (DD-17)

Compound (DD-17) was synthesized according to the following Reaction Scheme 1.

Reaction Scheme 1

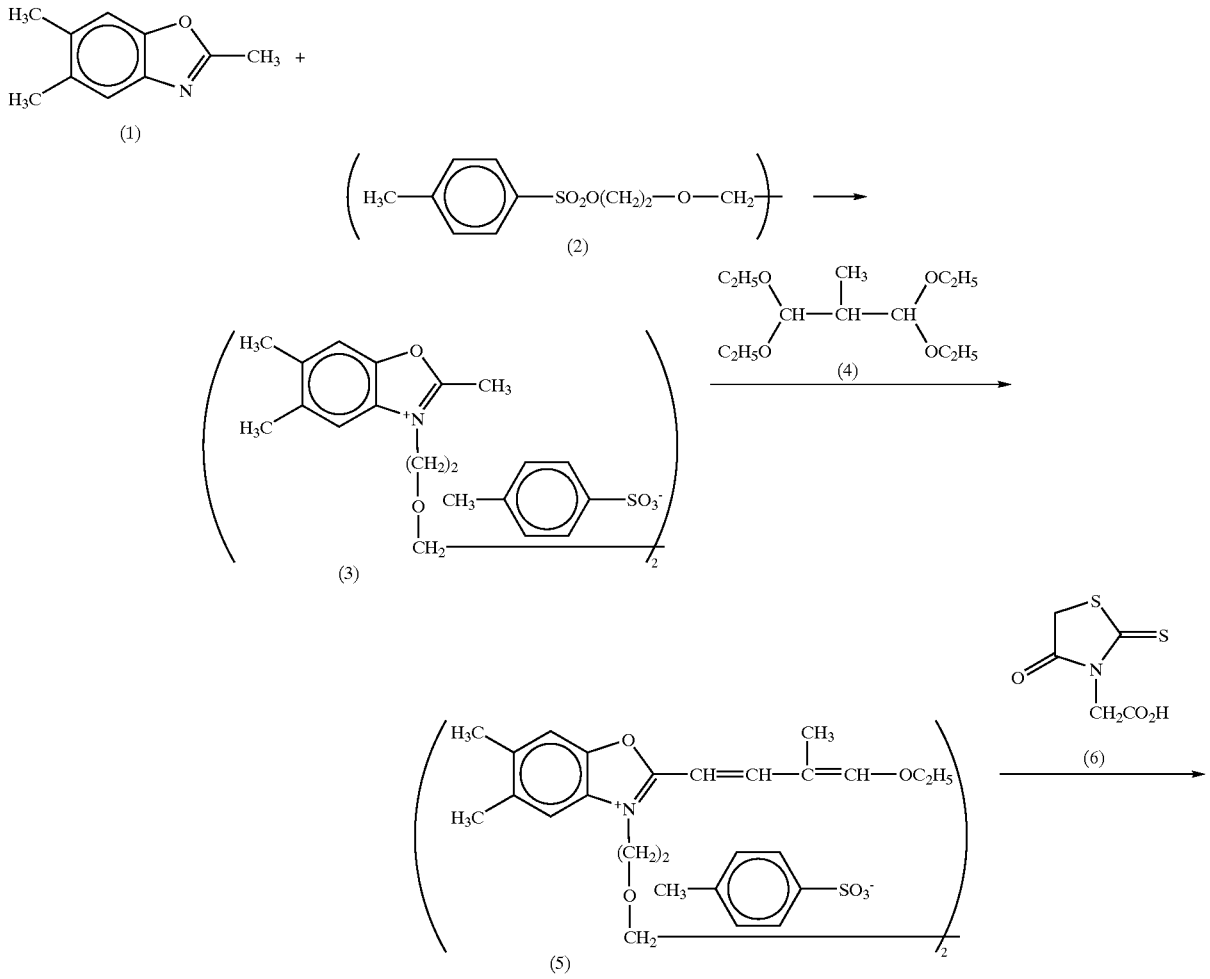

DD-17

Ten (10) grams of compound (1) and 14.2 g of compound (2) were stirred with heating for 9 hours in an oil bath the temperature of which was set at 150° C. To the solution was then added 100 ml of ethyl acetate, and the supernatant was removed by decantation, thereby oily compound (3) was obtained. Acetic anhydride (50 ml) and 43.6 g of compound (4) were added to compound (3) as it was without isolation, and the solution was stirred for 30 minutes with heating at outer temperature of 100° C. To the reaction solution were added 150 ml of ethyl acetate and 200 ml of hexane, and the supernatant was removed by decantation, thereby oily compound (5) was obtained. Acetonitrile (150 ml) and 11.9 g of compound (6) were added to compound (5) as it was without isolation, and further 26 ml of triethylamine was added thereto, and the mixture was stirred at room temperature for 1 hour. To the reaction solution were added 15 ml of acetic acid, 150 ml of ethyl acetate and 150 ml of hexane, and the reaction solution was allowed to stand for 24 hours. The crystals precipitated were filter by suction, and the thus-obtained crystals were dissolved in a mixed solution comprising 350 ml of methanol and 3 ml of triethylamine at room temperature. After the solution was filtered naturally, 4 ml of acetic acid was added to the filtrate, and the filtrate was allowed to stand for 24 hours. The crystals obtained were dissolved in a mixed solution comprising 100 ml of methanol and 2 ml of triethylamine at room temperature, and then filtered. Acetic acid (3 ml) was added to the filtrate and the filtrate was allowed to stand for 24 hours. The crystals obtained were filtered by suction and washed with methanol. This procedure was repeated one more time. The thus-obtained crystals were dried under reduced pressure, thereby 2 g of compound (DD-17) was obtained.

Absorption of solution (methanol plus one droplet of triethylamine), $\lambda max=561$ nm, $\epsilon=180{,}000$, shoulder absorption was confirmed at 585 nm.

In the present invention, the sensitizing dyes represented by formulae (A) and (I) may be used alone or two or more, or may be used in combination with other sensitizing dyes.

As such dyes, a cyanine dye, a merocyanine dye, a rhodacyanine dye, a trinuclear merocyanine dye, a tetranuclear merocyanine dye, an alopolar dye, a hemicyanine dye and a styryl dye are preferably used. More preferred dyes are a cyanine dye, a merocyanine dye and a rhodacyanine dye, and a cyanine dye is particularly preferred.

These dyes are described in detail in F. M. Harmer, *Heterocyclic Compounds—Cyanine Dyes and Related*

*Compounds*, John Wiley & Sons, New York, London (1964), D. M. Sturmer, *Heterocyclic Compounds—Special Topics in Heterocyclic Chemistry*, Chap. 18, Clause 14, pp. 482 to 515, John Wiley & Sons, New York, London (1977), and *Rodd's Chemistry of Carbon Compounds,* 2nd Ed., Vol. IV, Part B, Chap. 15, pp. 369 to 422, Elsevier Science Publishing Company Inc., New York (1977).

As the specific examples of the dyes which can be preferably used in combination, the formulae and the sensitizing dyes shown in the specific examples disclosed on pages 32 to 44 in U.S. Pat. No. 5,994,051, on pages 30 to 39 in U.S. Pat. No. 5,747,236 can be exemplified.

Further, as the preferred cyanine, merocyanine and rhodacyanine dyes, those represented by formulae (XI), (XII) and (XIII) disclosed in columns 21 and 22 in U.S. Pat. No. 5,340,694 can be exemplified (however, the numbers of $n_{12}$, $n_{15}$, $n_{17}$ and $n_{18}$ are not restricted here and regarded as the integers of 0 or more (preferably 4 or less)).

These sensitizing dyes to be used in combination may be used alone or two or more may be used in combination. A combination of sensitizing dyes is often used for the purpose of supersensitization.

The representative examples of combinations are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862, 4,026,707, British Patents 1,344,281, 1,507,803, JP-B-43-49336, JP-B-53-12375, JP-A-52-110618 and JP-A-52-109925.

Dyes which themselves do not have a spectral sensitizing function or substances which substantially do not absorb visible rays but show supersensitization can be incorporated into an emulsion with sensitizing dyes.

Supersensitizers preferably used in spectral sensitization in the present invention (e.g., pyrimidylamino compounds, triazinylamino compounds, azolium compounds, aminostyryl compounds, aromatic organic acid-formaldehyde condensation products, azaindene compounds, cadmium salts) and the combination of supersensitizers with sensitizing dyes are disclosed, e.g., in U.S. Pat. Nos. 3,511,664, 3,615,613, 3,615,632, 3,615,641, 4,596,767, 4,945,038, 4,965,182, 2,933,390, 3,635,721, 3,743,510, 3,617,295, and 3,635,721, and the using methods disclosed in these patents are also preferably used.

The time of addition of the sensitizing dyes represented by formulae (A) and (I) according to the present invention (and other sensitizing dyes and supersensitizers) to the silver halide emulsions for use in the present invention may be at any stage of the preparation of the emulsion recognized as useful hitherto.

For example, the sensitizing dyes may be added at any stage if it is before coating of the emulsion, i.e., before grain formation stage of silver halide grains and/or before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920.

Also, as disclosed in U.S. Pat. No. 4,225,666 and JP-A-58-7629, these sensitizing dyes can be used as a single compound alone or in combination with compounds having different structures, and they can be divided and added separately, e.g., one part of them is added during grain formation stage and the remaining is added during chemical ripening or after completion of chemical ripening, alternatively one part is added prior to chemical ripening or during ripening stage and the remaining after completion of chemical ripening. The kinds of compounds added separately and the combinations of compounds may be varied.

The addition amount of the sensitizing dyes represented by formula (A) and (I) (and other sensitizing dyes and supersensitizers) for use in the present invention can be selected in accordance with the properties such as sensitivity and fog, the shape and the size of silver halide grains, but the amount is preferably from $10^{-6}$ to 1 mol per mol of the silver halide in a photosensitive layer, more preferably from $10^{-4}$ to $10^{-1}$ mol.

The sensitizing dyes represented by formula (A) and (I) (and other sensitizing dyes and supersensitizers) for use in the present invention can be directly dispersed in an emulsion.

Alternatively, the sensitizing dyes may be dissolved in an appropriate solvent, e.g., methyl alcohol, ethyl alcohol, methyl Cellosolve, acetone, water, pyridine, or mixtures of these solvents, and added to an emulsion as a solution. At this time, additives such as bases, acids and surfactants can be added together. Further, ultrasonic waves can also be used for dissolution.

Various methods can be used for the addition of these compounds to an emulsion, e.g., a method of dissolving the compounds in a volatile organic solvent, dispersing the solution in a hydrophilic colloid and adding this dispersion to an emulsion as disclosed in U.S. Pat. No. 3,469,987, a method of dispersing the compounds in a water-soluble solvent and adding the dispersion to an emulsion as disclosed in JP-B-46-24185, a method of dissolving the compounds in a surfactant and adding the solution to an emulsion as disclosed in U.S. Pat. No. 3,822,135, a method of dissolving the compounds using a compound capable of red-shifting and adding the solution to an emulsion as disclosed in JP-A-51-74624, and a method of dissolving the compounds in an acid not substantially containing water and adding the solution to an emulsion as disclosed in JP-A-50-80826 can be used.

Besides the above methods, the methods disclosed in U.S. Pat. Nos. 2,912,343, 3,342,605, 2,996,287 and 3,429,835 can also be used for the addition of the compounds to an emulsion.

The heat-developable photosensitive material according to the present invention is described in further detail below.

Organic silver salts which can be used in the present invention are relatively stable against light but are capable of forming a silver image when heated at 80° C. or higher in the presence of an exposed photocatalyst (e.g., the latent image of a photosensitive silver halide) and a reducing agent organic silver salts may be arbitrary organic substances containing sources which can reduce silver ions.

Such non-photosensitive organic silver salts are disclosed in JP-A-10-62899, paragraphs [0048] to [0049], and EP-A-0803764, line 24, page 18 to line 37, page 19, and EP-A-0962812.

Silver salts of organic acids, in particular, silver salts of long chain aliphatic carboxylic acids having from 10 to 30 of carbon atoms, preferably from 15 to 28, are preferably used in the present invention. The preferred examples of silver salts include silver behenate, silver arachidate, silver stearate, silver oleate, silver laurate, silver caproate, silver myristate, silver palmitate, and mixtures of these silver salts. Of these organic silver salts, it is preferred in the present invention to use organic acid silver having a silver behenate content of 75 mol % or more.

The shape of the organic silver salt which can be used in the present invention is not particularly restricted, and acicular, cylindrical, tabular and scaly organic silver salts may be used.

Scaly organic acid silver salts are preferably used in the present invention. A scaly organic silver salt is judged as follows in the specification of the present invention: An organic acid silver salt is observed with an electron microscope, the shape of the organic acid silver salt particle is approximated to a rectangular parallelopiped, and when the sides of the rectangular parallelopiped are taken as a, b and c from the shortest (c may be equal to b), x is computed from the shorter numeric values a and b as follows:

$$x=b/a$$

x is obtained as to about 200 particles by the above equation, and when the average value is taken as x (average), those satisfy the relationship x (average) ≧1.5 are regarded as scaly particles, preferably 30≧x (average) ≧1.5, more preferably 20≧x (average) ≧2.0. In this connection, acicular is 1≦x (average) <1.5.

In a scaly particle, a can be regarded as a thickness of a tubular particle having a plane with b and c as the sides as a main plane. The average of a is preferably from 0.01 to 0.23 μm, and more preferably from 0.1 to 0.20 μm. The average of c/b is preferably from 1 to 6, more preferably from 1.05 to 4, still more preferably from 1.1 to 3, and particularly preferably from 1.1 to 2.

The particle size distribution of an organic silver salt is preferably monodispersion. Monodispersion means that the values in terms of percentage obtained by dividing the standard deviations of the respective lengths of short axis and long axis by the respective lengths of short axis and long axis respectively are preferably 100% or less, more preferably 80% or less, and most preferably 50% or less. The shape of organic silver salt can be obtained from the transmission electron microscopic image of an organic silver salt dispersion product.

As another method of measuring monodispersing property, a method of obtaining the standard deviation of the volume weighted mean diameter of an organic silver salt can be used. The value obtained in terms of percentage by dividing the standard deviation of the volume weighted mean diameter by the volume weighted mean diameter (variation coefficient) is preferably 100% or less, more preferably 80% or less, and most preferably 50% or less. Monodispersing property can be obtained from the particle size (volume weighted mean diameter) obtained by irradiating the organic silver salt dispersed in a solution with laser beams, and finding the autocorrelation function to the time variation of fluctuation of light scattering.

Well-known methods can be used for the production and dispersion of the organic acid silver for use in the present invention. For example, JP-A-10-62899, EP-A-0803763 and EP-A-962812 can be referred to.

When a photosensitive silver salt is present during dispersion of the organic silver salt, fog increases and sensitivity extremely lowers. Thus, it is more preferred not to substantially contain a photosensitive silver salt during dispersion. The content of a photosensitive silver salt in the solution to be dispersed is 0.1 mol % or less per mol of the organic silver salt in the solution, thus it is preferred not to add a photosensitive silver salt positively.

A heat-developable photosensitive material can be prepared by mixing a water dispersion solution of an organic silver salt and a water dispersion solution of a photosensitive silver salt according to the present invention. The mixing ratio of an organic silver salt and a photosensitive silver salt can be selected according to purposes, but the ratio of a photosensitive silver salt to an organic silver salt is preferably from 1 to 30 mol %, more preferably from 3 to 20 mol %, and particularly preferably from 5 to 15 mol %. Mixture of two or more kinds of water dispersion solutions of organic silver salts and two or more kinds of water dispersion solutions of photosensitive silver salts is preferably used for adjusting photographic characteristics.

The organic silver salt can be used in a desired amount in the present invention but the amount is preferably from 0.1 to 5 g/m$^2$, more preferably from 1 to 3 g/m$^2$, as silver amount, of the heat-developable photosensitive material.

The heat-developable photosensitive material of the present invention contains a reducing agent for organic silver salts. A reducing agent for organic silver salts may be an arbitrary substance (preferably an organic substance) for reducing silver ions to metal silver.

Such reducing agents are disclosed in JP-A-11-65021, paragraphs [0043] to [0045], and EP-A-0803764, line 34, page 7 to line 12, page 18.

A bisphenol reducing agent is preferably used in the present invention as a reducing agent, and the compound represented by the following formula (Ia) is more preferably used.

(Ia)

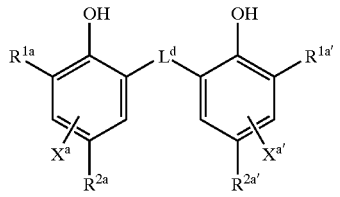

wherein $R^{1a}$ and $R^{1a'}$ each represents an alkyl group having from 1 to 20 carbon atoms; $X^a$ and $X^{a'}$ each represents a hydrogen atom or a group capable of substituting on a benzene ring; $R^{1a}$ and $X^a$, $R^{1a'}$ and $X^{a'}$, $R^{2a}$ and $X^a$, and $R^{2a'}$ and $X^{a'}$ may be bonded to each other to form a ring; $R^{2a}$ and $R^{2a'}$ each represents a hydrogen atom or a group capable of substituting on a benzene ring; $L^d$ represents an —S— group or a —$CHR^{3a}$— group; and $R^{3a}$ represents a hydrogen atom or an alkyl group having from 1 to 20 carbon atoms.

In formula (Ia), $R^{1a}$ and $R^{1a'}$ each represents a substituted or unsubstituted, straight chain, branched or cyclic alkyl group having from 1 to 20 carbon atoms.

The substituents of the alkyl group are not particularly restricted, and preferably an aryl group, a hydroxyl group, an alkoxyl group, an aryloxy group, an alkylthio group, an arylthio group, an acylamino group, a sulfonamido group, a sulfonyl group, a phosphoryl group, an acyl group, a carbamoyl group, an ester group and a halogen atom are exemplified.

$R^{1a}$ and $R^{1a}$ each more preferably represents a secondary or tertiary alkyl group having from 3 to 15 carbon atoms (e.g., isopropyl, isobutyl, tert-butyl, tert-amyl, tert-octyl, cyclohexyl, cyclopentyl, 1-methylcyclohexyl, 1-methylcyclopropyl), still more preferably a tertiary alkyl group having from 4 to 12 carbonatoms, of the tertiaryalkyl groups, tert-butyl, tert-amyl and 1-methylcyclohexyl are especially preferred, and tert-butyl is most preferred.

$R^{2a}$ and $R^{2a'}$ each represents a hydrogen atom or a group capable of substituting on a benzene ring. $X^a$ and $X^{a'}$ each represents a hydrogen atom or a group capable of substituting on a benzene ring. As the group capable of substituting on a benzene ring, an alkyl group, an aryl group, a halogen atom, an alkoxyl group and an acylamino group are preferably exemplified.

$R^{2a}$ and $R^{2a'}$ each preferably represents an alkyl group having from 1 to 20 carbon atoms (e.g., methyl, ethyl, propyl, butyl, isopropyl, tert-butyl, tert-amyl, cyclohexyl, 1-methylcyclohexyl, benzyl, methoxymethyl, methoxyethyl), more preferably methyl, ethyl, propyl, isopropyl or tert-butyl.

$X^a$ and $X^{a'}$ each preferably represents a hydrogen atom, a halogen atom or an alkyl group, particularly preferably a hydrogen atom.

$R^{1a}$ and $X^a$, $R^{1a'}$ and $X^{a'}$, $R^{2a}$ and $X^a$, and $R^{2a'}$ and $X^{a'}$ may be bonded to each other to form a ring, and the ring is preferably a 5- to 7-membered ring, and more preferably a saturated 6-membered ring.

$L^d$ represents an —S—group or a —$CHR^{3a}$— group, and $R^{3a}$ represents a hydrogen atom or a substituted or unsubstituted, straight chain, branched or cyclic alkyl group having from 1 to 20 carbon atoms.

As the specific examples of the unsubstituted alkyl group represented by $R^{3a}$, a methyl group, an ethyl group, a propyl group, a butyl group, a heptyl group, an undecyl group, an isopropyl group, a 1-ethylpentyl group and a 2,4,4-trimethylpentyl group can be exemplified. The substituents of the substituted alkyl group represented by $R^{3a}$ are the same as the substituents of the substituted alkyl group represented by $R^{1a}$ and $R^{1a'}$.

$L^d$ represents an —S— group or a —$CHR^{3a}$— group, and preferably represents a —$CHR^{3a}$— group.

$R^{3a}$ represents a hydrogen atom or an alkyl group having from 1 to 20 carbon atoms. The alkyl group represented by $R^{3a}$ may be straight chain, branched or cyclic, and may be substituted. The alkyl group represented by $R^{3a}$ preferably has from 1 to 15 carbon atoms.

As the specific examples of the unsubstituted alkyl group represented by $R^{3a}$, a methyl group, an ethyl group, a propyl group, a butyl group, a heptyl group, an undecyl group, an isopropyl group, a 1-ethylpentyl group and a 2,4,4-trimethylpentyl group can be exemplified. The examples of the substituents of the substituted alkyl group represented by $R^{3a}$ include a halogen atom, an alkoxyl group, an alkylthio group, an aryloxy group, an arylthio group, an acylamino group, a sulfonamide group, a sulfonyl group, a phosphoryl group, an oxycarbonyl group, a carbamoyl group, and a sulfamoyl group.

$R^{3a}$ preferably represents a hydrogen atom, a methyl group, an ethyl group, a propyl group, an isopropyl group, or a 2,4,4-trimethylpentyl group, and particularly preferably a hydrogen atom, a methyl group, an ethyl group, or a propyl group.

When $R^{3a}$ represents a hydrogen atom, $R^{2a}$ and $R^{2a'}$ each preferably represents an alkyl group having from 2 to 5 carbon atoms, more preferably an ethyl group or a propyl group, and most preferably an ethyl group.

When $R^{3a}$ represents a primary or secondary alkyl group having from 1 to 8 carbon atoms, $R^{2a}$ and $R^{2a'}$ each preferably represents a methyl group. As the primary or secondary alkyl group having from 1 to 8 carbon atoms represented by $R^{3a}$, a methyl group, an ethyl group, a propyl group and an isopropyl group are more preferred, and a methyl group, an ethyl group and a propyl group are still more preferred.

The specific examples of the reducing agents represented by formula (Ia) are shown below, but the compounds which can be used in the present invention are not limited thereto.

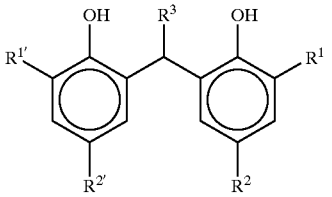

| | $R^1$ | $R^{1'}$ | $R^2$ | $R^{2'}$ | $R^3$ |
|---|---|---|---|---|---|
| 1 | $CH_3$ | $CH_3$ | $CH_3$ | $CH_3$ | H |
| 2 | $CH_3$ | $CH_3$ | $CH_3$ | $CH_3$ | $CH_3$ |
| 3 | $CH_3$ | $CH_3$ | $CH_3$ | $CH_3$ | $C_3H_7$ |
| 4 | $CH_3$ | $CH_3$ | $CH_3$ | $CH_3$ | (i)$C_3H_7$ |
| 5 | $CH_3$ | $CH_3$ | $CH_3$ | $CH_3$ | $CH(C_2H_5)C_4H_9$ |
| 6 | $CH_3$ | $CH_3$ | $CH_3$ | $CH_3$ | $CH_2CH(CH_3)CH_2C(CH_3)_3$ |
| 7 | $CH_3$ | $CH_3$ | $C_2H_5$ | $C_2H_5$ | H |
| 8 | $CH_3$ | $CH_3$ | $C_2H_5$ | $C_2H_5$ | (i)$C_3H_7$ |
| 9 | $C_2H_5$ | $C_2H_5$ | $CH_3$ | $CH_3$ | H |
| 10 | $C_2H_5$ | $C_2H_5$ | $CH_3$ | $CH_3$ | (i)$C_3H_7$ |
| 11 | (t)$C_4H_9$ | (t)$C_4H_9$ | $CH_3$ | $CH_3$ | H |
| 12 | (t)$C_4H_9$ | (t)$C_4H_9$ | $CH_3$ | $CH_3$ | $CH_3$ |
| 13 | (t)$C_4H_9$ | (t)$C_4H_9$ | $CH_3$ | $CH_3$ | $C_2H_5$ |
| 14 | (t)$C_4H_9$ | (t)$C_4H_9$ | $CH_3$ | $CH_3$ | (n)$C_3H_7$ |
| 15 | (t)$C_4H_9$ | (t)$C_4H_9$ | $CH_3$ | $CH_3$ | (n)$C_4H_9$ |
| 16 | (t)$C_4H_9$ | (t)$C_4H_9$ | $CH_3$ | $CH_3$ | (n)$C_7H_{15}$ |
| 17 | (t)$C_4H_9$ | (t)$C_4H_9$ | $CH_3$ | $CH_3$ | (n)$C_{11}H_{23}$ |
| 18 | (t)$C_4H_9$ | (t)$C_4H_9$ | $CH_3$ | $CH_3$ | (i)$C_3H_7$ |
| 19 | (t)$C_4H_9$ | (t)$C_4H_9$ | $CH_3$ | $CH_3$ | $CH(C_2H_5)C_4H_9$ |
| 20 | (t)$C_4H_9$ | (t)$C_4H_9$ | $CH_3$ | $CH_3$ | $CH_2CH(CH_3)_2$ |
| 21 | (t)$C_4H_9$ | (t)$C_4H_9$ | $CH_3$ | $CH_3$ | $CH_2CH(CH_3)CH_2C(CH_3)_3$ |
| 22 | (t)$C_4H_9$ | (t)$C_4H_9$ | $CH_3$ | $CH_3$ | $CH_2OCH_3$ |
| 23 | (t)$C_4H_9$ | (t)$C_4H_9$ | $CH_3$ | $CH_3$ | $CH_2CH_2OCH_3$ |
| 24 | (t)$C_4H_9$ | (t)$C_4H_9$ | $CH_3$ | $CH_3$ | $CH_2CH_2OC_4H_9$ |
| 25 | (t)$C_4H_9$ | (t)$C_4H_9$ | $CH_3$ | $CH_3$ | $CH_2CH_2SC_{12}H_{25}$ |
| 26 | (t)$C_4H_9$ | (t)$C_4H_9$ | $C_2H_5$ | $C_2H_5$ | H |
| 27 | (t)$C_4H_9$ | (t)$C_4H_9$ | $C_2H_5$ | $C_2H_5$ | $CH_3$ |
| 28 | (t)$C_4H_9$ | (t)$C_4H_9$ | $C_2H_5$ | $C_2H_5$ | (n)$C_3H_7$ |

-continued

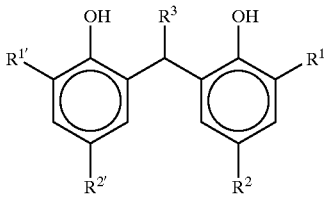

| | $R^1$ | $R^{1'}$ | $R^2$ | $R^{2'}$ | $R^3$ |
|---|---|---|---|---|---|
| 29 | (t)$C_4H_9$ | (t)$C_4H_9$ | $C_2H_5$ | $C_2H_5$ | (i)$C_3H_7$ |
| 30 | (t)$C_4H_9$ | (t)$C_4H_9$ | $C_2H_5$ | $C_2H_5$ | $CH_2CH_2OCH_3$ |
| 31 | (t)$C_4H_9$ | (t)$C_4H_9$ | (n)$C_3H_7$ | (n)$C_3H_7$ | H |
| 32 | (t)$C_4H_9$ | (t)$C_4H_9$ | (n)$C_3H_7$ | (n)$C_3H_7$ | $CH_3$ |
| 33 | (t)$C_4H_9$ | (t)$C_4H_9$ | (n)$C_3H_7$ | (n)$C_3H_7$ | (n)$C_3H_7$ |
| 34 | (t)$C_4H_9$ | (t)$C_4H_9$ | (n)$C_4H_9$ | (n)$C_4H_9$ | H |
| 35 | (t)$C_4H_9$ | (t)$C_4H_9$ | (n)$C_4H_9$ | (n)$C_4H_9$ | $CH_3$ |
| 36 | (t)$C_5H_{11}$ | (t)$C_5H_{11}$ | $CH_3$ | $CH_3$ | H |
| 37 | (t)$C_5H_{11}$ | (t)$C_5H_{11}$ | $CH_3$ | $CH_3$ | $CH_3$ |
| 38 | (t)$C_5H_{11}$ | (t)$C_5H_{11}$ | $C_2H_5$ | $C_2H_5$ | H |
| 39 | (t)$C_5H_{11}$ | (t)$C_5H_{11}$ | $C_2H_5$ | $C_2H_5$ | $CH_3$ |
| 40 | (i)$C_3H_7$ | (i)$C_3H_7$ | $CH_3$ | $CH_3$ | H |
| 41 | (i)$C_3H_7$ | (i)$C_3H_7$ | $CH_3$ | $CH_3$ | (n)$C_3H_7$ |
| 42 | (i)$C_3H_7$ | (i)$C_3H_7$ | $C_2H_5$ | $C_2H_5$ | H |
| 43 | (i)$C_3H_7$ | (i)$C_3H_7$ | $C_2H_5$ | $C_2H_5$ | (n)$C_3H_7$ |
| 44 | (i)$C_3H_7$ | (i)$C_3H_7$ | (i)$C_3H_7$ | (i)$C_3H_7$ | H |
| 45 | (i)$C_3H_7$ | (i)$C_3H_7$ | (i)$C_3H_7$ | (i)$C_3H_7$ | $CH_3$ |
| 46 | (t)$C_4H_9$ | $CH_3$ | $CH_3$ | $CH_3$ | H |
| 47 | (t)$C_4H_9$ | $CH_3$ | $CH_3$ | $CH_3$ | $CH_3$ |
| 48 | (t)$C_4H_9$ | $CH_3$ | $CH_3$ | $CH_3$ | (n)$C_3H_7$ |
| 49 | (t)$C_4H_9$ | $CH_3$ | (t)$C_4H_9$ | $CH_3$ | $CH_3$ |
| 50 | (i)$C_3H_7$ | $CH_3$ | $CH_3$ | $CH_3$ | $CH_3$ |

51

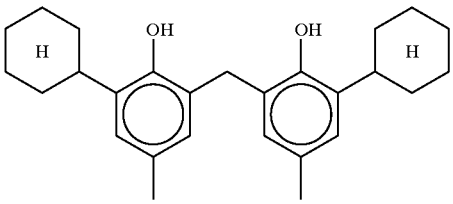

52

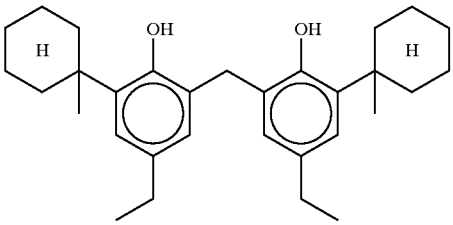

53

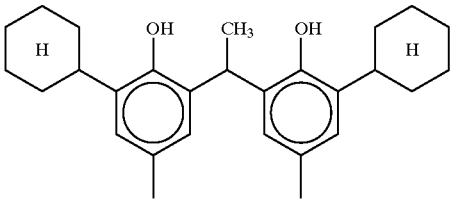

54

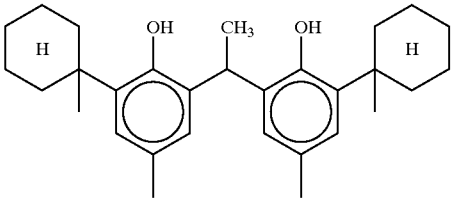

55

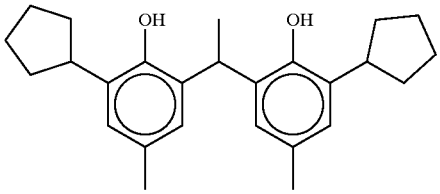

56

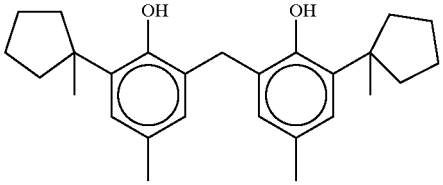

57

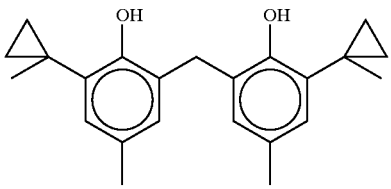

58

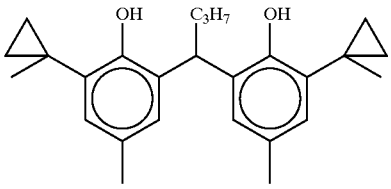

-continued
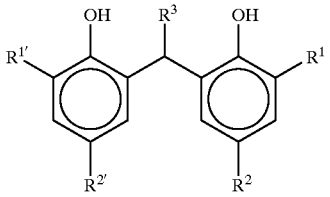
| $R^1$ | $R^{1'}$ | $R^2$ | $R^{2'}$ | $R^3$ |
|---|---|---|---|---|
59
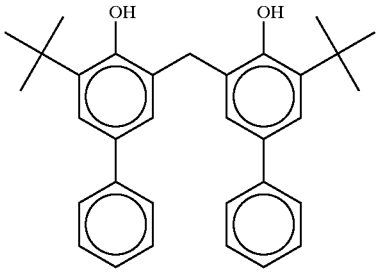
60
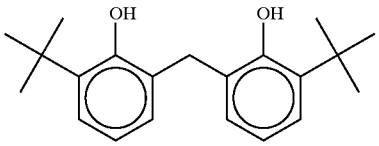
61
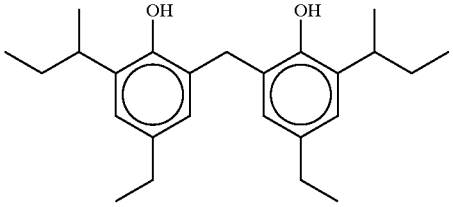
62
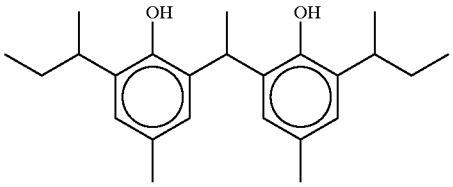
63
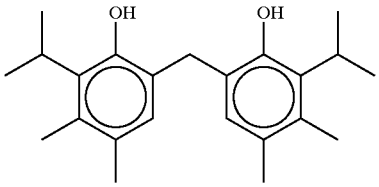
64
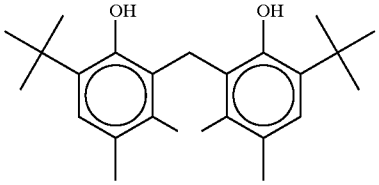
65
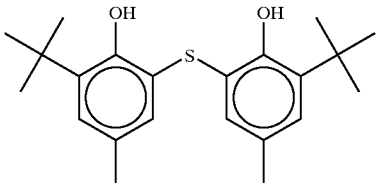
66
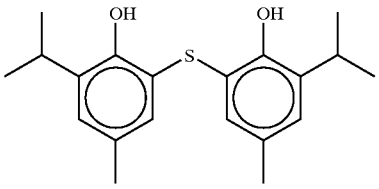
67
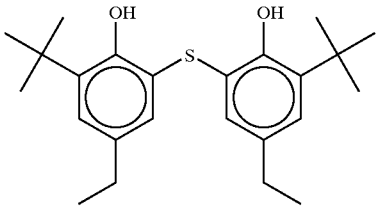
68
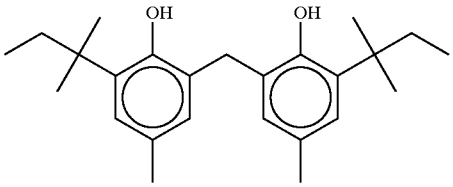
69
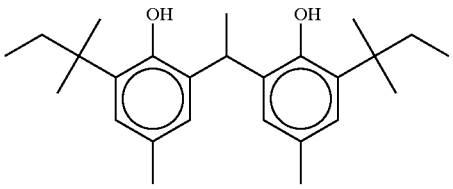
70
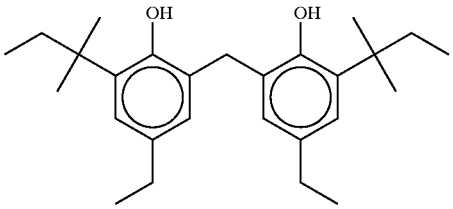

-continued

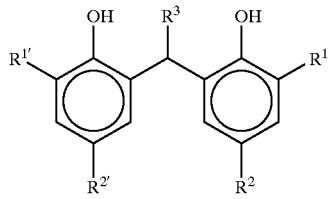

| | R1 | R1' | R2 | R2' | R3 |
|---|---|---|---|---|---|
| 71 | 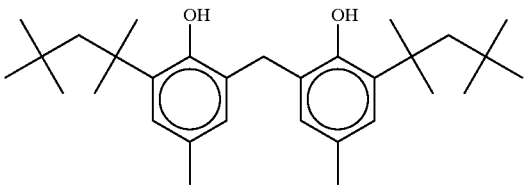 | | | | |
| 72 | 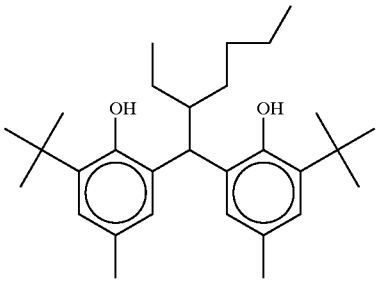 | | | | |
| 73 | 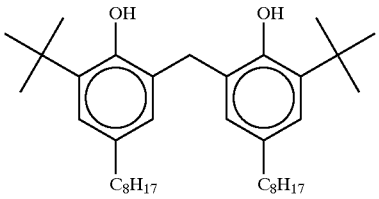 | | | | |
| 74 | 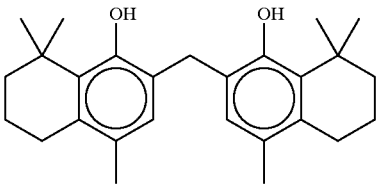 | | | | |
| 75 | 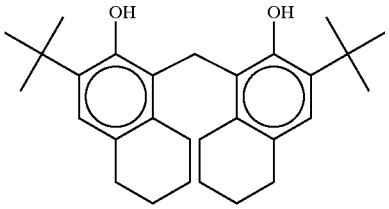 | | | | |
| 76 | 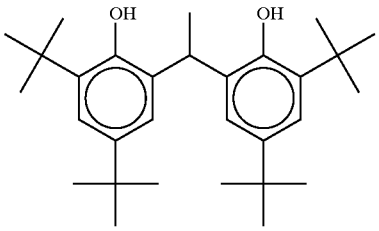 | | | | |

The addition amount of the reducing agent in the present invention is preferably from 0.01 to 5.0 g/m$^2$, more preferably from 0.1 to 3.0 g/m$^2$, and it is preferred to contain a reducing agent in an amount of preferably from 5 to 50 mol % per mol of the silver contained on the side of a support on which an image-recording layer is provided, more preferably from 10 to 40 mol %. A reducing agent can be contained in any layer on the side of a support on which an image-recording layer is provided, but it is preferred to be contained in an image-recording layer.

A reducing agent may be contained in a coating solution in the form of, e.g., a solution, an emulsified dispersion, or a solid fine particle dispersion, and added to a photosensitive material.

As a well-known emulsifying dispersing method, a method of dissolving a reducing agent with oils, e.g., dibutyl phthalate, tricresyl phosphate, glyceryl triacetate or diethyl phthalate, and auxiliary solvents, e.g., ethyl acetate or cyclohexanone, and mechanically producing an emulsified dispersion can be exemplified.

The solid fine particle dispersion can be produced by a method of dispersing the powder of a reducing agent in an appropriate solvent, e.g., water, by means of a ball mill, a colloid mill, a vibrating ball mill, a sand mill, a jet mill, a roller mill or ultrasonic wave. At that time, a protective colloid (e.g., polyvinyl alcohol) and a surfactant (e.g., an anionic surfactant such as sodium triisopropylnaphthalenesulfonate (a mixture of three isopropyl groups having different substitution positions)) may be used. A water dispersion can contain an antiseptic (e.g., benzoisothiazolinone sodium salt).

A phenol derivative represented by formula (A) disclosed in Japanese Patent Application No. 11-73951 can be preferably used in the heat-developable photosensitive material of the present invention as a development accelerator.

When the reducing agent according to the present invention has an aromatic hydroxyl group (—OH), in particular in the above bisphenols, it is preferred to use a non-reducible compound having a group capable of forming hydrogen bond with the hydroxyl group in combination.

The examples of the groups capable of forming hydrogen bond with a hydroxyl group or an amino group include a phosphoryl group, a sulfoxide group, a sulfonyl group, a carbonyl group, an amido group, an ester group, a urethane group, a ureido group, a tertiary amino group and a nitrogen-containing aromatic group.

Above all, a compound having a phosphoryl group, a sulfoxide group, an amido group (with the proviso that the amido group does not have an N—H group and is blocked such as N—R (R is a substituent other than H)), a urethane group (with the proviso that the urethane group does not have an N—H group and is blocked such as N—R (R is a substituent other than H)), or a ureido group (with the proviso that the ureido group does not have an N—H group and is blocked such as N—R (R is a substituent other than H)) is preferred.

As a hydrogen-bonding compound, a compound represented by the following formula (IIa) can be preferably used in the present invention.

(IIa)

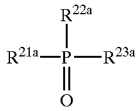

wherein $R^{21a}$, $R^{22a}$ and $R^{23a}$ each represents an alkyl group, an aryl group, an alkoxyl group, an aryloxy group, an amino group, or a heterocyclic group, and these groups may be substituted or unsubstituted. Arbitrary two of $R^{21a}$, $R^{22a}$ and $R^{23a}$ may be bonded to each other to form a ring.

When $R^{21a}$, $R^{22a}$ and $R^{23a}$ each has a substituent, the examples of the substituents include a halogen atom, an alkyl group, an aryl group, an alkoxyl group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, and a phosphoryl group, and preferably an alkyl group and an aryl group (e.g., methyl, ethyl, isopropyl, tert-butyl, tert-octyl, phenyl, 4-alkoxyphenyl, 4-acyloxyphenyl).

As the specific examples of the groups represented by $R^{21a}$, $R^{22a}$ and $R^{23a}$, a substituted or unsubstituted alkyl group, e.g., methyl, ethyl, butyl, octyl, dodecyl, isopropyl, tert-butyl, tert-amyl, tert-octyl, cyclohexyl, 1-methylcyclohexyl, benzyl, phenethyl, and 2-phenoxypropyl; a substitutedorunsubstitutedaryl group, e.g., phenyl, cresyl, xylyl, naphthyl, 4-tert-butylphenyl, 4-tert-octylphenyl, 4-anisidyl, and 3,5-dichlorophenyl; a substituted or unsubstituted alkoxyl group, e.g., methoxy, ethoxy, butoxy, octyloxy, 2-ethylhexyloxy, 3,5,5-trimethylhexyloxy, dodecyloxy, cyclohexyloxy, 4-methylcyclohexyloxy, and benzyloxy; a substituted or unsubstituted aryloxy group, e.g., phenoxy, cresyloxy, isopropylphenoxy, 4-tert-butylphenoxy, naphthoxy, and biphenyloxy; a substituted or unsubstituted amino group, e.g., amino, dimethylamino, diethylamino, dibutylamino, dioctylamino, N-methyl-N-hexylamino, dicyclohexylamino, diphenylamino, and N-methyl-N-phenylamino; and a heterocyclic group, e.g., 2-pyridyl, 4-pyridyl, 2-furanyl, 4-piperidinyl, 8-quinolyl and 5-quinolyl can be exemplified.

$R^{21a}$, $R^{22a}$ and $R^{23a}$ each preferably represents an alkyl group, an aryl group, an alkoxyl group or an aryloxy group. From the point of the effect of the present invention, it is preferred that one or more of $R^{21a}$, $R^{22a}$ and $R^{23a}$ represent an alkyl group or an aryl group, and it is more preferred that two or more of them represent an alkyl group or an aryl group. Further, from the point of inexpensive availability, it is preferred that $R^{21a}$, $R^{22a}$ and $R^{23a}$ represent the same group.

The specific examples of hydrogen-bonding compounds represented by formula (IIa) are shown below, but the compounds which can be used in the present invention are not limited thereto.

(II-1)

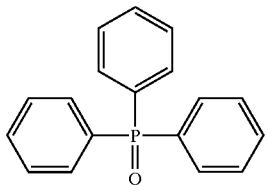

(II-2)

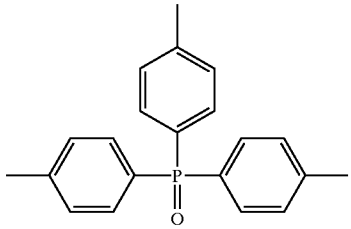

(II-3)

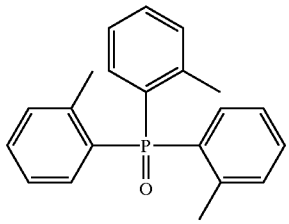

(II-4)

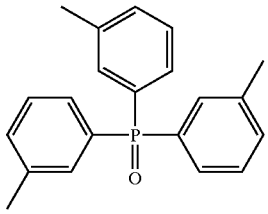

(II-5)

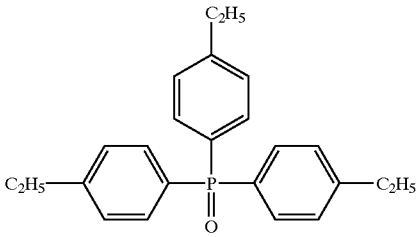

(II-6)

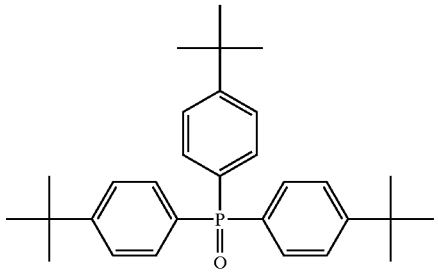

(II-7)

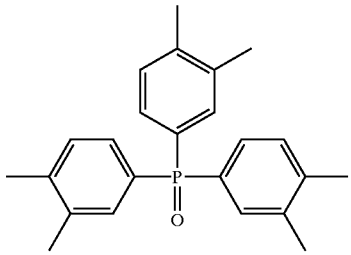

-continued
(II-8)
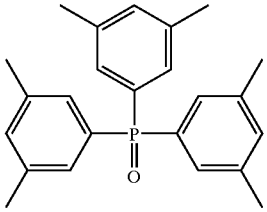
(II-9)
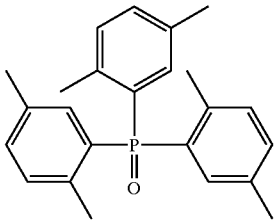
(II-10)
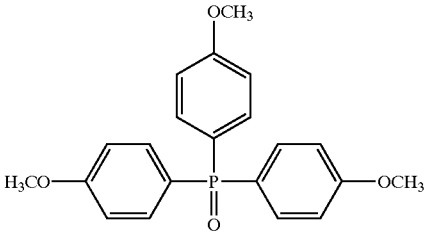
(II-11)
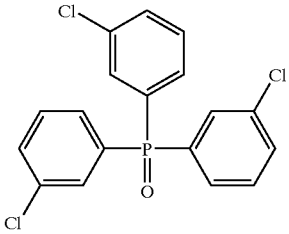
(II-12)
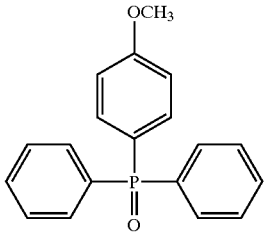
(II-13)
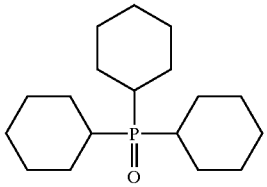
(II-14)
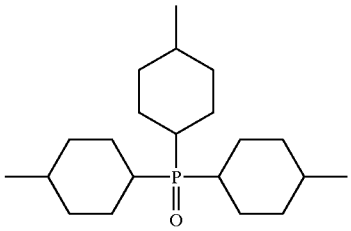
-continued
(II-15)
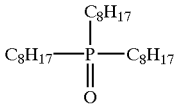
(II-16)
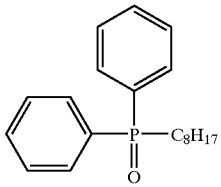
(II-17)
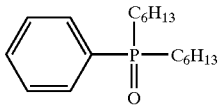
(II-18)
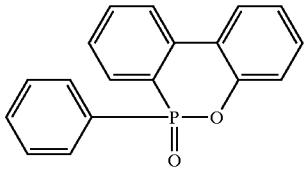
(II-19)
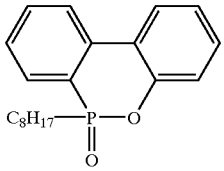
(II-20)
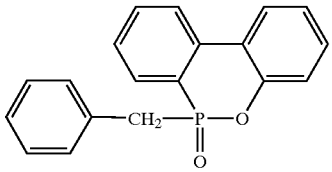
(II-21)
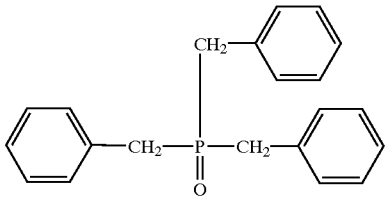
(II-22)
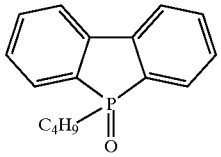
(II-23)
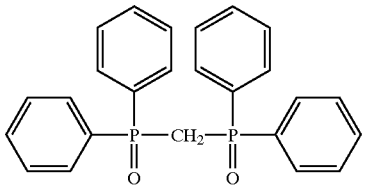

-continued
(II-24)
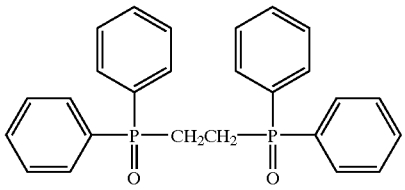
(II-25)
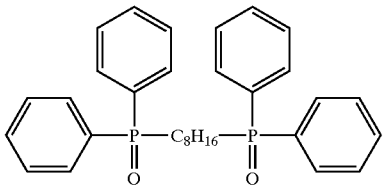
(II-26)
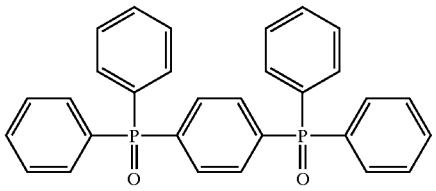
(II-27)
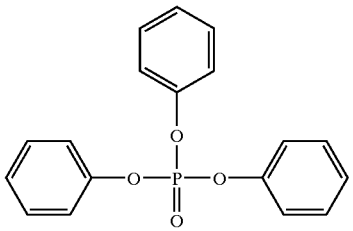
(II-28)
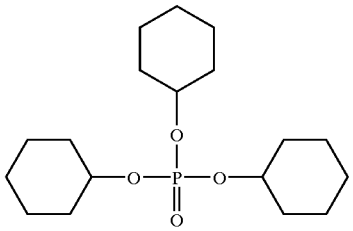
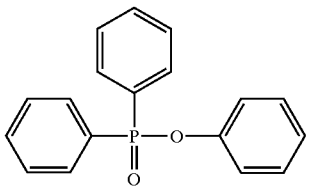
(II-30)
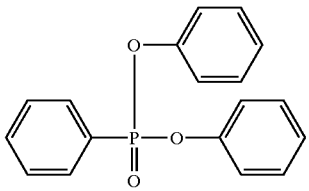
(II-31)
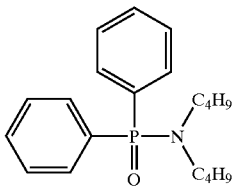
-continued
(II-32)
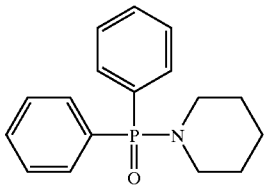
(II-33)
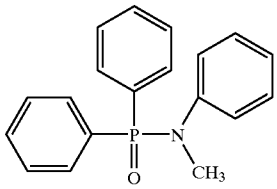
(II-34)
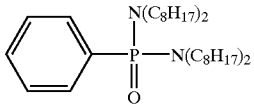
(II-35)
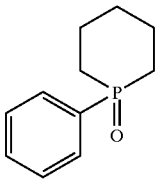
(II-36)
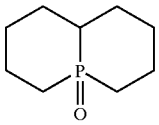
(II-37)
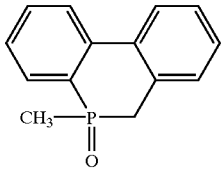
(II-38)
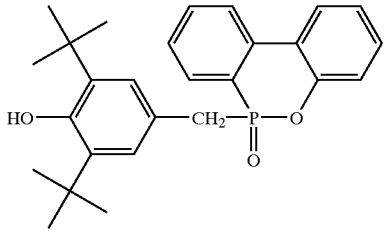
(II-39)
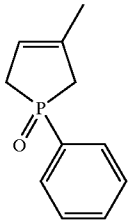

-continued (II-40)

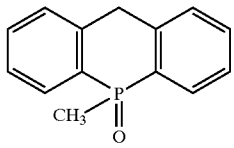

Similarly to reducing agents, the compound represented by formula (IIa) is contained in a coating solution in the form of, e.g., a solution, an emulsified dispersion, or a solid fine particle dispersion, and added to a heat-developable photosensitive material. Since the compound represented by formula (IIa) in the state of a solution is forming hydrogen-bonding complex with a compound having a phenolic hydroxyl group or an amino group, it can be isolated as a complex in a crystal state by certain combination with a reducing agent. It is particularly preferred to use such an isolated crystal powder of a complex as a solid fine particle dispersion for obtaining stable performance.

A method of mixing a reducing agent and the compound represented by formula (IIa) as powders and forming a complex by dispersion in a sand grinder mill with a proper dispersant can also be preferably used in the present invention.

The compound represented by formula (IIa) is used in an amount of preferably from 1 to 200 mol %, more preferably from 10 to 150 mol %, and still more preferably from 30 to 100 mol %, based on the reducing agent.

The halogen composition of the photosensitive silver halide for use in the present invention is not particularly restricted. Silver chloride, silver chlorobromide, silver bromide, silver iodobromide, and silver iodochlorobromide can be used in the present invention. The distribution of the halogen composition in a grain may be uniform, the halogen composition may be varied stepwise or may be continuously varied. Silver halide grains having a core/shell structure can be preferably used.

The grain structures are preferably from a double structure to a quintuple structure, and the core/shell grains having a double structure to a quadruple structure can be more preferably used. The technique of localizing silver bromide on the surface of silver chloride or silver chlorobromide grains can also preferably be used.

Photosensitive silver halides are well-known in the industry and can be produced using the methods disclosed, e.g., in *Research Disclosure*, No. 17029 (June, 1978) and U.S. Pat. No. 3,700,458 can be used. Specifically, a photosensitive silver halide is produced by adding a silver-supplying compound and a halogen-supplying compound to gelatin or other polymer solution, then mixing the solution with an organic silver salt. Further, the methods disclosed in JP-A-11-119374, paragraphs [0217] to [0224], and Japanese Patent Application Nos. 11-98708 and 11-84182 are also preferred.

The grain size of the photosensitive silver halide is preferably small for the purpose of suppressing the white turbidity after image formation to low degree, specifically preferably 0.20 $\mu$m or less, more preferably from 0.005 to 0.15 $\mu$m, still more preferably from 0.01 to 0.12 $\mu$m, especially preferably from 0.01 to 0.05 $\mu$m, and most preferably from 0.02 to 0.05 $\mu$m.

The grain size in the present invention means the diameter of a circle having the same area as the projected area of a silver halide grain (when the grain is a tabular grain, the projected area of the main plane of the grain).

The average equivalent-circle diameter of the photosensitive silver halide for use in the present invention is preferably from 10 to 50 nm, in particular from the viewpoint of storage stability.

Silver halide grains may have a crystal form such as a cubic, octahedral, tabular, spherical, cylindrical, or pebble-like form. Cubic grains are particularly preferably used in the present invention. Silver halide grain having rounded corners can also be preferably used in the present invention.

An index of a plane (Miller indices) of the outer surface of photosensitive silver halide grains is not particularly limited, but it is preferred that the proportion occupied by {100} planes which have high ratio of spectral sensitizing efficiency when spectral sensitizing dyes are adsorbed is high. The proportion is preferably 50% or more, more preferably 65% or more, and still more preferably 80% or more. The ratio of Miller indices of {100} plane can be obtained by the method described in T. Tani, *J. Imaging Sci.*, 29, 165 (1985), which makes use of adsorption dependence of {111} plane and {100} plane in adsorption of sensitizing dyes.

Silver halide grains having localize hexacyano metal complexes on the outermost surface of the grains are preferably used in the present invention. As the hexacyano metal complexes, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$ can be exemplified. Hexacyano Fe complexes are preferably used in the present invention.

Since a hexacyano metal complex is present in an aqueous solution in the form of an ion, a counter cation is not important, but it is preferred to use, as the counter cation, those which are easily miscible with water and applicable to precipitation processing of a silver halide emulsion, such as an alkali metal ion (e.g., a sodium ion, a potassium ion, a rubidium ion, a cesium ion, and a lithium ion), an ammonium ion, and an alkylammonium ion (e.g., a tetramethylammonium ion, a tetraethylammonium ion, a tetrapropylammonium ion and a tetra(n-butyl)ammonium ion).

Hexacyano metal complexes can be added to silver halide grains as mixture with water, with a mixed solvent of appropriate solvents miscible with water (e.g., alcohols, ethers, glycols, ketones, esters or amides), and with gelatin.

The addition amount of hexacyano metal complexes is preferably from $1\times10^{-5}$ to $1\times10^{-2}$ mol, more preferably from $1\times10^{-4}$ to $1\times10^{-3}$ mol, per mol of the silver.

For localizing hexacyano metal complexes on the outermost surface of a silver halide grain, they are directly added after the addition of a silver nitrate aqueous solution used for grain formation is finished and before charging process of chemical sensitization, e.g., chalcogen sensitization of sulfur sensitization, selenium sensitization and tellurium sensitization, and noble metal sensitization, e.g., gold sensitization, etc., during washing process, during dispersing process, or before chemical sensitization process. Hexacyano metal complexes are preferably added rapidly after grain formation so as not to grow silver halide fine grains and the addition is preferably performed before charging process is completed.

The addition of hexacyano metal complexes may be started after 96 mass % of the total amount of a silver nitrate which is added for improving grain forming property has been added, more preferably after 98 mass % has been added, and particularly preferably after 99 mass % has been added.

When hexacyano metal complexes are added just before completion of the grain formation and after the addition of a silver nitrate aqueous solution, they cannot be adsorbed onto the outermost surfaces of the silver halide grains, and almost all of the hexacyano metal complexes form a hardly soluble salt with the silver ions on the grain surfaces. Since the silver salt of hexacyanoferrate(II) is a more hardly soluble salt than AgI, re-dissolution by fine grains can be prevented, thus the production of silver halide grains having smaller grain sizes can be realized.

The photosensitive silver halide grains for use in the present invention can contain metals or metal complexes belonging to group VIII to group X of the Periodic Table (group I to group XVIII are shown). The preferred central metals of metals or metal complexes belonging to group VIII to group X of the Periodic Table are rhodium, ruthenium and iridium. These metal complexes may be used alone, or two or more of the complexes of the same or different metals can be used in combination. The content of these metals or metal complexes is preferably from $1\times10^{-9}$ to $1\times10^{-3}$ mol per mol of the silver.

These heavy metals, metal complexes and the addition methods of them are disclosed in JP-A-7-225449, JP-A-11-65021, paragraphs from [0018] to [0024], and JP-A-11-119374, paragraphs from [0227] to [0240].

Further, metal atoms which can be contained in the silver halide grains for use in the present invention (e.g., $[Fe(CN)_6]^{4-}$), desalting methods and chemical sensitization methods of silver halide emulsions are disclosed in JP-A-11-84574, paragraphs [0046] to [0050], JP-A-11-65021, paragraphs [0025] to [0031], and JP-A-11-119374, paragraphs [0242] to [0250].

Various gelatins can be used in the photosensitive silver halide emulsions for use in the present invention. It is preferred to use low molecular weight gelatins having a molecular weight of from 500 to 60,000 for maintaining a good dispersion state of the photosensitive silver halide emulsions in an organic silver salt-containing coating solution. These low molecular weight gelatins may be used during grain formation or during the dispersion stage after desalting processing, preferably during the dispersion stage after desalting processing.

The using methods of the sensitizing dyes which can be used in combination with the sensitizing dyes represented by formulae (A) and (I) are further described below in addition to the above description.

The sensitizing dyes which can be used in combination in the present invention are those capable of spectrally sensitizing silver halide grains in a desired wavelength region when adsorbed onto the silver halide grains, and sensitizing dyes which have spectral sensitivities suitable for the spectral characteristics of exposure light sources can be advantageously selected.

With respect to the sensitizing dyes and the addition methods, JP-A-11-65021, paragraphs [0103] to [0109], the compound represented by formula (II) disclosed in JP-A-10-186572, the dye represented by formula (I) and paragraph [0106] in JP-A-11-119374, U.S. Pat. No. 5,510,236, the dye disclosed in Example 5 of U.S. Pat. No. 3,871,887, JP-A-2-96131, the dyes disclosed in JP-A-59-48753, EP-A-0803764, from line 38, page 19 to line 35, page 20, and Japanese Patent Application Nos. 2000-86865 and 2000-102560 can be referred to.

These sensitizing dyes may be used alone or two or more may be used in combination. The time of addition of sensitizing dyes to silver halide emulsions in the present invention is preferably after desalting step and before coating, more preferably after desalting step and before the initiation of chemical ripening.

The addition amount of the sensitizing dyes to be used in combination in the present invention can be selected according to performances such as sensitivity and fog, and is preferably from $10^{-6}$ to 1 mol, more preferably from $10^{-4}$ to $10^{-1}$ mol, per mol of the silver halide in a photosensitive layer.

Supersensitizers can be used in the present invention to improve spectral sensitization effect. The compounds disclosed in EP 587338, U.S. Pat. Nos. 3,877,943, 4,873,184, JP-A-5-341432, JP-A-11-109547 and JP-A-10-111543 can be exemplified as supersensitizers for use in the present invention.

The photosensitive silver halide grains according to the present invention are preferably chemically sensitized by sulfur sensitization, selenium sensitization or tellurium sensitization. Well known compounds, e.g., the compounds disclosed in JP-A-7-128768, can be used in sulfur sensitization, selenium sensitization or tellurium sensitization.

Tellurium sensitization is particularly preferably used in the present invention, and the compounds disclosed in paragraph [0030] of JP-A-11-65021, and the compounds represented by formulae (II), (III) and (IV) disclosed in JP-A-5-313284 are more preferably used.

Chemical sensitization may be performed any time after grain formation and before coating. For example, chemical sensitization may be performed (1) after desalting, (2) before spectral sensitization, (3) at the same time with spectral sensitization, (4) after spectral sensitization, or (5) just before coating. It is particularly preferred to perform chemical sensitization (4) after spectral sensitization.

The amount of the sulfur, selenium and tellurium sensitizers to be used in the present invention varies according to the silver halide grains used and the conditions of chemical ripening, but the amount is generally about $10^{-8}$ to $10^{-2}$ mol, preferably about $10^{-7}$ to $10^{-3}$ mol, per mol of the silver halide.

There is no particular limitation on the conditions of chemical sensitization in the present invention, but pH is from 5 to 8, pAg is from 6 to 11, and temperature is from 40 to 95° C.

Thiosulfonic acid compounds may be added to the silver halide emulsion of the present invention according to the method disclosed in European Patent 293917.

The photosensitive silver halide emulsion for use in the heat-developable photosensitive material of the present invention may be one kind, or two or more kinds of photosensitive silver halide emulsions (for example, those differing in average grain sizes, differing in halogen compositions, differing in crystal habits, or differing in the conditions of chemical sensitization) may be used in combination. Gradation can be controlled by using a plurality of photosensitive silver halides having different sensitivities.

Techniques with respect to these are disclosed in JP-A-57-119341, JP-A-53-106125, JP-A-47-3929, JP-A-48-55730, JP-A-46-5187, JP-A-50-73627, and JP-A-57-150841. It is preferred for each emulsion to have sensitivity difference of 0.2 logE or more.

The photosensitive silver halide according to the present invention is preferably used in an amount of from 0.03 to 0.6 $g/m^2$, more preferably from 0.05 to 0.4 $g/m^2$, and most preferably from 0.1 to 0.4 $g/m^2$, in a coating silver amount per $m^2$ of the heat-developable photosensitive material, and the use amount of the photosensitive silver halide per mol of the organic silver salt is preferably from 0.01 to 0.5 mol, more preferably from 0.02 to 0.3 mol.

Photosensitive silver halide grains and an organic silver salt prepared separately may be mixed using a high speed stirrer, a ball mill, a sand mill, a colloid mill, a vibrating mill or a homogenizer, alternatively a photosensitive silver halide having been prepared may be mixed with an organic silver salt at any time during preparation of the organic silver salt to complete the preparation of the organic silver salt. There is no restriction as to the methods so long as the effect of the present invention can be sufficiently exhibited.

It is preferred to mix two or more organic silver salt water dispersion solutions and two or more photosensitive silver salt water dispersion solutions for controlling photographic characteristics.

The preferred addition time of a silver halide to the coating solution of an image-forming layer in the present invention is from 180 minutes before coating to just before coating, preferably from 60 minutes to 10 seconds before coating. However, mixing methods and mixing conditions are not particularly restricted as long as the effect of the present invention can be sufficiently exhibited.

As the specific mixing method, a method of mixing a silver halide and a coating solution in a tank so that the average residence time, which is computed from the addition flow rate and the charging amount to the coater, coincides with the desired time, and a method of using a static mixer as described in N. Harnby, M. F. Edwards, A. W. Nienow, translated by Koji Takahashi, *Liquid Mixing Techniques*, Chap. 8, published by Nikkan Kogyo Shinbunsha (1989) can be used.

The binders for use in an organic silver salt-containing layer (image-forming layer) of the present invention are not restricted and any binder can be used, and the preferred binders are transparent or translucent and colorless in general. The examples of the suitable binders include natural resins, polymers and copolymers of them, synthetic resins, polymers and copolymers of them, besides the above, media which can form a film, e.g., gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylic acids), poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) and poly(vinyl butyral)), poly(esters), poly(urethanes), phenoxy resins, poly (vinylidene chlorides), poly(epoxides), poly(carbonates), poly(vinyl acetates), poly(olefins), cellulose esters, and poly (amides). Binders may be formed from water, an organic solvent or an emulsion by coating.

A case where an organic silver salt-containing layer is formed by coating and drying a coating solution in which water accounts for 30 mass % or more of the solvent, and further, the binder of an organic silver salt-containing layer is soluble or dispersible in a water base solvent (water solvent) and, in particular, a case where the binder comprises a polymer latex having an equilibrium moisture content at 25° C. 60% RH of 2 mass % or less are preferred in the present invention. The most preferred polymer of the present invention is a polymer so prepared that ionic conductivity becomes 2.5 mS/cm or less. Such a polymer can be produced by a method of purification processing the polymer synthesized using a separating function film.

A water base solvent in which the above polymer is soluble or dispersible as used herein is water or water mixed with a water-miscible organic solvent in concentration of 70 mass % or less.

As the water-miscible organic solvent, alcohols such as methyl alcohol, ethyl alcohol, and propyl alcohol, Cellosolves such as methyl Cellosolve, ethyl Cellosolve, and butyl Cellosolve, ethyl acetate and dimethylformamide can be exemplified.

The system of a so-called dispersing state in which a polymer is not dissolved thermodynamically is also called a water base solvent in the present invention.

"An equilibrium moisture content at 25° C. 60% RH" used in the present invention can be represented as follows with the mass of the polymer in humidity conditioning equilibrium at 25° C. 60% RH being $W^1$ and the mass of the polymer in an absolute dry condition at 25° C. being $W^0$:

An equilibrium moisture content at 25° C. 60% RH= $[(W^1-W^0)/W^0]\times 100$ (mass %)

With respect to the definition and the measuring method of a moisture content, e.g., *Kobunshi Kogaku Koza* 14 (*High Polymer Engineering, Lecture* 14), "Kobunshi Zairyo Shiken-Ho (Test Method of High Polymer Materials)", compiled by Kobunshi-Gakkai, published by Chijin Shokan Co. Ltd. can be referred to.

The equilibrium moisture content at 25° C. 60% RH of the binder polymer according to the present invention is preferably 2 mass % or less, more preferably from 0.01 to 1.5 mass %, and still more preferably from 0.02 to 1 mass %.

Polymers which are dispersible in a water base solvent are particularly preferably used in the present invention. As the examples of dispersion states, there are latexes in which fine particles of water-insoluble hydrophobic polymers are dispersed, and dispersions in which polymer molecules are dispersed in a molecular state or with forming micells, and any of these can be preferably used. The average particle size of dispersed particles is preferably from 1 to 50,000 nm, more preferably from 5 to 1,000 nm or so. The particle size distribution of dispersed particles is not especially restricted, and either polymers having broad particle size distribution or narrow particle size distribution may be used.

As the preferred polymers dispersible in a water base solvent, hydrophobic polymers such as acrylic polymers, poly(esters), rubbers (e.g., SBR resins), poly(urethanes), poly(vinyl chlorides), poly(vinyl acetates), poly(vinylidene chlorides) and poly(olefins) can be preferably used in the present invention. These polymers may be straight chain, branched or crosslinked polymers. These polymers may be homopolymers obtained by homopolymerization of single monomers and copolymers obtained by copolymerization of two or more monomers. The copolymers may be random copolymers or block copolymers.

The molecular weight of these polymers is from 5,000 to 1,000,000, preferably from 10,000 to 200,000, in number average molecular weight. When the molecular weight is too small, the mechanical strength of the emulsion layer is insufficient, while when it is too large, the film property results in deterioration.

The specific examples of preferred polymer latexes are shown below. In the following, polymers are indicated as starting material monomers, and the numerical values in the parentheses are mass % and the molecular weights are number average molecular weights.

P-1: Latex comprising MMA (70)-EA (27)-MAA (3) (molecular weight: 37,000)
P-2: Latex comprising MMA (70)-2EHA (20)-St (5)-AA (5) (molecular weight: 40,000)
P-3: Latex comprising St (50)-Bu (47)-MAA (3) (molecular weight: 45,000)
P-4: Latex comprising St (68)-Bu (29)-AA (3) (molecular weight: 60,000)
P-5: Latex comprising St (71)-Bu (26)-AA (3) (molecular weight: 60,000)
P-6: Latex comprising St (70)-Bu (27)-IA (3) (molecular weight: 120,000)
P-7: Latex comprising St (75)-Bu (24)-AA (1) (molecular weight: 108,000)

-continued

| | |
|---|---|
| P-8: | Latex comprising St (60)-Bu (35)-DVB (3)-MAA (2) (molecular weight: 150,000) |
| P-9: | Latex comprising St (70)-Bu (25)-DVB (2)-AA (3) (molecular weight: 280,000) |
| P-10: | Latex comprising VC (50)-MMA (20)-EA (20)-AN (5)-AA (5) (molecular weight: 80,000) |
| P-11: | Latex comprising VDC (85)-MMA (5)-EA (5)-MAA (5) (molecular weight: 67,000) |
| P-12: | Latex comprising Et (90)-MAA (10) (molecular weight: 12,000) |
| P-13: | Latex comprising St (70)-2EHA (27)-AA (3) (molecular weight: 130,000) |
| P-14: | Latex comprising MMA (63)-EA (35)-AA (2) (molecular weight: 33,000) |

Abbreviations of the above structures denote the following monomers. MMA: methyl methacrylate, EA: ethyl acrylate, MAA: methacrylic acid, 2EHA: 2-ethylhexyl acrylate, St: styrene, Bu: butadine, AA: acrylic acid, DVB: divinylbenzene, VC: vinyl chloride, AN: acrylonitrile, VDC: vinylidene chloride, Et: ethylene, and IA: itaconic aced.

The above-described polymer latexes are commercially available and the following polymers can be used.

As examples of acrylic polymers, Sebian A-4635, 46583 and 4601 (manufactured by Daicel Polymer Ltd.), Nipol Lx811, 814, 821, 820 and 857 (manufactured by Nippon Zeon Co., Ltd.); as examples of poly(esters), FINETEX ES650, 611, 675 and 850 (manufactured by Dainippon Chemicals and Ink Co., Ltd.), WD-size and WMS (manufactured by Eastman Chemical Co.); as examples of poly(urethanes), HYDRAN AP10, 20, 30 and 40 (manufactured by Dainippon Chemicals and Ink Co., Ltd.); as examples of rubbers, LACSTAR 731OK, 3307B, 470OH and 7132C (manufactured by Dainippon Chemicals and Ink Co., Ltd.), Nipol Lx416, 410, 438C and 2507 (manufactured by Nippon Zeon Co., Ltd.); as examples of poly (vinyl chlorides), G351 and G576 (manufactured by Nippon Zeon Co., Ltd.); as examples of poly(vinylidene chlorides), L502 and L513 (manufactured by Asahi Chemical Industry Co., Ltd.); and as examples of poly(olefins), Chemipearl S120 and SA100 (manufactured by Mitsui Petrochemical Industries, Ltd.) can be exemplified.

These polymers latexes may be used alone or two or more of them may be blended, if necessary.

Styrene/butadiene copolymer latexes are particularly preferably used in the present invention. The mass ratio of the styrene monomer unit and the butadiene monomer unit in styrene/butadiene copolymers is preferably from 40/60 to 95/5. The ratio occupied by the styrene monomer unit and the butadiene monomer unit in the copolymers is preferably from 60 to 99 mass %. The preferred molecular weight is the same as described above.

The preferred styrene/butadiene copolymer latexes which can be used in the present invention are the foregoing P-3 to P-8 and commercially available products LACSTAR-3307B, 7132C, and Nipol Lx416.

The latexes for use in the present invention have a glass transition temperature (Tg) of preferably from 10° C. to 80° C., more preferably from 20° C. to 60° C. When two or more latexes having different Tg's are used as mixture, it is preferred that the mass average Tg is in the above range.

Hydrophilic polymers such as gelatin, polyvinyl alcohol, methyl cellulose, hydroxypropyl cellulose and carboxymethyl cellulose may be added to the organic silver salt-containing layer of the heat-developable photosensitive material of the present invention, if necessity. The addition amount of these hydrophilic polymers is preferably 30 mass % or less, more preferably 20 mass % or less, based on the total amount of the binder of the organic silver salt-containing layer.

The organic silver salt-containing layer (i.e., an image-forming layer) according to the present invention is formed of polymer latexes. The mass ratio of the total binder/organic silver salt in the organic silver salt-containing layer is preferably from 1/10 to 10/1, more preferably from 1/5 to 4/1.

Such an organic silver salt-containing layer is, in general, also a photosensitive layer (an emulsion layer) containing a photosensitive silver halide. In this case, the mass ratio of the total binder/silver halide is preferably from 400 to 5, more preferably from 200 to 10.

The total amount of the binder in the organic silver salt-containing layer (image-forming layer) of the present invention is preferably from 0.2 to 30 g/m$^2$, more preferably from 1 to 15 g/m$^2$. The image-forming layer of the present invention may contain a crosslinking agent for crosslinking and a surfactant for improving coating property.

The solvent for the coating solution of the organic silver salt-containing layer of the present invention (a solvent and a dispersion medium are briefly expressed solvent collectively) is preferably a water base solvent containing 30 mass % or more of water. As components other than water, water-miscible organic solvents such as methyl alcohol, ethyl alcohol, isopropyl alcohol, methyl Cellosolve, ethyl Cellosolve, dimethylformamide and ethyl acetate may be arbitrarily used in the coating solution. The water content in the solvent of the coating solution is preferably 50 mass % or more, more preferably 70 mass % or more.

The preferred examples of the composition of the solvent include, other than water, water/methyl alcohol=90/10 (the numerical value is mass %), water/methyl alcohol=70/30, water/methylalcohol/dimethylformamide=80/15/5, water/methyl alcohol/ethyl Cellosolve=85/10/5, and water/methyl alcohol/isopropyl alcohol=85/10/5.

The antifoggants, stabilizers and stabilizer precursors which can be used in the present invention are disclosed in JP-A-10-62899, paragraph [0070], and EP-A-0803764, line 57, page 20 to line 7, page 21. Further, the antifoggants which are preferably used in the present invention are organic halogen compounds, and they are disclosed in JP-A-11-65021, paragraphs [0111] and [0112]. In particular, the organic halogen compounds represented by formula (P) disclosed in Japanese Patent Application No. 11-87297 and the organic polyhalogen compounds represented by formula (II) disclosed in JP-A-10-339934 are preferably used.

The organic polyhalogen compound preferably used in the present invention is described below. The polyhalogen compound preferably used in the present invention is a compound represented by the following formula (IIIa):

$$Q^a—(Y^a)n^a—C(Z^{1a})(Z^{2a})X^b \quad \text{(IIIa)}$$

wherein $Q^a$ represents an alkyl group, an aryl group or a heterocyclic group, each of which may have a substituent; $Y^a$ represents a divalent linking group; $n^a$ represents 0 or 1; $Z^{1a}$ and $Z^{2a}$ each represents a halogen atom; and $X^b$ represents a hydrogen atom or an electron attractive group.

The alkyl group represented by $Q^a$ in formula (IIIa) is a straight chain, branched or cyclic alkyl group preferably having from 1 to 20, more preferably from 1 to 12, and particularly preferably from 1 to 6, carbon atoms (e.g., methyl, ethyl, allyl, n-propyl, isopropyl, sec-butyl, isobutyl, tert-butyl, sec-pentyl, isopentyl, tert-pentyl, tert-octyl, 1-methylcyclohexyl). The alkyl group is preferably a tertiary alkyl group.

The alkyl group represented by $Q^a$ may have a substituent, and the substituent may be any group as long as the photographic performances are not affected, e.g., a halogen atom (e.g., fluorine, chlorine, bromine, iodine), analkyl group, analkenyl group, an alkynyl group, an aryl group, a heterocyclic group (including an N-substituted nitrogen-containing heterocyclic group, e.g., morpholino), an alkoxycarbonyl group, an aryloxycarbonyl group, a carbamoyl group, an imino group, an imino group substituted with an N atom, a thiocarbonyl group, a carbazoyl group, a cyano group, a thiocarbamoyl group, an alkoxyl group, an aryloxy group, a heterocyclic oxy group, an acyloxy group, an alkoxycarbonyloxy group, an aryloxycarbonyloxy group, a sulfonyloxy group, an acylamido group, a sulfonamido group, a uredio group, a thioureido group, an imido group, an alkoxycarbonylamino group, an aryloxycarbonylamino group, a sulfamoylamino group, a semicarbazido group, a thiosemicarbazido group, an alkylsulfonylureido group, an arylsulfonylureido group, a nitro group, an alkylsulfonyl group, an arylsulfonyl group, a sulfamoyl group, a group containing phosphoric acid amide or phosphoric ester structure, a silyl group, a carboxyl group or a salt of it, a sulfo group or a salt of it, a phosphoric acid group, a hydroxyl group, and a quaternary ammonium group can be exemplified.

These substituents may be further substituted with these substituents.

In formula (IIIa), the aryl group represented by $Q^a$ is a monocyclic or condensed cyclic aryl group preferably having from 6 to 20, more preferably from 6 to 16, and particularly preferably from 6 to 10, carbon atoms. The aryl group is preferably a phenyl group or a naphthyl group.

The aryl group represented by $Q^a$ may have a substituent, and the substituent may be any group as long as the photographic performances are not afffected, e.g., the groups exemplified above as the substituents of the alkyl group can be used as the substituents of the aryl group. Particularly preferably, $Q^a$ represents a phenyl group substituted with an electron attractive group taking the Hammett's $\sigma_p$ value of a positive value.

The $\sigma_p$ value of the electron attractive group is preferably from 0.2 to 2.0, more preferably from 0.4 to 1.0. The specific examples of such electron attractive groups include a cyano group, an alkoxycarbonyl group, an aryloxycarbonyl group, a carbamoyl group, a sulfamoyl group, an alkylsulfonyl group, an arylsulfonyl group, an alkylphosphoryl group, a sulfoxide group, an acyl group, a heterocyclic group, a halogen atom, a halogenated alkyl group and a phosphoryl group.

The more preferred electron attractive groups are a carbamoyl group, an alkoxycarbonyl group, an alkylsulfonyl group, and an alkylphosphoryl group. A carbamoyl group is most preferred.

The heterocyclic group represented by $Q^a$ in formula (IIIa) is preferably a 5- or 7-membered, saturated or unsaturated monocyclic or condensed ring in which the heterocyclic ring contains one or more hetero atom(s) selected from the group consisting of a nitrogen atom, an oxygen atom and a sulfur atom.

The examples of the heterocyclic rings include preferably pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole, thiadiazole and triazole, more preferably pyridine, quinoline, pyrimidine, thiadiazole and benzothiazole, and particularly preferably pyridine, quinoline and pyrimidine.

The heterocyclic group represented by $Q^a$ may have a substituent, and the groups described above as the substituents of the alkyl group can be exemplified as the substituents of the heterocyclic group.

$Q^a$ particularly preferably represents a phenyl group substituted with an electron attractive group taking the Hammett's $\sigma_p$ value of a positive value.

The substituents of $Q^a$ may have a ballast group which is used in a photographic material for reducing diffusibility or a group which gives the adsorptivity onto a silver salt or water solubility, the substituents may form a polymer by polymerization with each other, or the substituents may be bonded to each other to form a bis type, a tris type or a tetrakis type group.

In formula (IIIa), $Y^a$ represents a divalent linking group, preferably —$SO_2$—, —SO— or —CO—, and particularly preferably —$SO_2$—.

In formula (IIIa), $n^a$ represents 0 or 1, preferably 1.

$Z^{1a}$ and $Z^{2a}$ in formula (IIIa) each represents a halogen atom (e.g., fluorine, chlorine, bromine, iodine), and most preferably $Z^{1a}$ and $Z^{2a}$ each represents a bromine atom.

In formula (IIIa) $X^b$ represents a hydrogen atom or an electron attractive group. The electron attractive group represented by $X^b$ is a substituent capable of taking the Hammett's substituent constant p value of a positive value, specifically a cyano group, an alkoxycarbonyl group, an aryloxycarbonyl group, a carbamoyl group, a sulfamoyl group, an alkylsulfonyl group, an arylsulfonyl group, a halogen atom, an acyl group, and a heterocyclic group can be exemplified. $X^b$ preferably represents a hydrogen atom or a halogen atom, most preferably a bromine atom. As the polyhalogen compound represented by formula (IIIa), the compounds disclosed in U.S. Pat. Nos. 3,874,946, 4,756,999, 5,340,712, 5,369,000, 5,464,737, JP-A-50-137126, JP-A-50-89020, JP-A-50-119624, JP-A-59-57234, JP-A-7-2781, JP-A-7-5621, JP-A-9-160164, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, J-A-11-242304, Japanese Patent Application Nos. 10-181459, 10-292864,11-90095, 11-89773, and 11-205330 can be exemplified.

The specific examples of the polyhalogen compounds represented by formula (IIIa) are shown below, but the compounds which can be used in the present invention are not limited thereto.

(III-1)

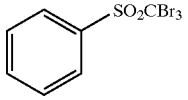

(III-2)

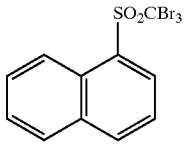

(III-3)

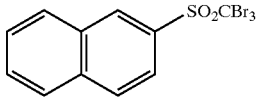

(III-4)

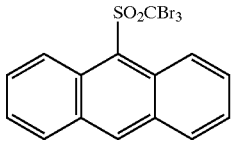

-continued
(III-5)
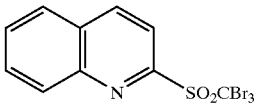
(III-6)
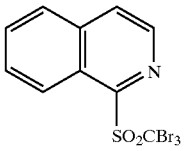
(III-7)
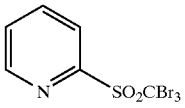
(III-8)
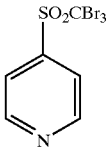
(III-9)
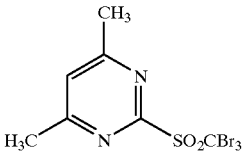
(III-10)
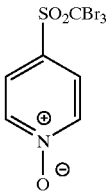
(III-11)
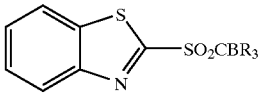
(III-12)
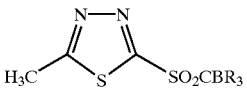
(III-13)
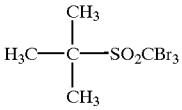
(III-14)
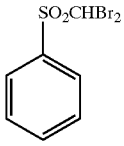
(III-15)
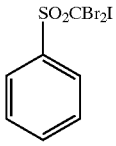
-continued
(III-16)
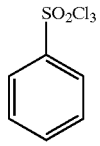
(III-17)
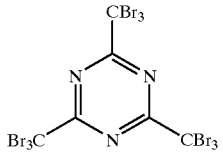
(III-18)
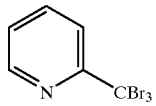
(III-19)
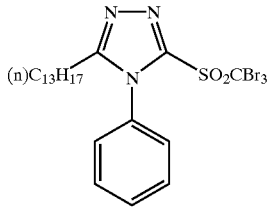
(III-20)
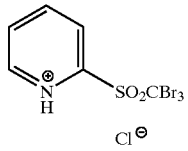
(III-21)
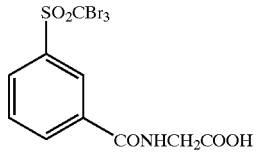
(III-22)
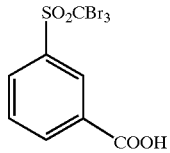
(III-23)
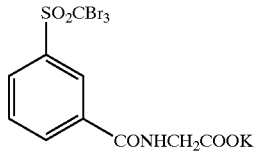
(III-24)
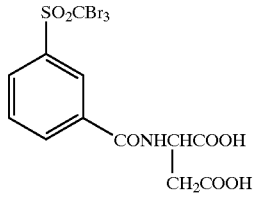

-continued
(III-25)
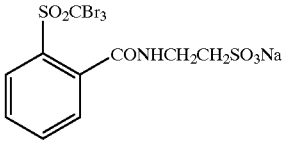
(III-26)
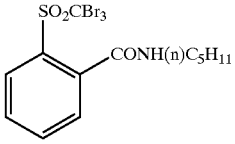
(III-27)
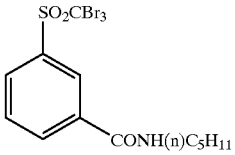
(III-28)
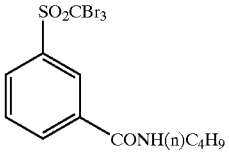
(III-29)
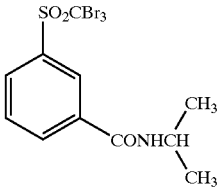
(III-30)
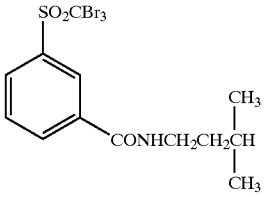
(III-31)
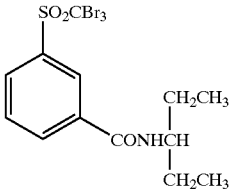
(III-32)
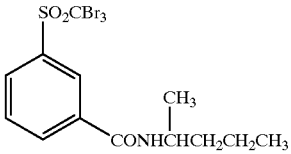
(III-33)
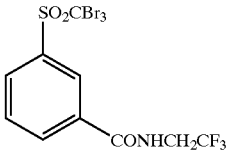
-continued
(III-34)
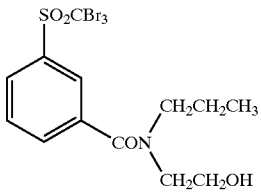
(III-35)
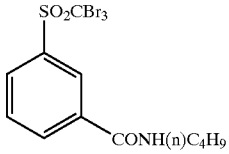
(III-36)
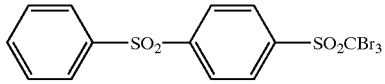
(III-37)
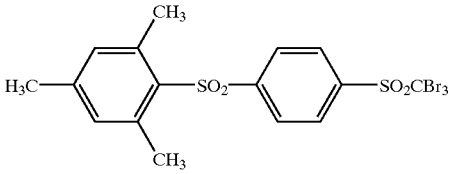
(III-38)
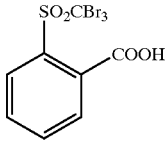
(III-39)
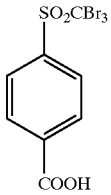
(III-40)
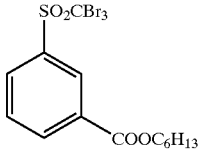
(III-41)
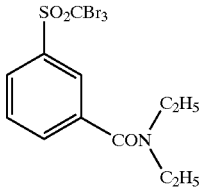
(III-42)
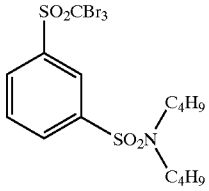

-continued (III-43)

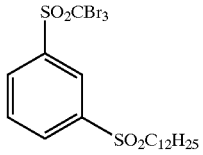

(III-44)

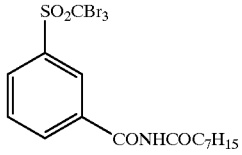

(III-45)

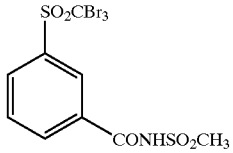

The polyhalogen compounds represented by formula (IIIa) may be used alone or two or more may be used in combination.

The compound represented by formula (IIIa) is preferably used in an amount of from $10^{-4}$ to 1 mol per mol of the non-photosensitive silver salt in an image-forming layer, more preferably from $10^{-3}$ to 0.8 mol, and still more preferably from $5\times10^{-3}$ to 0.5 mol.

In the present invention, antifoggants are added to a heat-developable photosensitive material in the same methods as described in the addition method of reducing agents, and it is also preferred for organic polyhalogen compounds to be added as a solid fine particle dispersion.

As other antifoggants, the following compounds can be exemplified: the mercury(II) salt disclosed in JP-A-11-65021, paragraph [0113], the benzoic acids disclosed in JP-A-11-65021, paragraph [0114], the salicylic acid derivative represented by formula (Z) disclosed in Japanese Patent Application No. 11-87297, the formalin scavenger compound represented by formula (S) disclosed in Japanese Patent Application No. 11-23995, the triazine compound claimed in claim 9 in JP-A-11-352624, the compound represented by formula (III) disclosed in JP-A-6-11791, and 4-hydroxy-6-methyl-1,3,3a,7-tetraazaindene.

The heat-developable photosensitive material according to the present invention may contain azolium salts for the purpose of preventing fog. As azolium salts which can be used in the present invention, the compounds represented by formula (XI) disclosed in JP-A-59-193447, the compounds disclosed in JP-B-55-12581, and the compounds represented by formula (II) disclosed in JP-A-60-153039 can be exemplified. Azolium salts can be added to anywhere of the heat-developable photosensitive material, but they are preferably added to the layers on the side on which a photosensitive layer is provided, more preferably they are added to a layer containing an organic silver salt. Azolium salts may be added at any stage of the preparation of a coating solution. When they are added to an organic silver salt-containing layer, they may be added at any stage from the preparation stage of the organic silver salt to the preparation stage of the coating solution, but preferably azolium salts are added to the coating solution after preparation of the organic silver salt and just before coating.

Azolium salts may be added in the form of, e.g., a powder, a solution, or a solid fine particle dispersion. They may be added as the mixed solution with other additives such as sensitizing dyes, reducing agents and toners.

The addition amount of azolium salts is not particularly restricted, but is preferably from $1\times10^{-6}$ to 2 mol, more preferably from $1\times10^{-3}$ to 0.5 mol, per mol of the silver.

The heat-developable photosensitive material of the present invention can contain mercapto compounds, disulfide compounds and thione compounds for the purpose of controlling development by inhibiting or accelerating development, improving spectral sensitization efficiency and/or improving storage stability before and after development. Mercapto compounds, disulfide compounds and thione compounds are disclosed in JP-A-10-62899 (paragraphs [0067] to [0069]), JP-A-10-186572 (the compound represented by formula (I), and the specific examples of them are described in paragraphs [0033] to [0052]), EP-A-0803764 (lines 36 to S6 on page 20), and Japanese Patent Application No. 11-273670. Mercapto-substituted heterocyclic aromatic compounds are preferred above all.

Toners are preferably used in the photothermographic material of the present invention. Toners are disclosed in JP-A-10-62899, paragraphs [0054] and [0055], EP-A-0803764, lines 23 to 48 on page 21, and JP-A-2000-35631, and phthalazinones (phthalazinone, phthalazinone derivatives or metal salts of them, e.g., 4-(1-naphthyl) phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, and tetrachlorophthalic anhydride); phthalazines (phthalazine, phthalazine derivatives or metal salts of them, e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); and combinations of phthalazines and phthalic acids are preferably used, and combinations of phthalazines and phthalic acids are particularly preferably used.

Plasticizers and lubricants which can be used in the photosensitive layer of the present invention are disclosed in JP-A-11-65021, paragraph [0117], super-high contrast agents to form a super-high contrast image and the addition methods and addition amount of super-high contrast agents are disclosed in JP-A-11-65021, paragraph [0118], and JP-A-11-223898, paragraphs [0136] to [0193]. The compounds represented by formulae (H), (1) to (3), (A) and (B) disclosed in Japanese Patent Application No. 11-87297, the compounds represented by formulae (III), (IV) and (V) in Japanese Patent Application No. 11-91652 (specific examples are Compounds 21 to 24), and high contrast accelerators disclosed in JP-A-11-65021, paragraph [0102], and JP-A-11-223898, paragraphs [0194] and [0195] can be used in the present invention.

When formic acid and formate are used as a strong fogging substance, it is preferred to use them in an amount of 5 mmol or less per mol of the silver, more preferably 1 mmol or less, on the side on which an image-forming layer containing a photosensitive silver halide is provided.

When super-high contrast agents are used in the heat-developable photosensitive material of the present invention, it is preferred to use an acid obtained by hydrating a diphosphorus pentoxide or a salt of it in combination. As the acid obtained by hydrating a diphosphorus pentoxide or a salt of it, a metaphosphoric acid (a salt of it), a pyrophosphoric acid (a salt of it), an orthophosphoric acid (a salt of it), a triphosphoric acid (a salt of it), a tetraphosphoric acid (a salt of it), and a hexametaphosphoric acid (a salt of it) are exemplified. As the acid obtained by hydrating a diphosphorus pentoxide or a salt of it particularly preferably used in the present invention, an orthophosphoric acid (a salt of it) and a hexametaphosphoric acid (a salt of it) are exemplified. As the specific examples of the salt, sodium orthophosphate, sodium dihydrogenorthophosphate, sodium hexametaphosphate and ammonium hexametaphosphate are exemplified.

The acid obtained by hydrating a diphosphorus pentoxide or a salt of it can be used in a desired amount in accordance with the properties such as sensitivity and fog, but the coating amount is preferably from 0.1 to 500 mg/m$^2$ of the photographic material, and more preferably from 0.5 to 100 mg/m$^2$.

The heat-developable photosensitive material according to the present invention can be provided with a surface protective layer for the purpose of adhesion prevention of an image-forming layer. A surface protective layer may comprise a monolayer or a plurality of layers. A surface protective layer is disclosed in JP-A-11-60521, paragraphs [0119] and [0120].

Gelatin is preferably used as the binder of a surface protective layer but it is also preferred to use polyvinyl alcohol (PVA). Inert gelatin (e.g., Nitta gelatin 705) and phthalated gelatin (e.g., Nitta gelatin 801) can be used as the gelatin, for instance. As PVA, a completely saponified product PVA-105, a partially saponified products PVA-205 and PVA-335, and a modified polyvinyl alcohol MP-203 (trade names, manufactured by Kurare Co., Ltd.) can be exemplified.

The coating amount of polyvinyl alcohol of a surface protective layer (per one layer) is preferably from 0.3 to 4.0 g/m$^2$ of a support, more preferably from 0.3 to 2.0 g/m$^2$.

In particular, when the heat-developable photosensitive material according to the present invention is used for printing where dimensional fluctuation is an issue of concern, it is preferred to use polymer latexes in a surface protective layer or a backing layer.

Such polymer latexes are described in Taira Okuda and Hiroshi Inagaki compiled, *Gosei Jushi Emulsion* (*Synthetic Resin Emulsions*), Kobunshi Kanko-Kai (1978), Takaaki Sugimura, Yasuo Kataoka, Soichi Suzuki and Keiji Kasahara compiled, *Gosei Latex no Oyo* (*Application of Synthetic Latexes*), Kobunshi Kanko-Kai (1993), and Soichi Muroi, *Gosei Latex no Kagaku* (*Chemistry of Synthetic Latexes*), Kobunshi Kanko-Kai (1970). Specifically, a copolymer latex comprising methyl methacrylate (33.5 mass %)-ethylacrylate (50 mass %)-methacrylic acid (16.5 mass %), a copolymer latex comprising methyl methacrylate (47.5 mass %)-butadiene (47.5 mass %)-itaconic acid (5 mass %), a copolymer latex comprising ethyl acrylate-methacrylic acid, a copolymer latex comprising methyl methacrylate (58.9 mass %)-2-ethylhexyl acrylate (25.4 mass %)-styrene (8.6 mass %)-2-hydroxyethyl methacrylate (5.1 mass %)-acrylic acid (2.0 mass %), and a copolymer latex comprising methyl methacrylate (64.0 mass %)-styrene (9.0 mass %)-butyl acrylate (20.0 mass %)-2-hydroxyethyl methacrylate (5.0 mass %)-acrylic acid (2.0 mass %) can be exemplified.

Further, as the binders for a surface protective layer, the combinations of polymer latexes disclosed in Japanese Patent Application No. 11-6872, the technique disclosed in Japanese Patent Application No. 11-143058, paragraphs [0021] to [0025], the technique disclosed in Japanese Patent Application No. 11-6872, paragraphs [0027] and [0028], and the technique disclosed in Japanese Patent Application No. 10-199626, paragraphs [0023] to [0041] can be applied to the present invention.

The ratio of the polymer latex for a surface protective layer is preferably from 10 to 90 mass % of the entire binders, particularly preferably from 20 to 80 mass %.

The coating amount of the entire binders (including a water-soluble polymer and a latex polymer) of a surface protective layer (per one layer) is preferably from 0.3 to 5.0 g/m$^2$ of a support, more preferably from 0.3 to 2.0 g/m$^2$.

The coating solution for an image-forming layer for use in the present invention is preferably prepared at preparation temperature of from 30 to 65° C., more preferably from 35 to less than 60° C., and still more preferably from 35 to 55° C. It is preferred that the temperature of the coating solution for an image-forming layer just after the addition of a polymer latex is maintained at 30 to 65° C. Further, it is preferred that a reducing agent and an organic silver salt have been mixed before addition of a polymer latex.

The heat-developable photosensitive material in the present invention may comprise one or more image-forming layers on a support. When the image-forming layer consists of one image-forming layer, the layer comprises the organic silver salt, the photosensitive silver halide, the reducing agent, the binder and the compound represented by formula (A), in addition to these compounds, desired additional materials, e.g., a toner, a coating aid, and other auxiliary agents. When the image-forming layer consists of two or more layer, a first image-forming layer (generally the layer contiguous to the support) comprises the organic silver salt, the photosensitive silver halide and the compound represented by formula (A), and at least one of the first image-forming layer and second image-forming layer(s) comprises the other several components.

In the constitution of a multi-color photothermographic material, each color may comprise a combination of these two layers. Alternatively, all the components may be contained in a single layer as disclosed in U.S. Pat. No. 4,708,928. In the case of a multi-dye multi-color photothermographic material, a functional or non-functional barrier layer is generally provided between photosensitive layers to thereby separate and retain each emulsion layer as disclosed in U.S. Pat. No. 4,460,681.

Various kinds of dyes and pigments (e.g., C.I. Pigment Blue 60, C.I. Pigment Blue 64 and C.I. Pigment Blue 15:6) can be used in the image-forming layer of the present invention with a view to improving tone, preventing generation of interference fringe by laser exposure, and preventing irradiation, which are disclosed in detail in WO 98/36322, JP-A-10-268465 and JP-A-11-338098.

In heat-developable photosensitive material of the present invention, an antihalation layer can be provided farther than the photosensitive layer from the light source.

Heat-developable photosensitive materials generally have non-photosensitive layers besides photosensitive layers. Non-photosensitive layers can be classified from the arrangement to (1) a protective layer provided on a photosensitive layer (farther side from the support), (2) intermediate layers provided between a plurality of photosensitive layers or between a photosensitive layer and a protective layer, (3) an undercoat layer provided between a photosensitive layer and a support, and (4) a backing layer provided on the opposite side to a photosensitive layer.

A filter layer is provided in the heat-developable photosensitive material as a layer of (1) or (2). An antihalation layer is provided in the heat-developable photosensitive material as a layer of (3) or (4).

Antihalation layers are disclosed in JP-A-11-65021, paragraphs [0123] and [0124], JP-A-11-223898, JP-A-9-230531, JP-A-10-36695, JP-A-10-104779, JP-A-11-231457, JP-A-11-352625 and JP-A-11-352626.

An antihalation layer contains an antihalation dye having absorption at exposure wavelength. When the exposure wavelength is in the infrared region, it is sufficient to use infrared ray-absorbing dyes, and dyes which do not have absorption in the visible ray region is preferred in such a case.

To prevent halation with a dye having absorption in the visible ray region, it is preferred that the color of the dye does not substantially remain after image formation, it is preferred to use a means of decoloring by the heat of heat development, and it is particularly preferred to add a thermal-decoloring dye and a base precursor to a non-photosensitive layer to make the non-photosensitive layer function as an antihalation layer. These techniques are disclosed in JP-A-11-231457.

The addition amount of decoloring dyes are determined by the uses of the dyes. In general, decoloring dyes are used in the amount that the optical density (absorbance) exceeds 0.1 when measured at objective wavelength, preferably from 0.2 to 2. The addition amount of the dye for obtaining such optical density is in general from about 0.001 to about 1 $g/m^2$.

Decoloration of dyes results in the reduction of optical density to 0.1 or less. Two or more kinds of decoloring dyes maybe used in combination in a thermal-decoloring type recording material or a heat-developable photosensitive material. Two or more kinds of base precursors may also be used in combination.

In the decoloration using a thermal-decoloring dye and a base precursor, the substance which lowers a melting point of the decoloring dye by 3° C. or more (e.g., diphenylsulfone, 4-chlorophenyl (phenyl) sulfone) when mixed with abase precursor as disclosed in JP-A-11-352626 is preferably used in view of thermal-decoloring property.

Coloring agents having absorption maximum in the wavelength region of from 300 to 450 nm may be used in the present invention for the purpose of improving silver tone and the fluctuation of an image with the lapse of time. These coloring agents are disclosed in JP-A-62-210458, JP-A-63-104046, JP-A-63-103235, JP-A-63-208846, JP-A-63-306436, JP-A-63-314535, JP-A-1-61745 and Japanese Patent Application No. 11-276751.

These coloring agents are used generally in the range of from 0.1 mg to 1 $g/m^2$, and they are preferably added to a backing layer provided on the opposite side to the photosensitive layer.

The heat-developable photosensitive material according to the present invention is preferably single-sided photosensitive material having at least one photosensitive layer (image-forming layer) containing a silver halide emulsion on one side of the support and a backing layer on the opposite side of the support.

It is preferred that the heat-developable photosensitive material according to the present invention contain matting agents for improving transporting property. Matting agents are disclosed in JP-A-11-65021, paragraphs [0126] and [0127].

The coating amount of the matting agent is preferably from 1 to 400 $mg/m^2$ of the heat-developable photosensitive material, more preferably from 5 to 300 $mg/m^2$.

The matting degree of an emulsion surface is not particularly limited as long as star dust hindrance does not occur, but Beck's smoothness is preferably from 30 to 2,000 seconds, particularly preferably from 40 to 1,500 seconds. Beck's smoothness can be easily obtained by JIS P8119 "smoothness test method of paper and plate paper by a Beck's tester" and TAPPI standard method T479.

The matting degree of the backing layer according to the present invention is preferably Beck's smoothness of from 10 seconds to 1,200 seconds, more preferably from 20 seconds to 800 seconds, and still more preferably from 40 seconds to 500 seconds.

In the present invention, matting agents are preferably added to the outermost surface layer of the photothermographic material, the layer which functions as the outermost surface layer, or the layer near the outer surface. They are also preferably added to the layer functioning as a protective layer.

Backing layers which can be used in the present invention are disclosed in JP-A-11-65021, paragraphs [0128] to [0130].

The film pH of the heat-developable photosensitive material of the present invention before heat development processing is preferably 6.0 or less, more preferably 5.5 or less. The lower limit is not especially restricted but is generally about 3. The adjustment of film pH is preferably performed with an organic acid such as a phthalic acid derivative, a non-volatile acid such as a sulfuric acid or a volatile base such as an ammonia from the viewpoint of capable of reducing film pH. In particular, ammonia easily volatilizes and is capable of being removed before coating and heat development, thus preferred for achieving low film pH. The measurement of film pH in the present invention is according to the method disclosed in Japanese Patent Application No. 11-87297, paragraph [0123].

A hardening agent may be used in a photosensitive layer, a protective layer, and a backing layer of the present invention. The examples of hardening agents are described in T. H. James, *The Theory of the Photographic Process,* 4th Ed., pp. 77 to 87, Macmillan Publishing Co., Inc. (1977). Chromium alum, sodium 2,4-dichloro-6-hydroxy-s-triazine, N,N-ethylenebis(vinylsulfone acetamide), N,N-propylenebis (vinylsulfone acetamide), the polyvalent metal ions described on p. 78 of the above literature, the polyisocyanates disclosed in U.S. Pat. No. 4,281,060 and JP-A-6-208193, the epoxy compounds disclosed in U.S. Pat. No. 4,791,042, and the vinyl sulfone compounds disclosed in JP-A-62-89048 are preferably used in the present invention.

The hardening agent is added as a solution. The preferred addition time of the solution to the protective layer coating solution is from 180 minutes before coating to immediately before coating, preferably from 60 minutes before to 10 seconds before coating. The mixing method and the mixing condition are not particularly restricted so long as the effect of the present invention can be sufficiently exhibited.

As the specific mixing methods, a method of performing mixture in a tank in such a manner that the average residence time, which is calculated from the addition flow rate and the charging amount to the coater, coincides with the desired time, and a method of using a static mixer as described in N. Harnby, M. F. Edwards, A. W. Nienow, translated by Koji Takahashi, *Liquid Mixing Techniques*, Chap. 8, Nikkan Kogyo Shinbun-sha (1989) can be used.

Surfactants which can be used in the present invention are disclosed in JP-A-11-65021, paragraph [0132], solvents are disclosed in paragraph [0133] of the same patent, supports in paragraph [0134] of the same patent, antistatic agents and electric conductive layers in paragraph [0135] of the same patent, the methods for obtaining a color image are disclosed in paragraph [0136] of the same patent, and sliding agents are disclosed in JP-A-11-84573, paragraphs [0061] to [0064], and Japanese Patent Application No. 11-106881, paragraphs [0049] to [0062].

Polyester films heat treated at 130 to 185° C., in particular, polyethylene terephthalate films, are preferably used as a transparent support to relieve the inner distortion remaining in a film at biaxial stretching and to avoid shrinkage distortion by heat generated during heat development processing.

The transparent support of a heat-developable photosensitive material for medical use may be colored with a bluing dye (e.g., Dye-1 in the Example of JP-A-8-240877), or may not be colored. It is preferred to apply to the support undercoating techniques of the water-soluble polyester disclosed in JP-A-11-84574, the styrene-butadiene copolymer disclosed in JP-A-10-186565, and the vinylidene chloride copolymer disclosed in JP-A-11-106881, paragraphs [0063] to [0080].

The techniques disclosed in JP-A-56-143430, JP-A-56-143431, JP-A-58-62646, JP-A-56-120519, JP-A-11-84573, paragraphs [0040] to [0051], U.S. Pat. No. 5,575,957, and JP-A-11-223898, paragraphs [0078] to [0084] can be applied to an antistatic layer or undercoating.

The heat-developable photosensitive material according to the present invention is preferably a mono-sheet type material (a type capable of forming an image on the heat-developable photosensitive material not using other sheet, e.g., an image-receiving material).

The heat-developable photosensitive material according to the present invention may further contain an antioxidant, a stabilizer, a plasticizer, an ultraviolet absorber, or a coating aid. Various additives are added to either a photosensitive layer or a non-photosensitive layer. With respect to the addition of these additives, WO 98/36322, EP-A-803764, JP-A-10-186567 and JP-A-10-18568 can be referred to.

The heat-developable photosensitive material according to the present invention may be coated by any method.

Specifically, extrusion coating, slide coating, curtain coating, immersion coating, knife coating, flow coating, and various coating methods including extrusion coating using hoppers disclosed in U.S. Pat. No. 2,681,294 can be used. Extrusion coating and slide coating described in Stephen F. Kistler, Peter M. Schweizer, *Liquid Film Coating*, pp. 399 to 536, Chapman & Hall Co. (1997) are preferably used, particularly slide coating is preferably used.

The examples of the shapes of slide coaters for use in slide coating are described in ibid., p. 427, FIG. 11*b*.l. Two or more layers can be coated simultaneously by the methods described in ibid., pp. 399 to 536, U.S. Pat. No. 2,761,791 and British Patent 837,095, if desired.

The coating solution for the organic silver salt-containing layer of the present invention is preferably a so-called thixotropic liquid. Thixotropy is the property which lowers in viscosity as the shear rate increases. Any test apparatus can be used in the viscosity measurement in the present invention. RFS Fluid Spectrometer manufactured by Rheometrics Far East Co. is preferably used. Measurement is performed at 25° C.

The viscosity at the shear rate of 0.1 $S^{-1}$ of the coating solution for the organic silver salt-containing layer of the present invention is preferably from 400 mPa·s to 100,000 mPa·s, more preferably from 500 mPa·s to 20,000 mPa·s. The viscosity at shear rate of 1,000 $S^{-1}$ is preferably from 1 mPa·s to 200 mPa·s, more preferably from 5 mPa·s to 80 mPa·s.

Various systems exhibiting thixotropy are known and described in Kobunshi Kanko-Kai compiled, *Koza.Rheology* (*Lecture, Rheology*), Muroi and Morino, *Kobunshi Latex* (*High Molecular Latexes*), published by Kobunshi Kanko-Kai. It is necessary for a liquid to contain a large amount of solid fine particles to exhibit thixotropy. For heightening thixotropy, viscosity-increasing linear high molecules must be contained. It is effective that solid fine particles contained have a large aspect ratio anisotropically, in addition, the use of alkali thickeners and surfactants is also effective.

With respect to the techniques which can be used in the heat-developable photosensitive material according to the present invention, the following patents can also be referred to: EP-A-803764, EP-A-883022, WO 98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, and JP-A-11-352627.

The heat-developable photosensitive material according to the present invention may be developed by any method. However, in general, the imagewise exposed heat-developable photosensitive material is developed with increasing the temperature. The developing temperature is preferably from 80 to 250° C., more preferably from 100 to 140° C.

The developing time is preferably from 1 to 180 seconds, more preferably from 10 to 90 seconds, and particularly preferably from 10 to 40 seconds.

A plate heater system is preferably used as the heat developing method. The heat developing method by plate heater systems disclosed in JP-A-11-133572 is preferably used in the present invention, which is the method using a heat developing apparatus to obtain a visible image by making a heat-developable photosensitive material, in which a latent image has been formed, contact with a heating means at a heat developing zone. The foregoing heating means comprises a plate heater, and a plurality of pressing rollers arranged along one surface of the plate heater vis-a-vis with the plate heater. Heat development is performed by passing the foregoing heat-developable photosensitive material between the above pressing rollers and the plate heater. It is preferred to divide the plate heater to two to six stages and make the temperature of the tip part of the heater low by 1 to 10° C. or so.

Such a method is disclosed in JP-A-54-30032, which method is capable of removing the moisture content and the organic solvent contained out of the material, and inhibiting the deformation of the support of the heat-developable photosensitive material due to sudden heating of the heat-developable photosensitive material.

The heat-developable photosensitive material according to the present invention may be subjected to exposure according to any method, but laser beams are preferably used as a light source. A gas laser ($Ar^+$, He—Ne), a YAG laser, a dye laser and a semiconductor laser are preferably used as laser beams in the present invention. A semiconductor laser and second harmonic generating element can also be used. From red to infrared emission gas and a semiconductor laser are preferably used.

As the laser imager equipped with an exposure zone and a heat developing zone, Fuji Medical Dry Laser Imager FM-DPL can be exemplified. FM-DPL is described in *Fuji Medical Review*, No. 8, pp. 39 to 55, and the technique is of course applied to the heat-developable photosensitive material of the present invention as laser imager. The technique can also be applied to the heat-developable photosensitive material for laser imager in AD Network as Fuji Medical System suggested as the network system adapted to DICOM standard.

The heat-developable photosensitive material of the present invention forms a black-and-white image by a silver image, and preferably used as the heat-developable photosensitive material for medical diagnosis, the heat-developable photosensitive material for industrial photography, the heat-developable photosensitive material for printing, and the heat-developable photosensitive material for COM.

With respect to the techniques which can be used for a color heat-developable photosensitive material, the techniques disclosed in JP-A-6-130607, JP-A-6-332134, JP-A-6-332136, JP-A-6-347970, JP-A-7-261354, and Japanese Patent Application No. 2000-89436 can be exemplified.

The present invention is described in detail below with reference to the examples, but the present invention should not be construed as being limited thereto.

EXAMPLE 1

The structural formulae of the compounds which are used in the Example are shown below.

Tellurium Sensitizer B

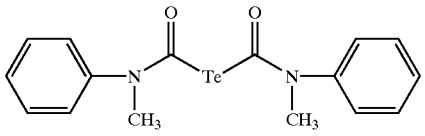

Base Precursor Compound 11

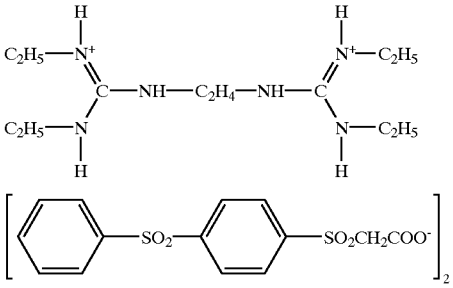

Cyanine Dye Compound 13

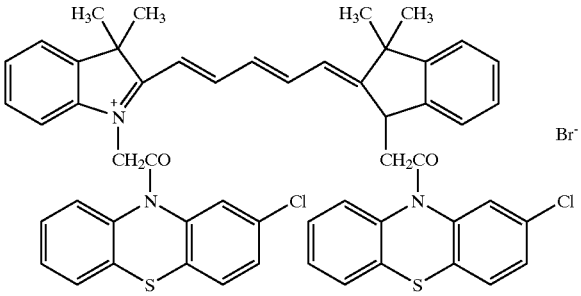

-continued

Blue Dye Compound 14

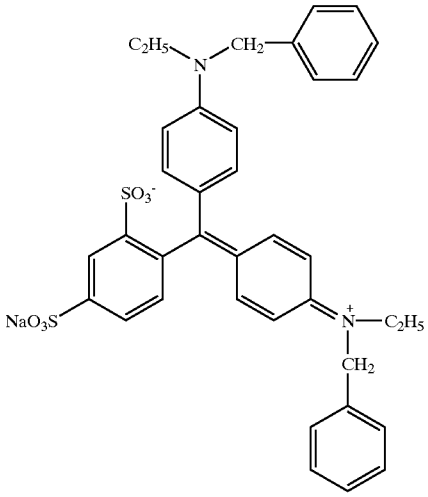

Yellow Dye Compound 15

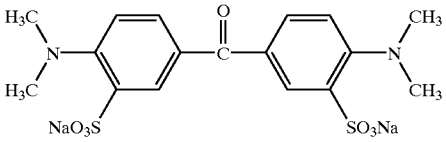

Comparative Dyes

SS-1

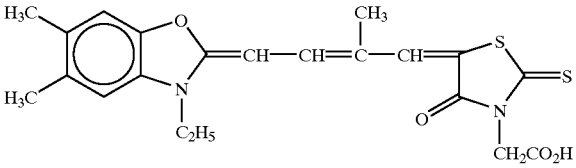

SS-2

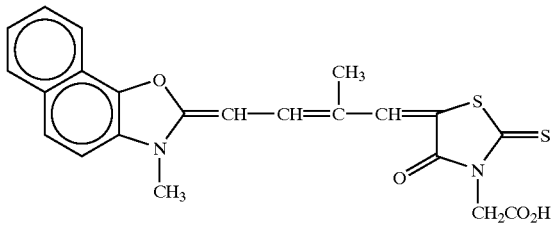

Preparation of PET Support

PET having an intrinsic viscosity IV=0.66 (measured in phenol/tetrachloroethane (6/4 by mass ratio) at 25° C.) was obtained according to ordinary method with terephthalic acid and ethylene glycol. After the obtained PET was pelletized and dried at 130° C. for 4 hours, melted at 300° C., extruded from T-die, and suddenly cooled, thereby an unstretched film having a film thickness after thermal fixation of 175 μm was obtained.

The film was stretched to 3.3 times in the machine direction with rollers having different peripheral speeds, then 4.5 times in the transverse direction by means of a tenter. The temperatures at that time were 110° C. and 130° C. respectively. Subsequently, the film was subjected to thermal fixation at 240° C. for 20 seconds, then relaxation by 4% in the transverse direction at the same temperature. The chuck part of the tenter was then slit, and both edges of the film were knurled. The film was rolled at a load of 4 kg/cm$^2$, thereby a roll of film having a thickness of 175 μm was obtained.

Corona Discharge Treatment of Support Surface

Both surfaces of the support were subjected to corona discharge treatment under room temperature at 20 m/min with a solid state corona treating apparatus model 6 KVA manufactured by Piller Co. From the reading of electric current and voltage, treatment applied to the support at that time was revealed to be 0.375 kV·A·min/$m^2$. The frequency at treatment at that time was 9.6 kHz and the gap clearance between the electrode and the dielectric roll was 1.6 mm.

Preparation of Undercoated Support (1) Preparation of Coating Solution for Undercoat Layer Prescription (1) (for Undercoat Layer on the Photosensitive Layer Side)

| | |
|---|---|
| Pesresin A-515GB (30 mass % solution, manufactured by Takamatsu Yushi Co., Ltd.) | 234 g |
| Polyethylene glycol monononylphenyl ether (average ethylene oxide number: 8.5, 10 mass % solution) | 21.5 g |
| MP-1000 (polymer fine particles, average particle size: 0.4 μm, manufactured by Soken Kagaku Co. Ltd.) | 0.91 g |
| Distilled water | 744 ml |

Prescription (2) (for First Layer on the Back Surface Side)

| | |
|---|---|
| Styrene/butadiene copolymer latex (solid content: 40 mass %, mass ratio of styrene/butadiene: 68/32) | 158 g |
| Sodium 2,4-dichloro-6-hydroxy-s-triazine (8 mass % aqueous solution) | 20 g |
| Sodium laurylbenzenesulfonate (1 mass % aqueous solution) | 10 ml |
| Distilled water | 854 ml |

Prescription (3) (for Second Layer on the Back Surface Side)

| | |
|---|---|
| $SnO_2$/SbO (9/1 by mass ratio, average particle size: 0.038 μm, 17 mass % dispersion) | 84 g |
| Gelatin (10% aqueous solution) | 89.2 g |
| Metrose TC-5 (2 mass % aqueous solution, manufactured by Shin-Etsu Chemical Co., Ltd.) | 8.6 g |
| MP-1000 (polymer fine particles, manufactured by Soken Kagaku Co. Ltd.) | 0.01 g |
| Sodium dodecylbenzenesulfonate (1 mass % aqueous solution) | 10 ml |
| NaOH (1 mass %) | 6 ml |
| Proxel (manufactured by ICI Co., Ltd.) | 1 ml |
| Distilled water | 805 ml |

(2) Preparation of Undercoated Support

Both surfaces of the above-prepared biaxially stretched polyethylene terephthalate support having a film thickness of 175 μm were subjected to corona discharge treatment, then the above undercoating solution prescription (1) was coated on one side (photosensitive layer surface) by means of a wire bar in a wet coating amount of 6.6 ml/$m^2$ (per one surface) and the coated layer was dried at 180° C. for 5 minutes. Subsequently, the above undercoating solution prescription (2) was coated on the back surface by means of a wire bar in a wet coating amount of 5.7 ml/$m^2$ and the coated layer was dried at 180° C. for 5 minutes, and further the above undercoating solution prescription (3) was coated on the back surface by means of a wire bar in a wet coating amount of 7.7 ml/$m^2$ and the coated layer was dried at 180° C. for 6 minutes. Thus, the undercoated support was prepared.

Preparation of Back Surface Coating Solution (1) Preparation of Solid Fine Particle Dispersion Solution (a) of Base Precursor Base precursor compound 11 shown below (64 g), 28 g of diphenylsulfone, and 10 g of surfactant Demol N (manufactured by Kao Corporation) were mixed with 220 ml of distilled water. The mixed solution was dispersed using beads in a sand mill (¼ Gallon sand grinder mill, manufactured by Imex Co., Ltd.), thereby a solid fine particle dispersion solution (a) of the base precursor compound having an average particle size of 0.2 μm was obtained.

(2) Preparation of Solid Fine Particle Dispersion Solution of Dye

Cyanine dye compound 13 shown below (9.6 g) and 5.8 g of sodium p-dodecylbenzenesulfonate were mixed with 305 ml of distilled water. The mixed solution was dispersed using beads in a sand mill (¼ Gallons and grinder mill, manufactured by Imex Co., Ltd.), thereby a solid fine particle dispersion solution of the dye having an average particle size of 0.2 μm was obtained.

(3) Preparation of Antihalation Layer Coating Solution

Gelatin (17 g), 9.6 g of polyacrylamide, 70 g of the above solid fine particle dispersion solution (a) of the base precursor, 56 g of the above solid fine particle dispersion solution of the dye, 1.5 g of polymethyl methacrylate fine particles (average particle size: 6.5 μm), 0.03 g of benzoylthiazolinone, 2.2 g of sodium polyethylenesulfonate, 0.2 g of the above-shown blue dye compound 14, 3.9 g of the above-shown yellow dye compound 15, and 844 ml of water were mixed. Thus, an antihalation layer coating solution was prepared.

(4) Preparation of Back Surface Protective Layer Coating Solution

In a reaction vessel maintained at 40° C. were mixed 50 g of gelatin, 0.2 g of sodium polystyrenesulfonate, 2.4 g of N,N-ethylenebis(vinylsulfone acetamide), 1 g of sodium tert-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether (average polymerization degree of ethylene oxide: 15), 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization mass ratio: 5/95), 0.6 g of aerosol OT (manufactured by American Cyanamide Co.), 1.8 g (as a liquid paraffin) of liquid paraffin emulsion product, and 950 ml of water, thereby a back surface protective layer coating solution was prepared.

Preparation of Silver Halide Emulsion

To 1,421 ml of distilled water were added 3.1 ml of a 1 mass % potassium bromide solution, 3.5 ml of a sulfuric acid solution in concentration of 0.5 mol/liter, and 31.7 g of phthalated gelatin. This mixed solution was stirred in a titanium-coated stainless reaction vessel with maintaining the temperature at 34° C. Solution A (22.22 g of silver nitrate was diluted with distilled water to make the volume 95.4 ml) and solution B (15.3 g of potassium bromide and 0.8 g of potassium iodide were diluted with distilled water to make the volume 97.4 ml) were prepared. The entire amount of solution A and solution B was added to the reaction vessel at a constant flow rate over 45 seconds. Then, 10 ml of a 3.5 mass % hydrogen peroxide aqueous solution was added, further, 10.8 ml of a 10 mass % benzimidazole aqueous solution was added.

Further, solution C (51.86 g of silver nitrate was diluted with distilled water to make the volume 317.5 ml), and solution D (44.2 g of potassium bromide and 2.2 g of potassium iodide were diluted with distilled water to make the volume 400 ml) were prepared. The entire amount of solution C was added to the reaction vessel at a constant flow rate over 20 minutes. Solution D was added by a controlled double jet method with maintaining pAg at 8.1. Ten minutes after the start of the addition of solution C and solution D, hexachloroiridate (III) potassium salt was added in an amount of $1\times10^{-4}$ mol of the silver. Five seconds after the completion of the addition of solution C, an aqueous solution of potassium hexacyanoferrate(II) was added in an amount of $3\times10^{-4}$ mol of the silver. pH was adjusted to 3.8 with a sulfuric acid in concentration of 0.5 mol/liter, and stirring was stopped. The reaction solution was subjected to precipitation, desalting and washing processes. pH was adjusted to 5.9 with sodium hydroxide in concentration of 1 mol/liter, thereby a silver halide dispersion having pAg of 8.0 was obtained.

The temperature of the above silver halide dispersion was maintained at 38° C. with stirring, then 5 ml of a 0.34 mass % methanol solution of 1,2-benzoisothiazolin-3-one was added, and 40 minute after, a methanol solution of spectral sensitizing dye SS-1 (comparative dye SS-1) shown below was added in an amount of $1\times10^{-3}$ mol per mol of the silver, and 1 minute after, the temperature was raised to 47° C.

Twenty minutes after temperature up, a methanol solution of a sodium benzenethiosulfonate was added thereto in an amount of $7.6\times10^{-5}$ mol per mol of the silver, and further five minutes after, a methanol solution of tellurium sensitizer B shown below was added in an amount of $1.9\times10^{-4}$ mol per mol of the silver, and the reaction solution was subjected to ripening for 91 minutes. A methanol solution of a 0.8 mass % N,N'-dihydroxy-N"-diethylmelamine (1.3 ml) was added to the above reaction solution, and four minutes after then, a methanol solution of 5-methyl-2-mercaptobenzimidazole in an amount of $3.7\times10^{-3}$ mol per mol of the silver, and a methanol solution of 1-phenyl-2-heptyl-5-mercapto-1,3,4-triazole in an amount of $4.9\times10^{-3}$ mol per mol of the silver were further added, thus a silver halide emulsion was prepared.

The grains in the thus-prepared silver halide emulsion were silver iodobromide grains containing 3.5 mol % of iodide uniformly and having an average equivalent-circle diameter of 42 nm and a variation coefficient of equivalent-circle diameter of 20% (in the silver halide emulsion having an average equivalent-circle diameter of 42 nm, the saturation adsorption amount of the sensitizing dye was $8.6\times10^{-3}$ mol/mol of the silver). The grain size was the average of 1,000 grains obtained by electron microscope. The {100} plane ratio of this grain obtained by the Kubelka-Munk method was 80%.

Silver halide emulsions were prepared in the same manner as in the preparation of the above silver halide emulsion except that the kind of a spectral sensitizing dye was changed from SS-1 to each spectral sensitizing dye shown in Table 1 below.

The addition amount of the sensitizing dye in each sample was as follows.

Samples 1 and 9: $1\times10^{-3}$ mol/mol Ag

Sample 14: the total of SS-1 and SS-2 was $1\times10^{-3}$ mol/mol Ag

Samples 2 to 8 and 10 to 13: $0.5\times10^{-3}$ mol/mol Ag

Sample 15: the total of DD-17 and DD-20 was $0.5\times10^{-3}$ mol/mol Ag

Sample 16: the total of DD-35 and DD-38 was $0.5\times10^{-3}$ mol/mol Ag

Sample 17: $0.7\times10^{-3}$ mol/mol Ag

Sample 18: $0.35\times10^{-3}$ mol/mol Ag

Further, silver halide emulsions were prepared in the same manner as in the preparation of the above silver halide emulsion except that the average equivalent-circle diameter was changed by changing the liquid temperature (in the silver halide emulsion having an average an equivalent-circle diameter of 80 nm, the saturation adsorption amount of the sensitizing dye was $4.5\times10^{-3}$ mol/mol of the silver), and the amount of the chemical sensitizers so as to give an optimal sensitivity for sensitometry described later.

In each of Samples 1 to 18 in Table 1, the dye chromophore of the sensitizing dye was adsorbed in a single layer. That is, the dye chromophore was not multilayer-adsorbed (the dye chromophore was not adsorbed onto a silver halide grain in more than one layer).

When a dye chromophore is multilayer-adsorbed, the sensitivity after the lapse of time is liable to be reduced as compared with the case of monolayer adsorption (i.e., not adsorbed in multilayers). Accordingly, monolayer adsorption (i.e., not adsorbed in multilayers) is advantageous in view of stability.

Preparation of Mixed Emulsion for Coating Solution

A 1 mass % aqueous solution of benzothiazolium iodide was added to the above-prepared each emulsion in an amount of $7\times10^{-3}$ mol per mol of the silver, to thereby prepare a mixed emulsion for each coating solution.

Preparation of Fatty Acid Silver Dispersion

Behenic acid (87.6 kg) (manufactured by Henkel Co., trade name: Edenor C22-85R), 423 liters of distilled water, 49.2 liters of an aqueous solution of NaOH in concentration of 5 mol/liter, and 120 liters of tert-butanol were mixed, and the mixture was stirred to react for 1 hour at 75° C., thereby a sodium behenate solution was obtained.

Apart from the sodium behenate solution, 206.2 liters of an aqueous solution containing 40.4 kg of silver nitrate (pH 4.0) was prepared and maintained at 10° C. A reaction vessel containing 635 liters of distilled water and 30 liters of tert-butanol was maintained at 30° C., with stirring the content in the reaction vessel, the entire amount of the above sodium behenate solution and the entire amount of the aqueous silver nitrate solution were added to the reaction vessel at a constant flow rate over 62 minutes and 10 seconds and 60 minutes, respectively, in such a manner that only the aqueous silver nitrate solution was added from the start of the addition, 7 minutes and 20 seconds after the start of the addition of the aqueous silver nitrate solution, the addition of the sodium behenate solution was started, and only the sodium behenate solution was added for 9 minutes and 30 seconds after the termination of the addition of the aqueous silver nitrate solution. The temperature in the reaction vessel was maintained at 30° C. and the outer temperature was controlled so as to maintain the solution temperature constant.

The piping of the addition system of the sodium behenate solution was warmed by steam tracing, and steam aperture was adjusted so that the solution temperature at the outlet of the addition nozzle tip became 75° C. The piping of the addition system of the aqueous solution of silver nitrate was warmed by circulating chilled water in the outer pipe of the double pipe. The positions where the sodium behenate solution and the aqueous solution of silver nitrate were added were arranged symmetrically with the stirring axle between, and the height of the position was adjusted so as not to touch the reaction solution.

After the addition of the sodium behenate solution was finished, the reaction solution was stirred at the same temperature for 20 minutes and allowed to stand to lower the temperature to 25° C. The solid content was then filtered by suction. The solid content was washed with water until the conductivity of the filtrate reached 30 mS/cm. Thus, a fatty acid silver salt was obtained. The solid content obtained was not dried and stored as a wet cake.

The shape of the obtained silver behenate particles was evaluated with an electron microscope. The obtained silver behenate particles were scaly crystals having a=0.14 μm, b=0.4 μm, and c=0.6 μm, on average, an average aspect ratio of 5.2, an average equivalent-sphere diameter of 0.52 μm, and a variation coefficient of the average equivalent-sphere diameter of 15%. (a, b and c were defined above.)

Polyvinyl alcohol (PVA-205, manufactured by Kurare Co., Ltd.) (7.4 g) and water were added to the wet cake of the amount corresponding to 100 g of dried solid content to make the entire amount 385 g, and then the above product was preliminarily dispersed in a homomixer.

The preliminarily dispersed starting solution was treated three times using a disperser (Micro-fluidizer M-110S-EH equipped with G10Z interaction chamber, manufactured by Micro Fluidex International Corp.). Pressure of the disperser was adjusted to 1,750 kg/cm$^2$. Thus, silver behenate dispersion was obtained. Cooling operation was performed by installing coiled heat exchangers respectively before and after the interaction chamber and setting the temperature of dispersion at 18° C. by adjusting the temperature of the cooling medium.

Preparation of 25 Mass % Dispersion of Reducing Agent

Water (16 kg) was added to 10 kg of 1,1-bis(2-hydroxy-3,5-dimethylphenyl)-3,5,5-trimethylhexane and 10 kg of a 20 mass % aqueous solution of modified polyvinyl alcohol (Poval MP203, manufactured by Kurare Co., Ltd.), and they were thoroughly mixed to make a slurry.

The slurry was fed to a horizontal beads mill (UVM-2, manufactured by Imex Co., Ltd.) packed with zirconia beads having an average diameter of 0.5 mm by means of a diaphragm pump and dispersed for 3 hours and 30 minutes. Benzoisothiazolinone sodium salt (0.2 g) and water were added to the above dispersion to make the concentration of the reducing agent 25 mass %, thereby the dispersion of the reducing agent was obtained.

The particles of the reducing agent contained in the thus-obtained reducing agent dispersion had a median particle diameter of 0.42 μm and a maximum particle diameter of 2.0 μm or less. The obtained reducing agent dispersion was filtered through a polypropylene filter having a pore diameter of 10.0 μm to remove impurities such as dusts and stored.

Preparation of 25 mass % Dispersion of Reducing Agent Complex

Water (16 kg) was added to 10 kg of 1/1 complex of 2,2-methylene-bis(4-ethyl-6-tert-butylphenol) and triphenylphosphine oxide, and 10 kg of a 20 mass % aqueous solution of modified polyvinyl alcohol (Poval MP203, manufactured by Kurare Co., Ltd.), and they were thoroughly mixed to make a slurry.

The slurry was fed to a horizontal beads mill (UVM-2, manufactured by Imex Co., Ltd.) packed with zirconia beads having an average diameter of 0.5 mm by means of a diaphragm pump and dispersed for 3 hours and 30 minutes. Benzoisothiazolinone sodium salt (0.2 g) and water were added to the above dispersion to make the concentration of the reducing agent 25 mass %, thereby the dispersion of the reducing agent complex was obtained.

The particles of the reducing agent complex contained in the thus-obtained reducing agent complex dispersion had a median particle diameter of 0.46 μm and a maximum particle diameter of 2.0 μm or less. The obtained reducing agent complex dispersion was filtered through a polypropylene filter having a pore diameter of 10.0 μm to remove impurities such as dusts and stored.

Preparation of 10 Mass % Dispersion of Mercapto Compound

Water (8.3 kg) was added to 5 kg of a mercapto compound (1-phenyl-2-heptyl-5-mercapto-1,3,4-triazole) and 5 kg of a 20 mass % aqueous solution of modified polyvinyl alcohol (Poval MP203, manufactured by Kurare Co., Ltd.), and they were thoroughly mixed to make a slurry.

The slurry was fed to a horizontal beads mill (UVM-2, manufactured by Imex Co., Ltd.) packed with zirconia beads having an average diameter of 0.5 mm by means of a diaphragm pump and dispersed for 6 hours. Water was added to the above dispersion to make the concentration of the mercapto compound 10 mass %, thereby the dispersion of the mercapto compound was obtained.

The particles of the mercapto compound contained in the thus-obtained mercapto compound dispersion had a median particle diameter of 0.40 μm and a maximum particle diameter of 2.0 μm or less. The obtained mercapto compound dispersion was filtered through a polypropylene filter having a pore diameter of 10.0 μm to remove impurities such as dusts and stored. The dispersion was filtered again through a polypropylene filter having a pore diameter of 10 μm just before use.

Preparation of 20 Mass % Organic Polyhalogen Compound Dispersion-1

Water (10 kg) was added to 5 kg of polyhalogen compound A (tribromomethylnaphthylsulfone), 2.5 kg of a 20 mass % aqueous solution of modified polyvinyl alcohol (Poval MP203, manufactured by Kurare Co., Ltd.), and 213 g of a 20 mass % aqueous solution of sodium triisopropylnaphthalenesulfonate, and they were thoroughly mixed to make a slurry.

The slurry was fed to a horizontal beads mill (UVM-2, manufactured by Imex Co., Ltd.) packed with zirconia beads having an average diameter of 0.5 mm by means of a diaphragm pump and dispersed for 5 hours. Benzoisothiazolinone sodium salt (0.2 g) and water were added to the above dispersion to make the concentration of the organic polyhalogen compound 20 mass %, thereby the dispersion of the organic polyhalogen compound was obtained.

The particles of the organic polyhalogen compound A contained in the thus-obtained organic polyhalogen compound dispersion had a median particle diameter of 0.36 μm and a maximum particle diameter of 2.0 μm or less. The obtained organic polyhalogen compound dispersion-1 was filtered through a polypropylene filter having a pore diameter of 3.0 μm to remove impurities such as dusts and stored.

Preparation of 25 Mass % Organic Polyhalogen Compound Dispersion-2

In the preparation of 20 mass % organic polyhalogen compound dispersion-1, the procedure of dispersion was repeated in the same manner except for using 5 kg of organic polyhalogen compound B (tribromomethyl[4-(2,4,6-trimethylphenylsulfonyl)phenyl]sulfone) in place of 5 kg of organic polyhalogen compound A (tribromomethylnaphthylsulfone). The dispersion was diluted to 25 mass % of the organic polyhalogen compound and then filtered., The particles of the organic polyhalogen compound B contained in the thus-obtained organic polyhalogen compound dispersion had a median particle diameter of 0.38 μm and a maximum particle diameter of 2.0 μm or less. The obtained organic polyhalogen compound dispersion-2 was filtered through a polypropylene filter having a pore diameter of 3.0 μm to remove impurities such as dusts and stored.

Preparation of 26 Mass % Organic Polyhalogen Compound Dispersion-3

In the preparation of 20 mass % organic polyhalogen compound dispersion-1, the procedure of dispersion was repeated in the same manner except for using 5 kg of organic polyhalogen compound C (tribromomethylphenylsulfone) in place of 5 kg of organic polyhalogen compound A (tribromomethylnaphthylsulfone), and changing the amount of a 20 mass % aqueous solution of MP203 to 5 kg. The dispersion was diluted to 26 mass % of the organic polyhalogen compound and then filtered.

The particles of the organic polyhalogen compound C contained in the thus-obtained organic polyhalogen compound dispersion had a median particle diameter of 0.41 μm and a maximum particle diameter of 2.0 μm or less. The obtained organic polyhalogen compound dispersion-3 was filtered through a polypropylene filter having a pore diameter of 3.0 μm to remove impurities such as dusts and stored. The dispersion was stored at 10° C. or less until use.

Preparation of 25 Mass % Organic Polyhalogen Compound Dispersion-4

In the preparation of 20 mass % organic polyhalogen compound dispersion-1, the procedure of dispersion was repeated in the same manner except for using 5 kg of organic polyhalogen compound D (N-butyl-3-tribromomethanesulfonylbenzamido) in place of 5 kg of organic polyhalogen compound A (tribromomethylnaphthylsulfone). The dispersion was diluted to 25 mass % of the organic polyhalogen compound and then filtered.

The particles of the organic polyhalogen compound D contained in the thus-obtained organic polyhalogen compound dispersion had a median particle diameter of 0.41 μm and a maximum particle diameter of 2.0 μm or less. The obtained organic polyhalogen compound dispersion-4 was filtered through a polypropylene filter having a pore diameter of 3.0 μm to remove impurities such as dusts and stored.

Preparation of 5 Mass % Solution of Phthalazine Compound

Modified polyvinyl alcohol (MP203, manufactured by Kurare Co., Ltd.) (8 kg) was dissolved in 174.57 kg of water, then 3.15 kg of a 20 mass % aqueous solution of sodium triisopropylnaphthalenesulfonate and 14.28 kg of a 70 mass % aqueous solution of 6-isopropylphthalazine were added, thereby a 5 mass % solution of 6-isopropylphthalazine was prepared.

Preparation of 20 Mass % Dispersion of Pigment

Water (250 g) was added to 64 g of C.I. Pigment Blue 60 and 6.4 g of a surfactant (Demol N, manufactured by Kao Corporation), and they were thoroughly mixed to make a slurry. Zirconia beads (800 g) having an average diameter of 0.5 mm were added to a vessel with the above-obtained slurry and dispersed with a disperser (¼ G sand grinder mill, manufactured by Imex Co., Ltd.) for 25 hours, thereby the dispersion of the pigment was obtained. The particles of the pigment contained in the thus-obtained pigment dispersion had an average particle diameter of 0.21 μm.

Preparation of 40 Mass % SBR Latex

SBR latex shown below was diluted with distilled water to 10 times, and purified by means of module FS03-FC-FUY03A1 for ultrafiltration purification (manufactured by Daisen Membrane System Co., Ltd.) until the ionic conductivity became 1.5 mS/cm, and Sandet BL (manufactured by Sanyo Chemical Industries Co., Ltd.) was added in 0.22 mass %.

Further, NaOH and $NH_4OH$ were added so as to reach $Na^+$ ion/$NH_4^+$ ion of 1/2.3 (molar ratio), and pH was adjusted to 8.4. The concentration of the latex at this time was 40 mass %.

SBR Latex

Latex of —St(68)—Bu (29)—AA (3)—, Tg: 17° C.

Average particle size: 0.1 μm, concentration: 45 mass %, equilibrium moisture content at 25° C. 60% RH: 0.6 mass %, ionic conductivity: 4.2 mS/cm (ionic conductivity was measured using a conductometer CM-30S manufactured by Toa Denpa Kogyo Co., Ltd., and starting solution of the latex (40 mass %) was measured at 25° C.), pH: 8.2.

Preparation of Coating Solution for Emulsion Layer (Photosensitive Layer)

The above-obtained 20 mass % dispersion of pigment (1.1 g), 103 g of the fatty acid silver dispersion, 5 g of a 20 mass % aqueous solution of modified polyvinyl alcohol (PVA-205, manufactured by Kurare Co., Ltd.), 25 g of the above-prepared 25 mass % reducing agent dispersion, total weight of 16.3 g of the above-prepared organic polyhalogen compound dispersion-1, dispersion-2 and dispersion-3 in the ratio of 5/1/3 (mass ratio), 6.2 g of the 10 mass % dispersion of mercapto compound, 106 g of the 40 mass % SBR latex (Tg: 17° C.) purified by ultrafiltration to adjust pH, and 18 ml of the 5 mass % solution of phthalazine compound were mixed, and 10 g of the above-prepared mixed emulsion for each coating solution was thoroughly mixed with the above reaction mixture just before coating, thus an emulsion layer coating solution was obtained. The obtained emulsion layer coating solution was fed to a coating die as it was in a coating amount of 70 ml/$m^2$ and coated.

The above emulsion layer coating solution was revealed to have viscosity of 85 mpa·s at 40° C. (No. 1 rotor, 60 rpm) measured by Model B viscometer (manufactured by Tokyo Keiki Co., Ltd.).

The viscosity of the emulsion layer coating solution measured by RFS Fluid Spectrometer (manufactured by Rheometrics Far East Co.) at 25° C. was 1, 500, 220, 70, 40, 20 mPa·s at shear rate of 0.1, 1, 10, 100, 1,000 $s^{-1}$, respectively.

Preparation of Intermediate Layer Coating Solution of Emulsion Surface

To 772 g of a 10 mass % aqueous solution of polyvinyl alcohol (PVA-205, manufactured by Kurare Co., Ltd.), 5.3 g of the 20 mass % dispersion of pigment, and 226 g of a 27.5 mass % solution of latex of methyl methacrylate/styrene/butyl acrylate/hydroxyethyl methacrylate/acrylic acid copolymer (copolymerization mass ratio: 64/9/20/5/2) were added 2 ml of a 5 mass % aqueous solution of Aerosol OT (manufactured by American Cyanamide Co.), and 10.5 ml of a 20 mass % aqueous solution of phthalic acid ammonium salt. Water was added to make the total amount 880 g, thereby an intermediate layer coating solution having pH of 7.5 adjusted with NaOH was prepared, which was fed to a coating die in a coating amount of 10 ml/$m^2$.

The viscosity of the coating solution was 21 mPa·s at 40° C. (No. 1 rotor, 60 rpm) measured by Model B viscometer.

Preparation of First Emulsion Surface Protective Layer Coating Solution

Inert gelatin 64 g was dissolved in water, and 80 g of a 27.5 mass % latex of methyl methacrylate/styrene/butyl acrylate/hydroxyethyl methacrylate/acrylic acid copolymer (copolymerization ratio by mass: 64/9/20/5/2), 23 ml of a 10 mass % methanol solution of phthalic acid, 23 ml of a 10 mass % aqueous solution of 4-methylphthalic acid, 28 ml of a sulfuric acid of 0.5 mol/liter, 5 ml of a 5 mass % aqueous solution of Aerosol OT (manufactured by American Cyanamide Co.), 0.5 g of phenoxyethanol, and 0.1 g of benzoisothiazolinone were added thereto. Water was added to make the total amount 750 g, and this mixed solution was mixed with 26 ml of a 4 mass % of chrome alum just before coating, and the obtained coating solution was fed to a coating die in a coating amount of 18.6 ml/m$^2$.

The viscosity of the coating solution was 17 mPa·s at 40° C. (No. 1 rotor, 60 rpm) measured by Model B viscometer.

Preparation of Second Emulsion Surface Protective Layer Coating Solution

Inert gelatin 80 g was dissolved in water, and 102 g of a 7.5 mass % latex of methyl methacrylate/styrene/butyl acrylate/hydroxyethyl acrylate/acrylic acid copolymer (copolymerization ratio by mass: 64/9/20/5/2), 3.2 ml of a 5 mass % aqueous solution of N-perfluorooctylsulfonyl-N-propylalanine potassium salt, 32 ml of a 2 mass % aqueous solution of polyethylene glycol mono(N-perfluorooctylsulfonyl-N-propyl-2-aminoethyl) ether (average polymerization degree of ethylene oxide: 15), 23 ml of a 5 mass % aqueous solution of Aerosol OT (manufactured by American Cyanamide Co.), 4 g of polymethyl methacrylate fine particles (average particle size: 0.7 μm), 21 g of polymethyl methacrylate fine particles (average particle size: 6.4 μm), 1.6 g of 4-methylphthalic acid, 4.8 g of phthalic acid, 44 ml of sulfuric acid of 0.5 mol/liter, and 10 mg of benzoisothiazolinone were added thereto. Water was added to make the total amount 650 g, and this mixed solution was mixed with 445 ml of an aqueous solution containing a 4 mass % chrome alum and a 0.67 mass % phthalic acid by means of a static mixer just before coating, thereby a surface protective layer coating solution was obtained. The obtained coating solution was fed to a coating die in a coating amount of 8.3 ml/m$^2$.

The viscosity of the coating solution was 9 mPa·s at 40° C. (No. 1 rotor, 60 rpm) measured by Model B viscometer.

Preparation of Heat-Developable Photosensitive Material

On the back side surface of the above-prepared undercoated support, the antihalation layer coating solution and the back surface protective layer coating solution were simultaneously coated and dried in such a manner that the gelatin coating amount of the back surface protective layer coating solution became 1.7 g/m$^2$ and the antihalation layer had a adsorption of 0.3 in 405 nm, thereby a backing layer was prepared.

The emulsion layer (the coating silver amount of the silver halide was 0.14 g/m$^2$), the intermediate layer, the first protective layer and the second protective layer were simultaneously multilayer-coated by slide bead coating on the opposite side of the backing layer side in this order from the undercoat surface, thereby heat-developable photosensitive material samples (shown in Table 1) were prepared.

Coating conditions were as follows.

Coating speed was 160 m/min. The distance between the tip of the coating die and the support was from 0.10 to 0.30 mm. The pressure in the pressure reducing chamber was set lower than atmospheric pressure by 196 to 882 Pa. Ionic air was blown to the support so as not to be charged with electricity.

In the subsequent chilling zone, air of dry-bulb temperature of from 10 to 20° C. was blown to cool the coating solution, each material sample was transported so as not to touch anything, and then dried by dry air of dry-bulb temperature of from 23 to 45° C. and wet-bulb temperature of from 15 to 21° C. on a helical floating non-contact type drying zone.

After drying, the sample was subjected to humidity conditioning at 25° C. and 40 to 60% RH. Subsequently, the film surface was heated at 70 to 90° C., and then cooled to 25° C.

The matting degree of the photosensitive layer surface of the obtained heat-developable photosensitive material was Beck's smoothness of 550 seconds and the backing layer surface was 130 seconds. pH of the film surface of the photosensitive layer was 6.0.

Evaluation (1) Evaluation of Photographic Performances

Each heat-developable photosensitive material prepared above was subjected to exposure and thermal development (about 120° C.) with Fuji Medical Dry Laser Imager FM-DPL (mounting a 660 nm semiconductor laser having maximum output of 60 mW (IIIB)), and the obtained image was evaluated using a densitometer. The results of measurement were evaluated by Dmin (fog) and sensitivity.

Sensitivity was the reciprocal of exposure amount required to give the density of Dmin+1.0 and expressed as a relative value taking the sensitivity of heat-developable photosensitive material 1 as 100.

(2) Evaluation of Aging Stability

Each sample was aged for 10 days at 50° C. 70% RH (forced aging). Dmin and sensitivity of this sample was evaluated in the same manner as in (1) evaluation of photographic performances. The results obtained are shown in Table 1 below.

TABLE 1

| Sample No. | Average Equivalent-Circle Diameter | Sensitizing Dye | Sensitivity | Dmin | Sensitivity after Aging | Dmin after Aging | Remarks |
|---|---|---|---|---|---|---|---|
| 1 | 42 | SS-1 | 100 (control) | 0.21 | 52 | 0.31 | Comparison |
| 2 | 42 | DD-24 | 151 | 0.18 | 134 | 0.20 | Invention |
| 3 | 42 | DD-23 | 152 | 0.18 | 135 | 0.20 | Invention |
| 4 | 42 | DD-17 | 201 | 0.18 | 195 | 0.19 | Invention |
| 5 | 42 | DD-18 | 200 | 0.17 | 195 | 0.18 | Invention |
| 6 | 42 | DD-36 | 225 | 0.16 | 224 | 0.16 | Invention |
| 7 | 42 | DD-35 | 223 | 0.16 | 222 | 0.16 | Invention |
| 8 | 42 | DD-50 | 230 | 0.16 | 229 | 0.16 | Invention |
| 9 | 42 | SS-2 | 101 | 0.20 | 53 | 0.32 | Comparison |
| 10 | 42 | DD-25 | 151 | 0.18 | 133 | 0.20 | Invention |
| 11 | 42 | DD-20 | 198 | 0.18 | 191 | 0.19 | Invention |
| 12 | 42 | DD-38 | 220 | 0.16 | 218 | 0.16 | Invention |
| 13 | 42 | DD-54 | 141 | 0.18 | 110 | 0.25 | Invention |
| 14 | 42 | SS-1/SS-2 = 1/1 | 105 | 0.21 | 58 | 0.30 | Comparison |
| 15 | 42 | DD-17/DD-20 = 1/1 | 241 | 0.18 | 235 | 0.19 | Invention |

TABLE 1-continued

| Sample No. | Average Equivalent-Circle Diameter | Sensitizing Dye | Sensitivity | Dmin | Sensitivity after Aging | Dmin after Aging | Remarks |
|---|---|---|---|---|---|---|---|
| 16 | 42 | DD-35/DD-38 = 1/1 | 261 | 0.16 | 260 | 0.16 | Invention |
| 17 | 80 | SS-1 | 138 | 0.25 | 53 | 0.41 | Comparison |
| 18 | 80 | DD-17 | 181 | 0.21 | 171 | 0.24 | Invention |

From the results of Samples 1 to 16 (each of which has an average equivalent-circle diameter of the photosensitive silver halide of 42 nm), it can be seen that the heat-developable photosensitive materials of the present invention using the sensitizing dye represented by formula (A) or (I) are high sensitivity and the reduction of sensitivity after aging is largely inhibited as compared with the heat-developable photosensitive materials using comparative dyes.

Further, from the results of Samples 1 and 4 (having an average equivalent-circle diameter of 42 nm) and Samples 17 and 18 (having an average equivalent-circle diameter of 80 nm), it can be seen that the storage stability of the material is higher and preferred when the average equivalent-circle diameter of the silver halide emulsion for use in the present invention is 42 nm as compared with the case of 80 nm.

As is apparent from the above, the sensitizing dye represented by formula (A) or (I) for use in the present invention, having the structure in which two or more dyes are linked by covalent bonding is conspicuously excellent in storage stability. Further, it has been found that the storage stability is particularly excellent when the average equivalent-circle diameter of the silver halide emulsion is from 10 to 50 nm.

EXAMPLE 2

Comparison similar to Example 1 was performed as follows. In the heat-developable photosensitive materials in Example 5 in JP-A-2000-122206, evaluation was performed in the same manner as in Example 1, except that SS-3 shown below, DD-11 and DD-72 were used in place of comparative dye A (provided that the addition amounts of DD-11 and DD-72 were half of the amount of SS-3), and the conditions of the evaluation of storage stability in Example 5 in JP-A-2000-122206 of 50° C. 75% RH for 3 days were changed to 60° C., 70% RH for 10 days.

As a result, SS-3 showed sensitivity of 100 (control), Dmin of 0.14, sensitivity after aging of 60, and Dmin after aging of 0.23. In the contrast, DD-11 showed sensitivity of 198, Dmin of 0.12, sensitivity after aging of 187 and Dmin after aging of 0.14, and DD-72 showed sensitivity of 185, Dmin of 0.12, sensitivity after aging of 160 and Dmin after aging of 0.17. These results show that DD-11 and DD-72 according to the present invention are excellent sensitizing dyes.

SS-3

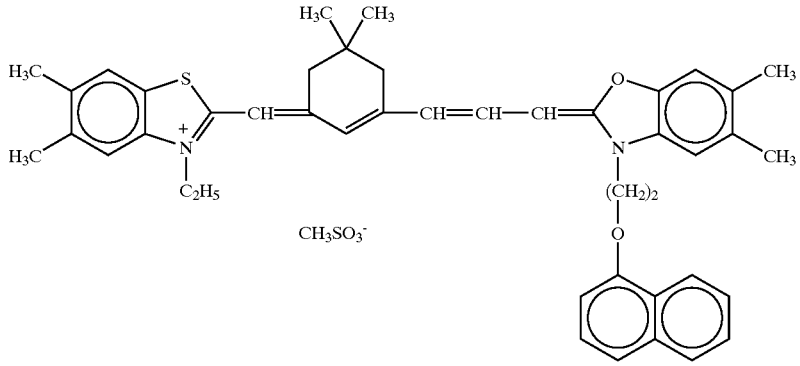

EXAMPLE 3

Evaluation was performed in the same manner as in Example 1, except for using SS-3 and DD-1 of the present invention in place of comparative dye A in Example 1 in JP-A-6-130607 (provided that the addition amount of DD-11 was half of the amount of SS-3), and changing the conditions of the evaluation of storage stability in Example 1 in JP-A-6-130607 of 60° C. 60% RH for 3 days to 60° C., 80% RH for 10 days.

As a result, SS-3 showed sensitivity of 100 (control) and sensitivity of 58 after aging at 60° C. 80% RH for 10 days, contrary to this, DD-11 was proved to be excellent to show sensitivity of 197 and sensitivity after aging of 189.

EXAMPLE 4

Evaluation was performed in the same manner as in Example 1, except for: using SS-4 and SS-5 in place of comparative dye SS-1 in sample No. 1 of Example 1; using DD-43 and DD-44 in place of DD-24 of the present invention in sample No. 2 of Example 1; changing the conditions of the evaluation of storage stability of 50° C. 70% RH for 10 days to 60° C., 80% RH for 2 days; and using a 810 nm semiconductor laser for an imagewise exposure (the angle of the laser beam to a surface to be exposed was 80 deg., and output of the laser was 75 mW, provided that a high-frequency superposition was performed, and output in a vertical multimode was performed. The exposure time was $1\times10^{-7}$ sec.).

As a result, DD-43 and DD-44, the dyes for use in the present invention, were excellent in the sensitivity and the inhibition of reduction of sensitivity after aging as compared with the SS-4 and SS-5, the comparative dyes.

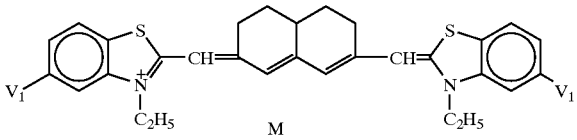

M

SS-4 $V_1$=$SCH_3$ M=p-$TsO^-$

SS-5 $V_1$=$SOCH_3$ M=$BF_4^-$

The present invention can provide a heat-developable photosensitive material of high sensitivity and excellent in storage stability.

While the invention has been described in detail and with reference to specific examples thereof, it will be apparent to one skilled in the art that various changes and modifications can be made therein without departing from the spirit and scope thereof.

What is claimed is:

1. A eat-developable photosensitive material comprising:

a support;

a photosensitive silver halide;

a non-photosensitive organic silver salt;

a reducing agent for a silver ion;

a binder; and a compound represented by formula (A)

(A)

$$D^a([—L^a—]q^b[D^b]q^a)r^a \quad M^a m^a$$

wherein $D^a$ and $D^b$ each independently represents a dye chromophore; $L^a$ represents a linking group or a single bond; $q^a$ is 1 and $r^a$ is 1 or 2; $q^b$ represents an integer of from 1 to 4; $M^a$ represents a a counter ion for equilibrating the electric charge; and $m^a$ represents a number necessary to neutralize the electric charge of the molecule.

2. The heat-developable photosensitive material as claimed in claim 1, wherein the compound represented by formula (A) is a compound having a structure represented by formula (I):

(I)

$$D^1([—L^1—]q^2[D^1]q^1)r^1 \quad M^1 m^1$$

wherein $D^1$ represents a dye chromophore; $L^1$ represents a linking group or a single bond; $q^1$ is 1 and $r^1$ is 1 or 2; $q^2$ represents an integer of from 1 to 4; $M^1$ represents a counter ion for equilibrating the electric charge; and $m^1$ represents a number necessary to neutralize the electric charge of the molecule.

3. The heat-developable photosensitive material as claimed in claim 2, wherein $D^1$ is a dye chromophore having a structure represented by one of formulae (XI), (XII) and (XIII):

(XI)

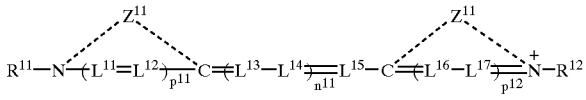

$M^{11}m^{11}$ wherein $L^{11}$, $L^{12}$, $L^{13}$, $L^{14}$, $L^{15}$, $L^{16}$ and $L^{17}$ each represents a methine group; $p^{11}$ and $p^{12}$ each represents 0 or 1; $n^{11}$ represents 0, 1, 2, 3 or 4; $Z^{11}$ and $Z^{12}$ each represents an atomic group necessary to form a nitrogen-containing heterocyclic ring, and $Z^{11}$ and $Z^{12}$ each may be a condensed ring; $M^{11}$ represents a counter ion for equilibrating the electric charge; $m^{11}$ represents a number of 0 or higher necessary to neutralize the electric charge of the molecule; and $R^{11}$ and $R^{12}$ each represents a hydrogen atom, an alkyl group, an aryl group or a heterocyclic group;

(XII)

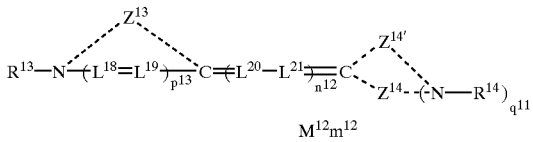

$M^{12}m^{12}$ wherein $L^{18}$, $L^{19}$, $L^{20}$ and $L^{21}$ each represents a methine group; $p^{13}$ represents 0 or 1; $q^{11}$ represents 0 or 1; $n^{12}$ represents 0, 1, 2, 3 or 4; $Z^{13}$ represents an atomic group necessary to form a nitrogen-containing heterocyclic ring; $Z^{14}$ and $Z^{14'}$ each represents an atomic group necessary to form a heterocyclic ring or an acyclic acidic terminal group together with $(N—R^{14})q^{11}$; $Z^{13}$, and $Z^{14}$ and $Z^{14'}$ each may be a condensed ring; $M^{12}$ represents a counter ion for equilibrating the electric charge; $m^{12}$ represents a number of 0 or higher necessary to neutralize the electric charge of the molecule; and $R^{13}$ and $R^{14}$ each represents a hydrogen atom, an alkyl group, an aryl group or a heterocyclic group;

(XIII)

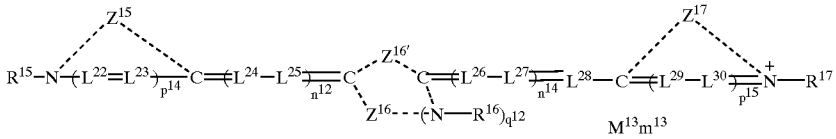

wherein $L^{22}$, $L^{23}$, $L^{24}$, $L^{25}$, $L^{26}$, $L^{27}$, $L^{28}$, $L^{29}$, and $L^{30}$ each represents a methine group; $p^{14}$ and $p^{15}$ each represents 0 or 1; $q^{12}$ represents 0 or 1; $n^{13}$ and $n^{14}$ each represents 0, 1, 2, 3 or 4; $Z^{15}$ and $Z^{17}$ each represents an atomic group necessary to form a nitrogen-containing heterocyclic ring; $Z^{16}$ and $Z^{16'}$ each represents an atomic group necessary to form a heterocyclic ring together with $(N—R^{16})q^{12}$; $Z^{15}$, $Z^{16}$ and $Z^{16'}$, and $Z^{17}$ each may be a condensed ring; $M^{13}$ represents a counter ion for equilibrating the electric charge; $m^{13}$ represents a number of 0 or higher necessary to neutralize the electric charge of the molecule; and $R^{15}$, $R^{16}$ and $R^{17}$ each represents a hydrogen atom, an alkyl group, an aryl group or a heterocyclic group.

4. The heat-developable photosensitive material as claimed in claim 2, wherein the compound represented by formula (I) is a compound represented by one of formulae (XXI) and (XXII):

(XXI)

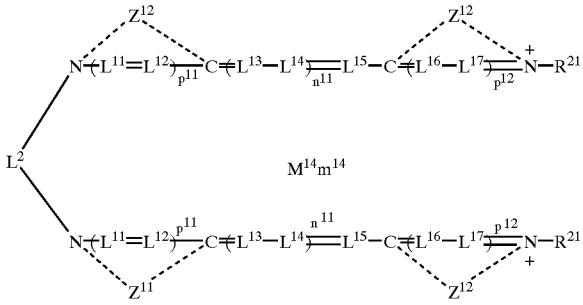

wherein $L^{11}$, $L^{12}$, $L^{13}$, $L^{14}$, $L^{15}$, $L^{16}$, $L^{17}$, $p^{11}$, $p^{12}$, $n^{11}$, $Z^{11}$ and $Z^{12}$ each has the same meaning as in formula (XI); $L^2$ represents a linking group; $M^{14}$ represents a counter ion for equilibrating the electric charge; $m^{14}$ represents a number of 0 or higher necessary to neutralize the electric charge of the molecule; and $R^{21}$ represents an alkyl group, an aryl group or a heterocyclic group;

(XXII)

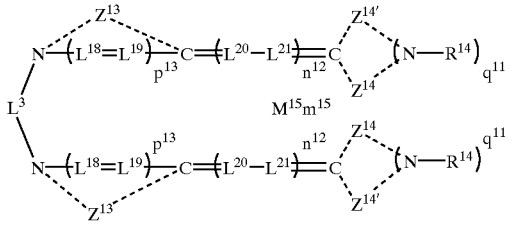

wherein $L^{18}$, $L^{19}$, $L^{20}$, $L^{21}$, $p^{13}$, $q^{11}$, $n^{12}$, $Z^{13}$, $L^{14}$, $L^{14'}$ and $R^{14}$ each has the same meaning as in formula (XII); $L^3$ represents a linking group; $M^{15}$ represents a counter ion for equilibrating the electric charge; and $m^{15}$ represents a number of 0 or higher necessary to neutralize the electric charge of the molecule.

5. The heat-developable photosensitive material as claimed in claim 2, wherein the compound represented by formula (I) is a compound represented by one of formulae (XXXIa), (XXXIb) and (XXXII):

(XXXIa)

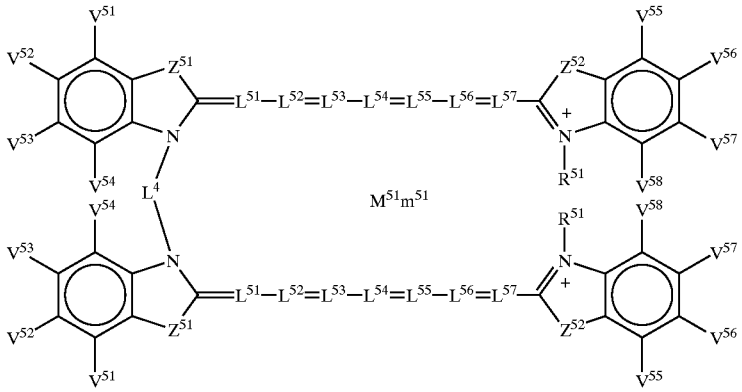

wherein $Z^{51}$ and $Z^{52}$ each represents an oxygen atom, a sulfur atom, a selenium atom, a nitrogen atom or a carbon atom; $R^{51}$ represents an alkyl group, an aryl group or a heterocyclic group; $L^{51}$, $L^{52}$, $L^{53}$, $L^{54}$, $L^{55}$, $L^{56}$ and $L^{57}$ each represents a methine group; $V^{51}$, $V^{52}$, $V^{53}$, $V^{54}$, $V^{55}$, $V^{56}$, $V^{57}$ and $V^{58}$ each represents a hydrogen atom or a substituent; $L^4$ represents a linking group; $M^{51}$ represents a counter ion for equilibrating the electric charge; and $m^{51}$ represents a number of 0 or higher necessary to neutralize the electric charge of the molecule;

(XXXIb)

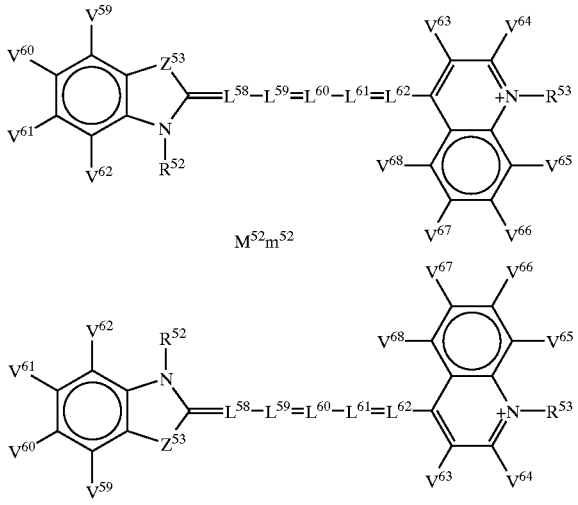

wherein $Z^{53}$ represents an oxygen atom, a sulfur atom, a selenium atom, a nitrogen atom or a carbon atom; $R^{52}$ and $R^{53}$ each represents an alkyl group, an aryl group or a heterocyclic group, provided that either two $R^{52}$'s or two $R^{53}$'s form $L^5$ jointly; $L^5$ represents a linking group; $L^{58}$, $L^{59}$, $L^{60}$, $L^{61}$ and $L^{62}$ each represents a methine group; $V^{59}$, $V^{60}$, $V^{61}$, $V^{62}$, $V^{63}$, $V^{64}$, $V^{65}$, $V^{66}$, $V^{67}$ and $V^{68}$ each represents a hydrogen atom or a substituent; $M^{52}$ represents a counter ion for equilibrating the electric charge; and $m^{52}$ represents a number of 0 or higher necessary to neutralize the electric charge of the molecule;

(XXXII)

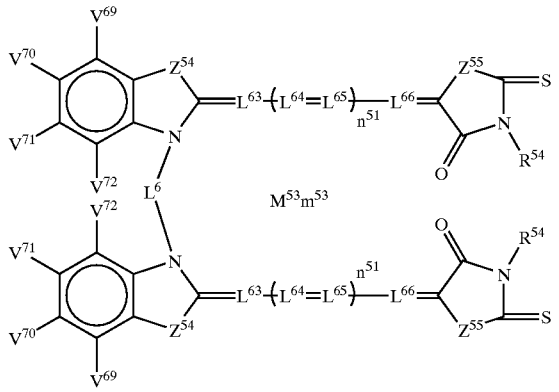

wherein $Z^{54}$ represents an oxygen atom, a sulfur atom, a selenium atom, a nitrogen atom or a carbon atom; $Z^{55}$ represents an oxygen atom, a sulfur atom or a nitrogen atom; $R^{54}$ represents an alkyl group, an aryl group or a heterocyclic group; $L^6$ represents a linking group; $L^{63}$, $L^{64}$, $L^{65}$ and $L^{66}$ each represents a methine group; $n^{51}$ represents 1 or 2; $V^{69}$, $V^{70}$, $V^{71}$ and $V^{72}$ each represents a hydrogen atom or a substituent; $M^{53}$ represents a counter ion for equilibrating the electric charge; and $m^{53}$ represents a number of 0 or higher necessary to neutralize the electric charge of the molecule.

6. The heat-developable photosensitive material as claimed in claim 2, wherein $D^1$ is a dye chromophore which is selected from the group consisting of a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, a holopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphyrin dye, a chlorophyll dye, a phthalocyanine dye, and a metallic complex dye.

7. The heat-developable photosensitive material as claimed in claim 2, wherein $D^1$ is a dye chromophore which is selected from the group consisting of a cyanine dye and a merocyanine dye.

8. The heat-developable photosensitive material as claimed in claim 2, wherein $L^1$ is divalent linking group.

9. The heat-developable photosensitive material as claimed in claim 2, wherein $L^1$ is a single bond.

10. The heat-developable photosensitive material as claimed in claim 1, wherein the compound represented by formula (A) is adsorbed in a single layer.

11. The heat-developable photosensitive material as claimed in claim 1, wherein the photosensitive silver halide has an average equivalent-circle diameter of from 10 to 50 nm.

12. The heat-developable photosensitive material as claimed in claim 1, which further comprises an image-forming layer containing the photosensitive silver halide, the non-photosensitive organic silver salt and the compound represented by formula (A).

13. The heat-developable photosensitive material as claimed in claim 12, wherein the image-forming layer further contains the reducing agent for a silver ion and the binder.

14. The heat-developable photosensitive material as claimed in claim 12, which further comprises a second image-forming layer containing the reducing agent for a silver ion and the binder.

15. The heat-developable photosensitive material as claimed in claim 1, wherein $D^a$ and $D^b$ are the same dye chromophore.

16. The heat-developable photosensitive material as claimed in claim 2, wherein $L^1$ is a linking group which comprises an atom or an atomic group containing at least one carbon atom, nitrogen atom, sulfur atom or oxygen atom.

17. The heat-developable photosensitive material as claimed in claim 2, wherein $L^1$ is a linking group having from 1–20 carbon atoms comprising one or more alkylene group, arylene group, alkenylene group, alkynylene group, amido group, ester group, sulfoamido group, sulfonic ester group, ureido group, sulfonyl group, sulfinyl group, thioether group, ether group, carbonyl group, —N(Va)-, wherein Va represents a hydrogen atom or a monovalent substituent, or a heterocyclic divalent group.

* * * * *